US005229248A

United States Patent [19]

Sanpei et al.

[11] Patent Number: 5,229,248

[45] Date of Patent: Jul. 20, 1993

[54] SILVER HALIDE PHOTOGRAPHIC LIGHT SENSITIVE MATERIAL

[75] Inventors: Takeshi Sanpei; Kenji Goto, both of Hino, Japan

[73] Assignee: Konica Corporation, Tokyo, Japan

[21] Appl. No.: 744,055

[22] Filed: Aug. 13, 1991

[30] Foreign Application Priority Data

Aug. 16, 1990 [JP] Japan ..... 2-216590
Sep. 4, 1990 [JP] Japan ..... 2-234203

[51] Int. Cl.[5] ..... G03C 1/06

[52] U.S. Cl. ..... 430/264; 430/598; 430/601; 430/599

[58] Field of Search ..... 430/264, 598, 601, 599

[56] References Cited

U.S. PATENT DOCUMENTS

| | | | |
|---|---|---|---|
| 4,853,312 | 8/1989 | Yamada | 430/264 |
| 4,929,535 | 5/1990 | Takahashi et al. | 430/264 |
| 4,975,354 | 12/1990 | Machonkin et al. | 430/264 |
| 4,987,052 | 1/1991 | Hirano et al. | 430/264 |
| 4,988,604 | 1/1991 | Machonkin et al. | 430/264 |
| 5,024,932 | 6/1991 | Tanji et al. | 430/642 |
| 5,041,355 | 8/1991 | Machonkin et al. | 430/264 |

FOREIGN PATENT DOCUMENTS

| | | | |
|---|---|---|---|
| 0196626A3 | 10/1986 | European Pat. Off. . | |
| 0324391A3 | 7/1989 | European Pat. Off. . | |
| 0204322 | 11/1983 | German Democratic Rep. | 430/642 |
| 62-0280733 | 12/1987 | Japan . | |
| 03-24391 | 7/1989 | Japan . | |
| 02-67639 | 10/1989 | Japan . | |
| 2-0008833 | 1/1990 | Japan . | |

OTHER PUBLICATIONS

Patent Abstracts of Japan, vol. 12, No. 166 (P-704) (3013), 1988.

Patent Abstracts of Japan, vol. 14, No. 148 (P-1024) (4091), 1990.

*Primary Examiner*—Hoa Van Le
*Assistant Examiner*—Thomas R. Neville
*Attorney, Agent, or Firm*—Finnegan, Henderson, Farabow, Garrett & Dunner

[57] ABSTRACT

A silver halide photographic light-sensitive material is disclosed, which is capable of forming an extremely high contrast image with high dot quality and is inhibited in formation of pepper spots. The light-sensitive material comprises a support, and provided thereon, a photographic layer including a silver halide emulsion layer, wherein the pH value of the surface of said photographic layer is 5.9 or more and said emulsion layer or a layer adjacent to said emulsion layer contains a specified hydrazine compound, and an amine compound or a quaternary onium compound.

12 Claims, No Drawings

SILVER HALIDE PHOTOGRAPHIC LIGHT SENSITIVE MATERIAL

FIELD OF THE INVENTION

This invention relates to a photographic light sensitive material comprising a support having thereon a silver halide light sensitive layer and, particularly, to a silver halide photographic light sensitive material capable of displaying a high contrast.

BACKGROUND OF THE INVENTION

A photomechanical process includes a step for converting a continuous tone original image into a half-tone dot image. To this step, an infectious developing technique has been applied as a technique capable of reproducing a super-hard contrast image.

A lithographic type silver halide photographic light sensitive material to be treated in an infectious development process is comprised of, for example, a silver chlorobromide emulsion having an average grain size of 0.2 μm, a narrow grain distribution, a uniform grain configuration, and a high silver chloride content in a proportion of not less than 50 mol % at least. When the lithographic type silver halide photographic light sensitive material is processed with an alkaline hydroquinone developer having a low sulfite ion concentration, that is so-called a lith type developer, an image high in contrast, sharpness and resolving power can be provided.

However, these lith type developers are seriously deteriorated in preservability, because it is liable to be air-oxidized. Therefore, a development quality can hardly be kept instant also in a repetition use.

There is a known method in which an image having a high contrast can rapidly be obtained without making use of the above-mentioned lith type developer. For example, as appeared in Japanese Patent Publication Open to Public Inspection—hereinafter referred to as JP OPI Publication—No. 56-106244/1981, the method is that a hydrazine derivative is contained in a silver halide light sensitive material. According to this method, an extreme high contrast image can be obtained by processing with a well preservable and rapidly processable developer.

In the above-mentioned technique, a developer having a high pH of not lower than pH 11.0 is required to be used for satisfactorily displaying the high contrast property of hydrazine derivatives. In such developers having a high pH of not lower than 11.0, the developing agents thereof are liable to be oxidized when they are exposed to the air, though they are rather stable than the lith type developers. When the developing agents are oxidized, there may frequently be some instances where an extreme high contrast image may not be obtained.

For overcoming the above-described defects, JP OPI Publication No. 63-29751/1988 and European Patent Nos. 333,435 and 345,025 disclose the silver halide photographic light sensitive materials each containing a contrast raising agent capable of making a contrast higher even in a developer having a comparatively lower pH.

However, when the silver halide photographic light sensitive material containing such a contrast raising agent as mentioned above is processed with the developer having a pH of lower than pH 11.0, the high-contrast results are not satisfactory and any satisfactory half-tone characteristics cannot be obtained, which have been the present situations.

SUMMARY OF THE INVENTION

It is an object of the invention to provide a silver halide photographic light sensitive material capable of displaying the high-contrast photographic characteristics even with a developer having a pH of lower than 11.0 and inhibiting the pepper spots from producing in half-tone dots.

The above-mentioned object of the invention can be achieved with a silver halide photographic light sensitive material comprising a support bearing thereon at least one of silver halide photographic emulsion layers, wherein the surface pH is not lower than 5.9 on the side coated with the silver halide emulsion layer, and the silver halide emulsion layers and/or the adjacent layers thereto contain each at least one kind of hydrazine derivatives represented by the following formula A, B or C and one kind of the compounds selected from the group consisting of amine compounds or quaternary onium salts.

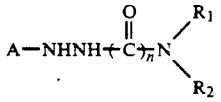

Formula A

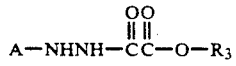

Formula B

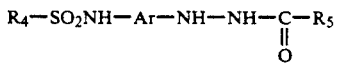

Formula C wherein A represents an aryl group or a heterocyclic group containing at least one sulfur or oxygen atom; n is an integer of 1 or 2; $R_1$ and $R_2$ represent each a hydrogen atom, an alkyl group, an alkenyl group, an alkynyl group, an aryl group, a saturated or unsaturated heterocyclic group, a hydroxy group, an alkoxy group, an alkenyloxy group, an alkynyloxy group, an aryloxy group, or a heterocyclic-oxy group, provided, when n is 1, $R_1$ and $R_2$ may form a ring, together with the nitrogen atom; and when n is 2, at least either one of $R_1$ and $R_2$ represents an alkenyl group, an alkynyl group, a saturated heterocyclic group, a hydroxy group, an alkoxy group, an alkynyloxy group, an alkinyloxy group, an aryloxy group or a heterocyclic-oxy group; $R_3$ represent an alkynyl group or a saturated heterocyclic group; $R_4$ represents an alkyl group, an aryl group or a heterocyclic group; $R_5$ represents a hydrogen atom or a blocking group; and Ar represents an arylene group or a heterocyclic group.

The compounds represented by formulas A and B will be detailed below.

A represents an aryl group such as a phenyl or naphthyl group, or a heterocyclic group containing at least one of sulfur or oxygen atom, such as a thiophene, furan, benzothiophene or pyrane group;

$R_1$ and $R_2$ represent each a hydrogen atom, alkyl groups including, for example, a methyl, ethyl, methoxyethyl, cyanoethyl, hydroxyethyl, benzyl, or trifluoroethyl group, alkenyl groups including, for example, an allyl, butenyl, pentenyl or pentadienyl group, alkynyl groups including, for example, a propargyl, butynyl or pentynyl group, aryl groups including, for example, a phenyl, naphthyl, cyanophenyl or methoxyphenyl group, heterocyclic groups including, for example, an unsaturated heterocyclic group such as a pyridine, thiophene, or furan group and saturated heterocyclic groups such as a tetrahydrofuran or sulforan group, hydroxy groups, alkoxy groups including, for example, a methoxy, ethoxy, benzyloxy or cyanomethoxy group, alkenyloxy groups including, for example, an allyloxy or butenyloxy group, alkynyloxy groups including, for example, a propargyloxy or butynyloxy group, aryloxy groups including, for example, a phenoxy or naphthyloxy group, and heterocyclic-oxy groups including, for example, a pyridyloxy or pyrimidyloxy group; provided, when n is 1, $R_1$ and $R_2$ may form a ring such as that of piperidine, piperazine or morpholine, together with a nitrogen atom; and provided, when n is 2, at least either one of $R_1$ and $R_2$ is to represent an alkenyl, alkynyl, saturated heterocyclic, hydroxy, alkoxy, alkenyloxy, alkynyloxy, aryloxy or heterocyclic-oxy group.

The typical examples of the alkynyl and saturated heterocyclic groups each represented by $R_3$ include those given above.

A variety of substituents may be introduced into the aryl groups or the heterocyclic groups each having at least one sulfur or oxygen atom, which are represented by A. The substituents which may be introduced thereinto include, for example, a halogen atom, an alkyl group, an aryl group, an alkoxy group, an aryloxy group, an acyloxy group, an alkylthio group, an arylthio group, a sulfonyl group, an alkoxycarbonyl group, an aryloxycarbonyl group, a carbamoyl group, a sulfamoyl group, an acyl group, an amino group, an alkylamino group, alkylideneamino, an arylamino group, an acylamino group, a sulfonamido group, an arylaminothiocarbonylamino group, a hydroxy group, a carboxy group, a sulfo group, a nitro group, and a cyano group. The preferably applicable substituents among them include, for example, a sulfonamido group, an alkylamino group and an alkylideneamino group.

In each of the formulas given above, it is preferable that A contains at least one of ballast groups or silver halide adsorption accelerating group. As the ballast groups, a ballast group commonly used in an immobile photographic additive such as a coupler may preferably be used. The ballast groups are the groups which have not less than 8 carbon atoms and are comparatively inert to photographic characteristics, and they can be selected from the group consisting of, for example, an alkyl group, an alkoxy group, a phenyl group, an alkylphenyl group, a phenoxy group and an alkylphenoxy group.

The silver halide adsorption accelerating groups include, for example, a thiourea group, a thiourethane group, a heterocyclic thioamido group, a mercaptoheterocyclic group and a triazole group such as those given in U.S. Pat. No. 4,385,108.

In the invention, the preferable compounds are those in the case of n=2 and those represented by formula B.

Among the compounds represented by formula A in the case of n=2, the compounds are preferable when $R_1$ and $R_2$ represent each a hydrogen atom, an alkyl, alkenyl, alkynyl, aryl, saturated or unsaturated heterocyclic, hydroxy or alkoxy group and at least one of $R_1$ and $R_2$ represents an alkenyl, alkynyl, saturated heterocyclic, hydroxy or alkoxy group.

Among the compounds represented by formula A, the particularly preferable compounds are represented by the following formula A-1;

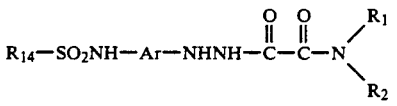

Formula A-1 wherein $R_1$ and $R_2$ are synonymous with those defined in formula A, and at least one of $R_1$ and $R_2$ represents an alkenyl, alkynyl, saturated heterocyclic, hydroxy, alkoxy, alkenyloxy, alkynyloxy, aryloxy or heterocyclic-oxy group; $R_{14}$ represents an alkyl, aryl or heterocyclic group; and Ar represents an arylene or a saturated or unsaturated heterocyclic group.

The above-given formula A-1 will now be further detailed.

$R_{14}$ represents an alkyl group including, for example, an octyl, t-octyl, decyl, dodecyl or tetradecyl group, an aryl group including, for example, a phenyl, p-propyl, phenyl or naphthyl group, or a heterocyclic group including, for example, a pyridyl, tetrazoline, oxazolyl, benzoxazolyl, benzothiazolyl or benzoimidazolyl group.

$R_{10}$ is preferable to contain at least one of either ballast groups or silver halide adsorption accelerating groups such as the above-mentioned.

Ar represents an arylene group or a heterocyclic group and, preferably, an arylene group.

$R_1$ and $R_2$ are each synonymous with $R_1$ and $R_2$ denoted in formula A.

Among the compounds represented by formula A-1, the preferable compounds include, for example, the compounds in which $R_{10}$ comprises a substituted alkyl group, a substituted aryl group or a substituted heterocyclic group each having at least one of the ballast groups or the silver halide adsorption accelerating groups, $Ar_1$ comprises an arylene group, $R_1$ and $R_2$ comprise each a hydrogen atom, an alkyl group, an alkenyl group, an alkynyl group, an aryl group, a saturated or unsaturated heterocyclic group, a hydroxy group or an alkoxy group, and at least one of $R_1$ and $R_2$ comprises an alkenyl group, an alkynyl group, a saturated heterocyclic group, a hydroxy group or an alkoxy group.

The typical compounds represented by formulas A and B include, for example, the following compounds:

Typical examples of the compounds

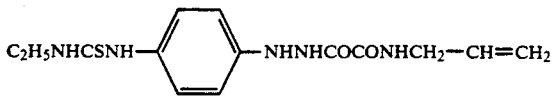

(1)

-continued
(2)
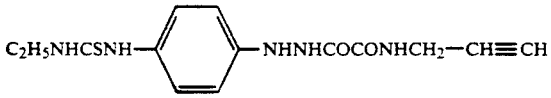
(3)
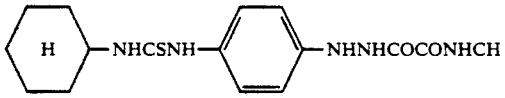
(4)
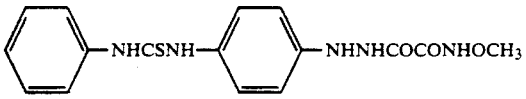
(5)
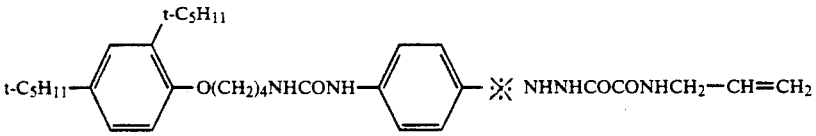
(6)
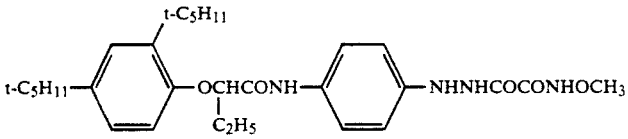
(7)
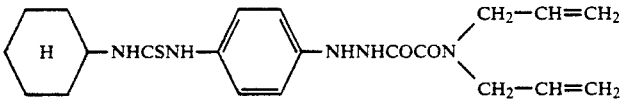
(8)
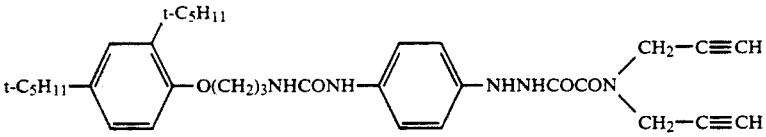
(9)
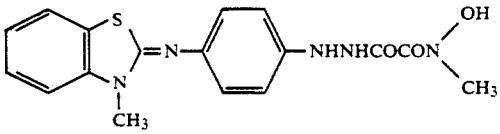
(10)
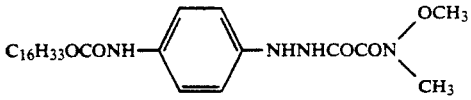
(11)
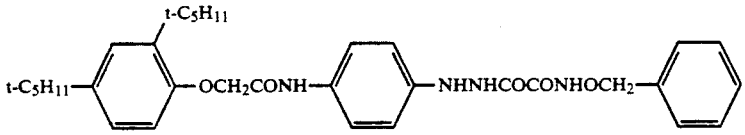
(12)
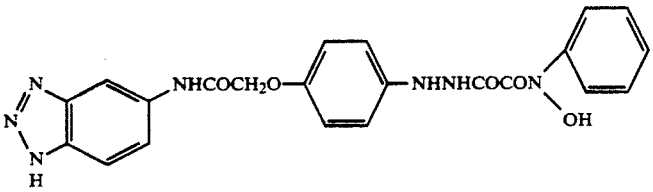

-continued
(13)
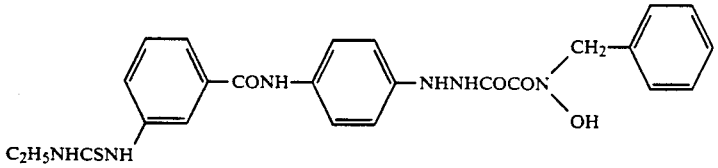
(14)
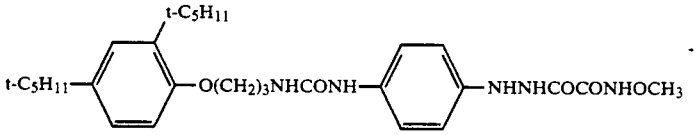
(15)
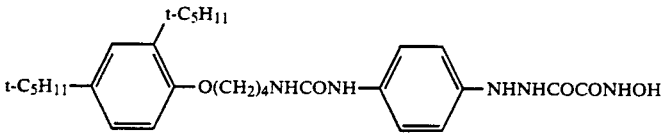
(16)
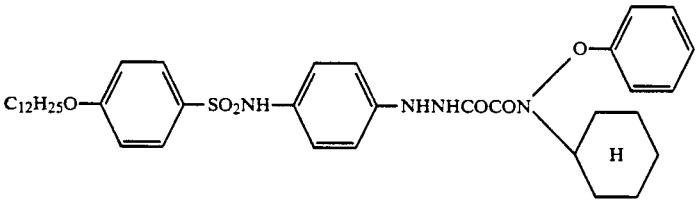
(17)
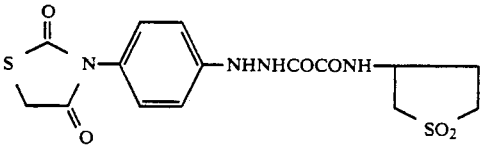
(18)
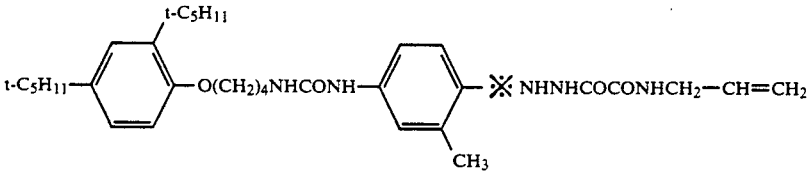
(19)
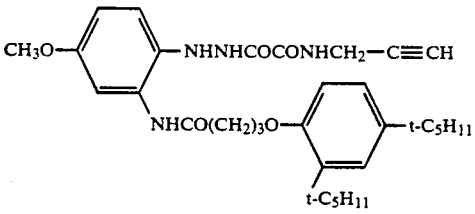
(20)
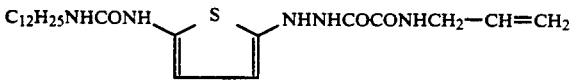
(21)
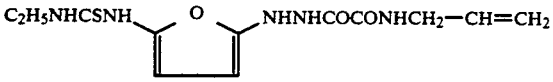
(22)
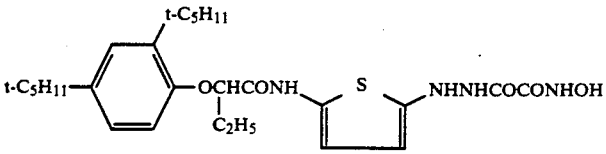

-continued
(23)
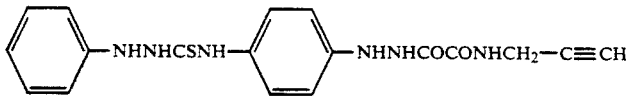
(24)
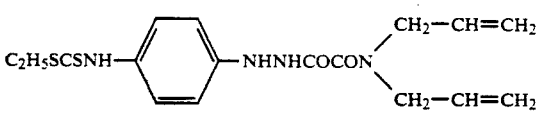
(25)
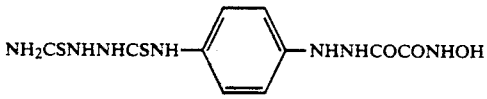
(26)
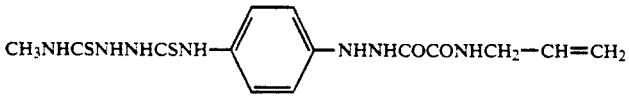
(27)
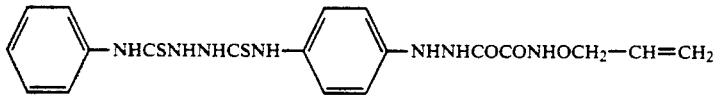
(28)
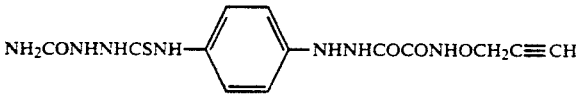
(29)
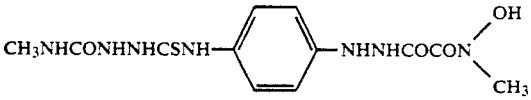
(30)
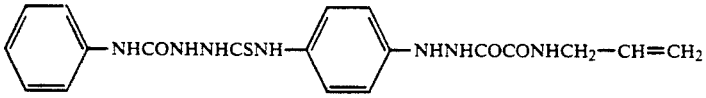
(31)
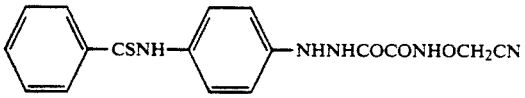
(32)
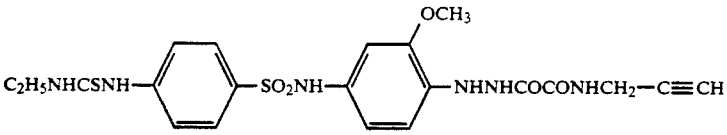
(33)
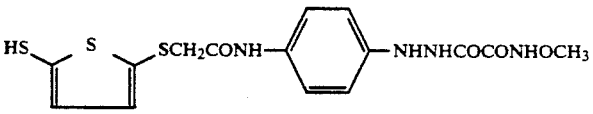
(34)
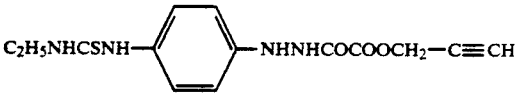
(35)
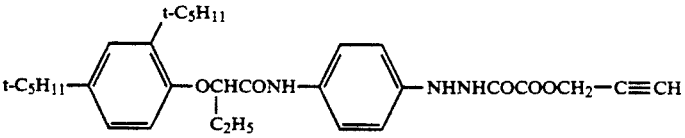

-continued
(36)
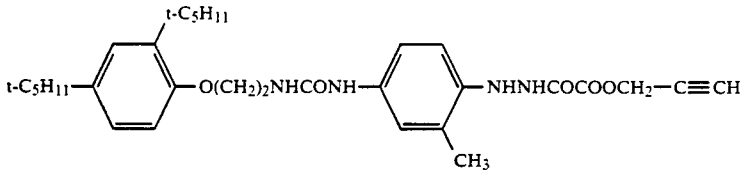
(37)
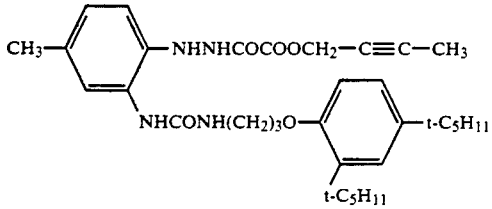
(38)
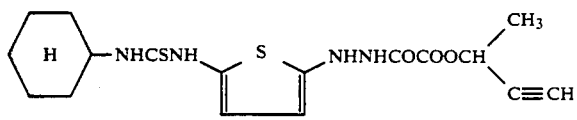
(39)
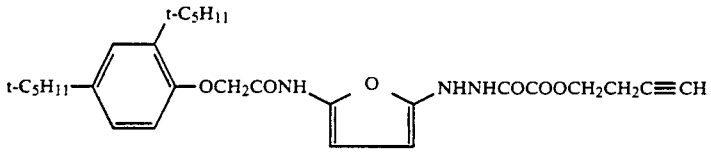
(40)
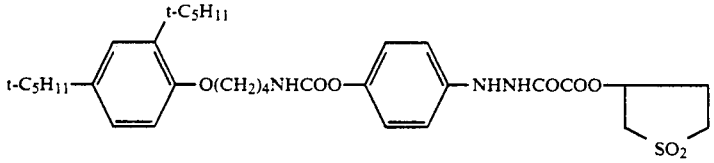
(41)
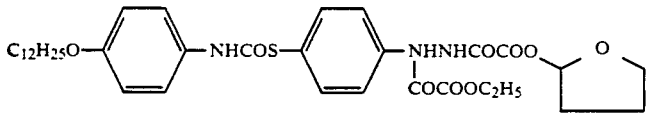
(42)
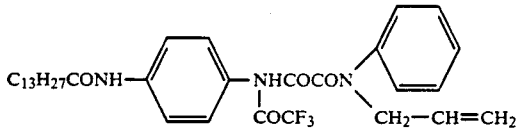
(43)
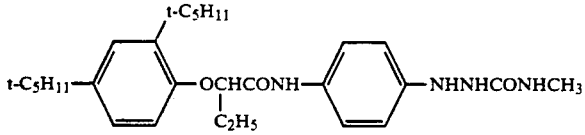
(44)
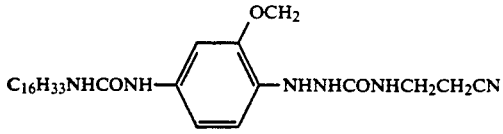
(45)
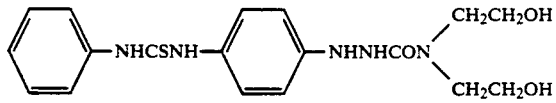

-continued
(46)
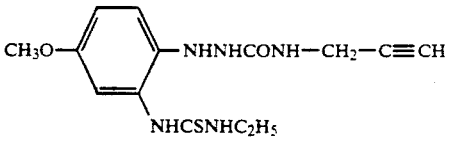
(47)
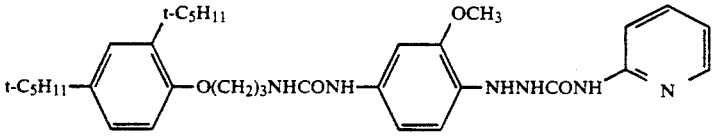
(48)
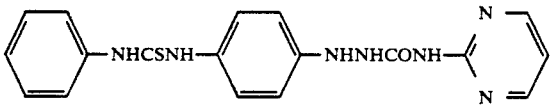
(49)
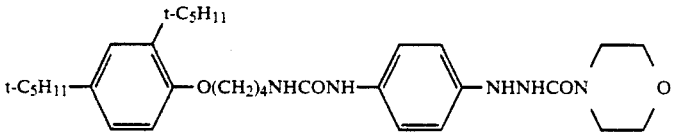
(50)
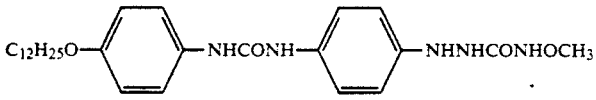
(51)
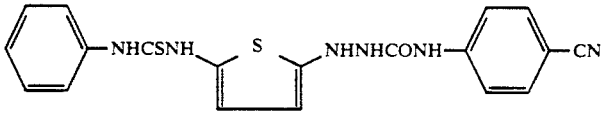
(52)
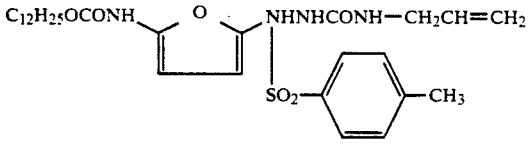
(53)
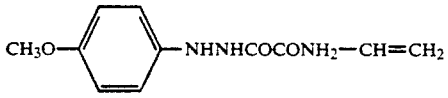
(54)
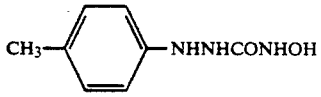
(55)
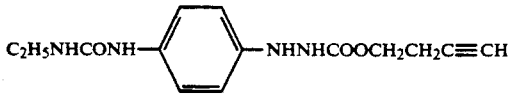
(56)
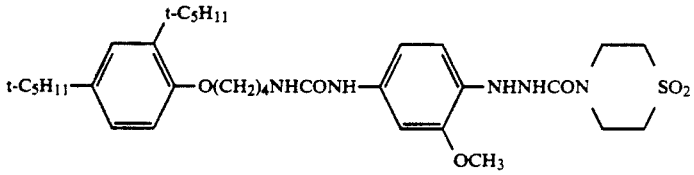

-continued
(57)
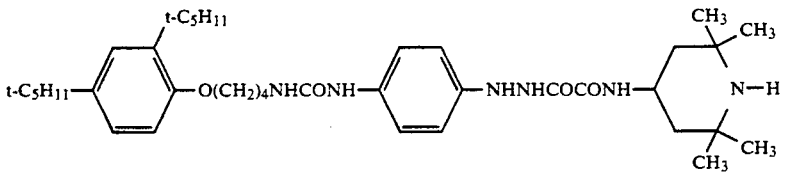
(58)
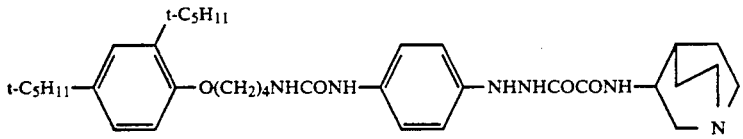
(59)
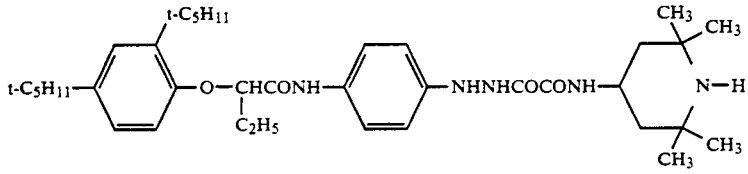
(60)
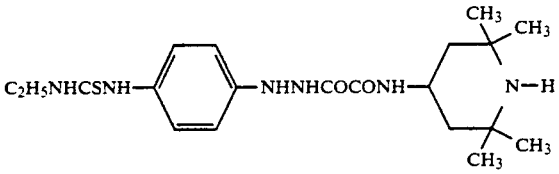
(61)
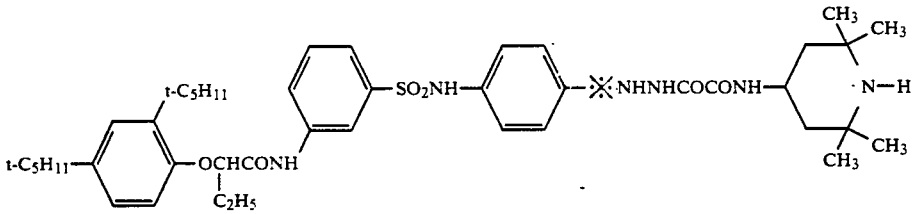
(62)
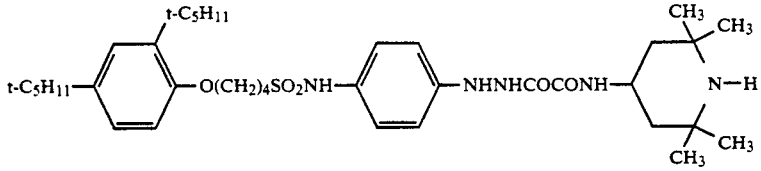
(63)
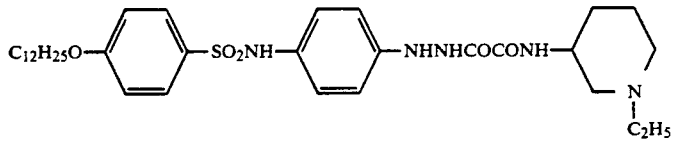
(64)
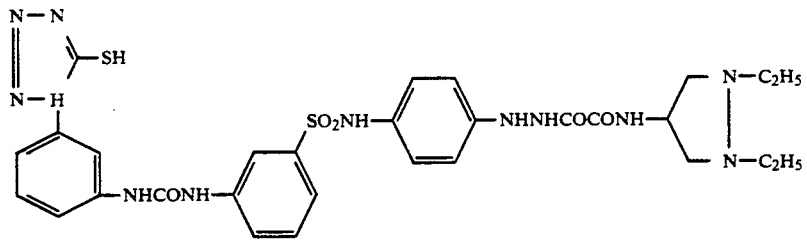

-continued
(65)
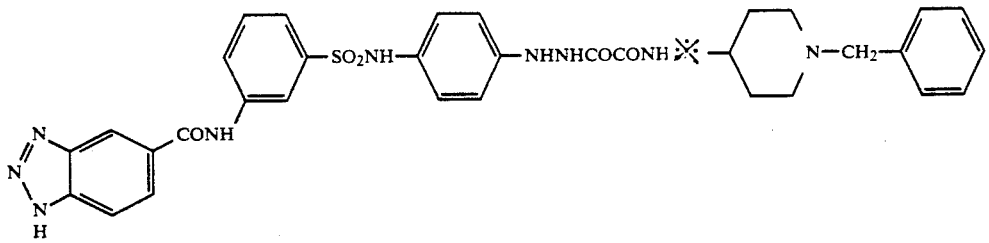
(66)
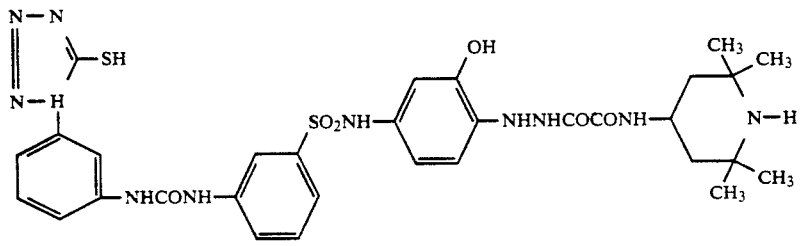
(67)
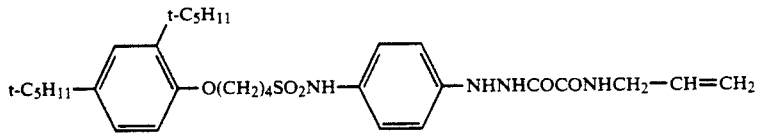
(68)
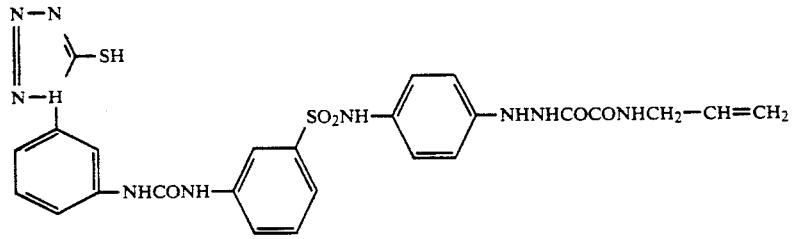
(69)
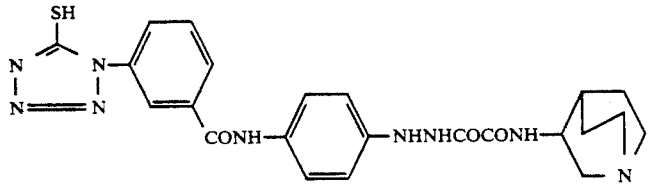
(70)
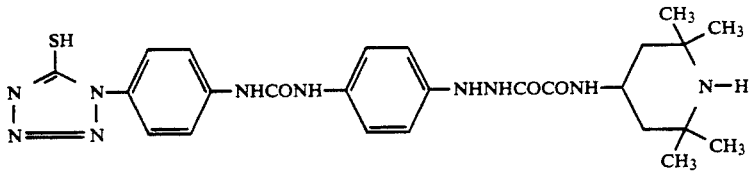
(71)
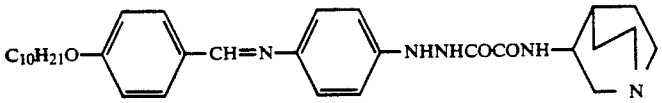
(72)
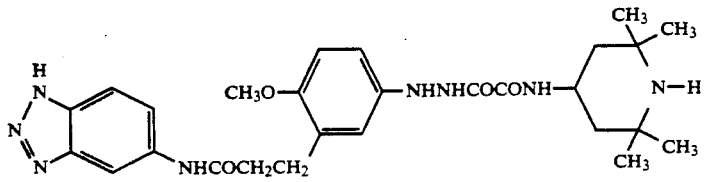

-continued
(73)
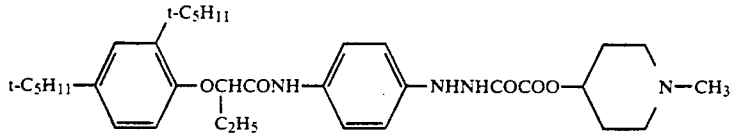
(74)
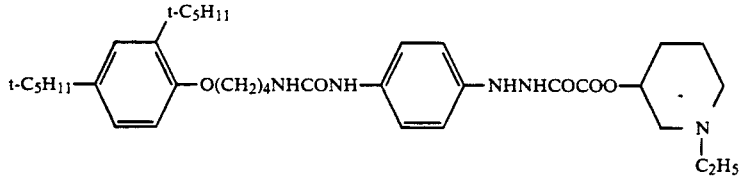
(75)
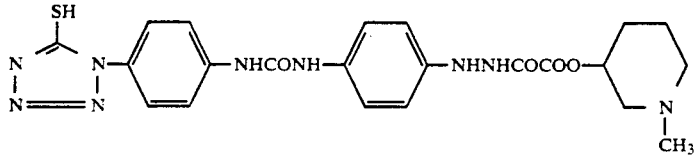
(76)
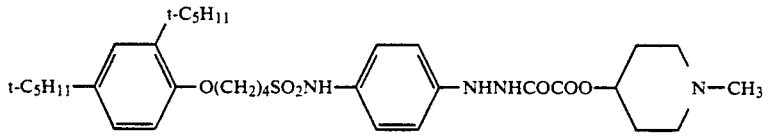
(77)
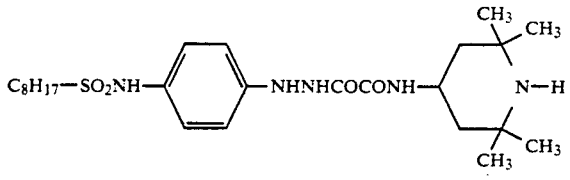
(78)
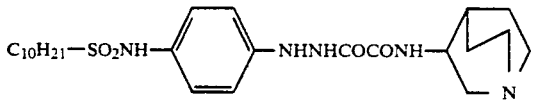
(79)
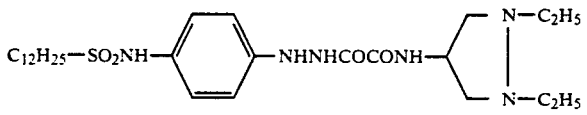
(80)
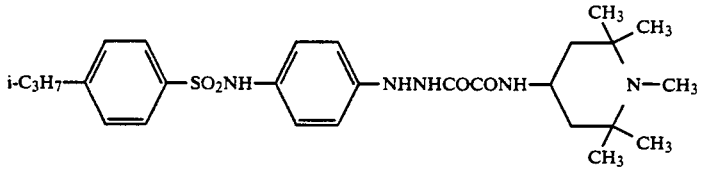
(81)
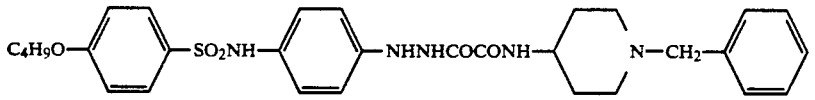
(82)
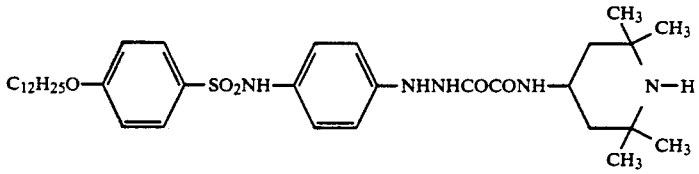

-continued
(83)
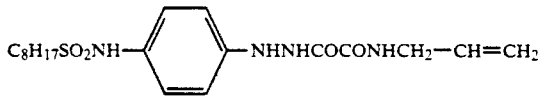
(84)
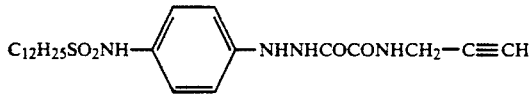
(85)
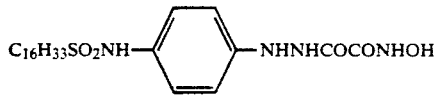
(86)
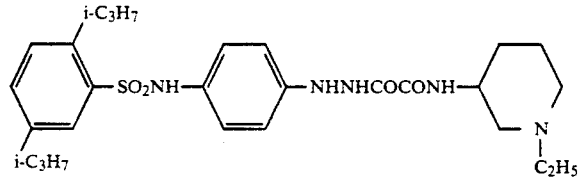
(87)
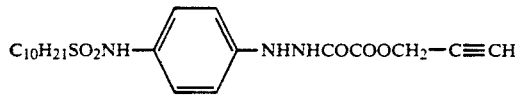
(88)
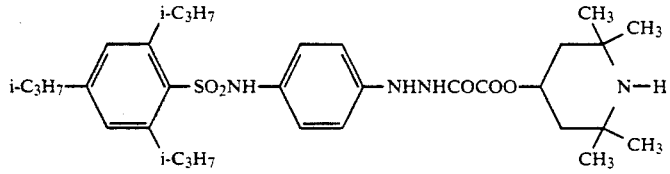
(89)
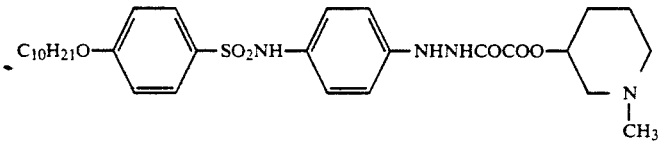
(90)
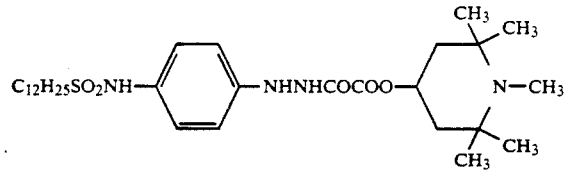
(91)
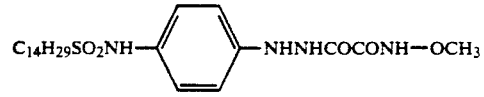
(92)
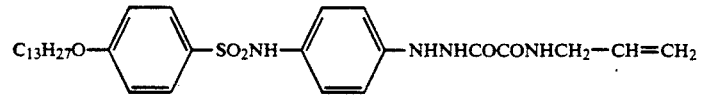
(93)
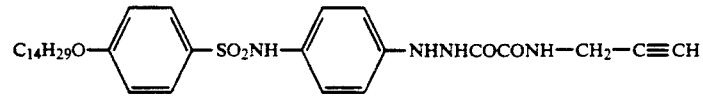

-continued
(94)
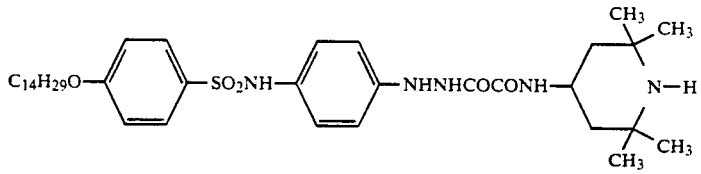
(95)
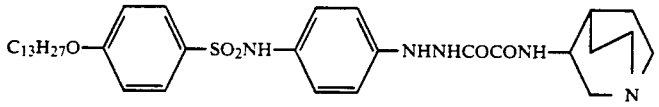
(96)
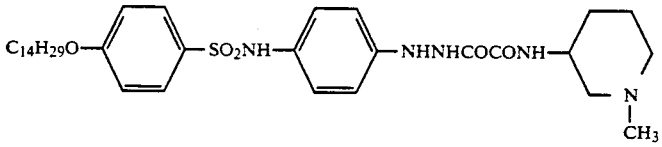
(97)
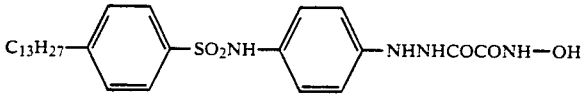
(98)
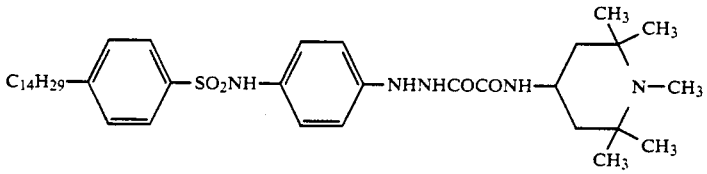
(99)
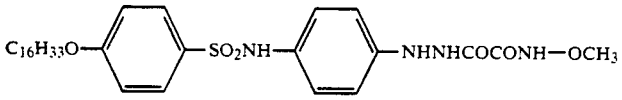
(100)
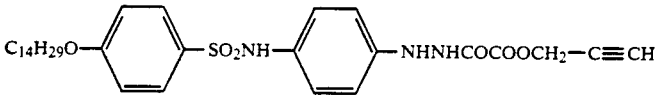
(101)
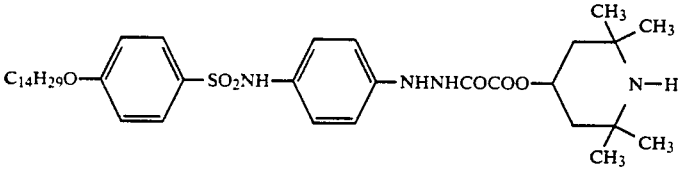
(102)
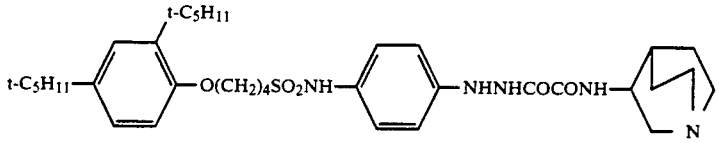
(103)
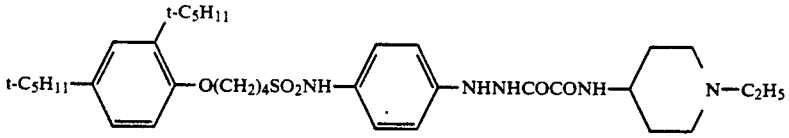
(104)
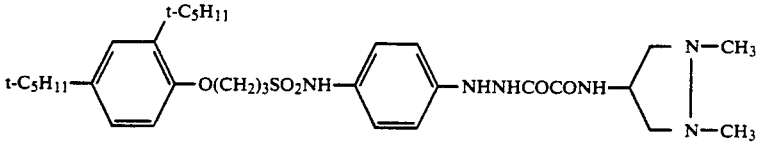

-continued
(105)
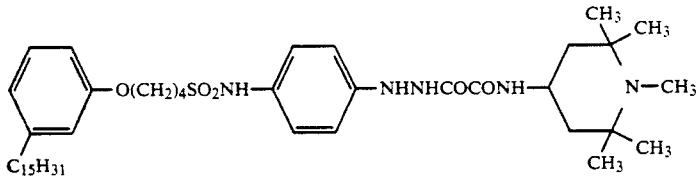
(106)
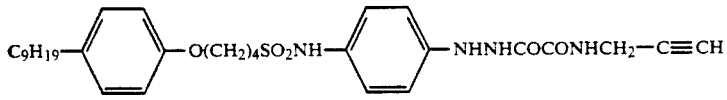
(107)
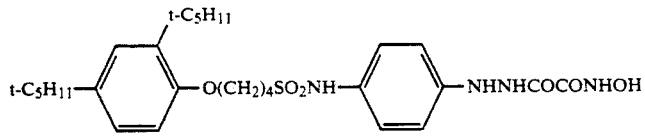
(108)
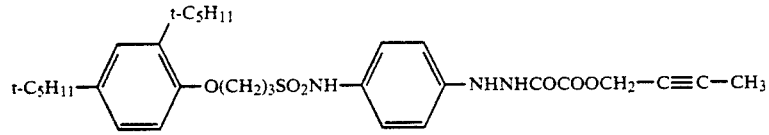
(109)
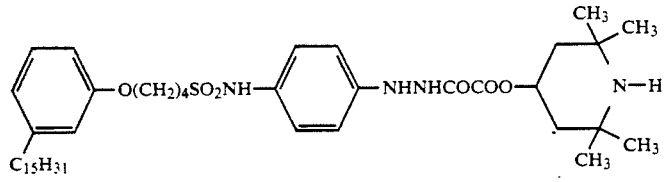
(110)
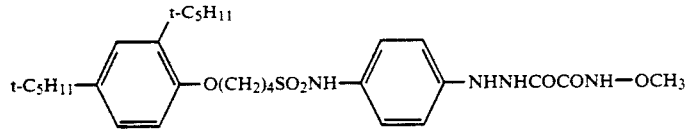
(111)
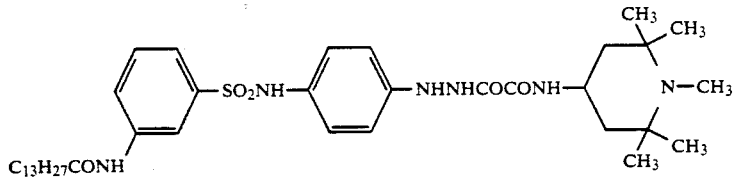
(112)
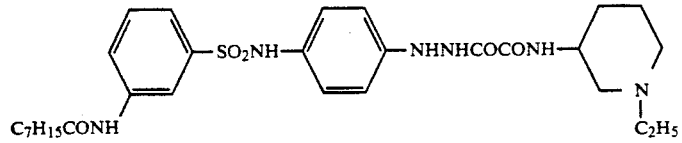
(113)
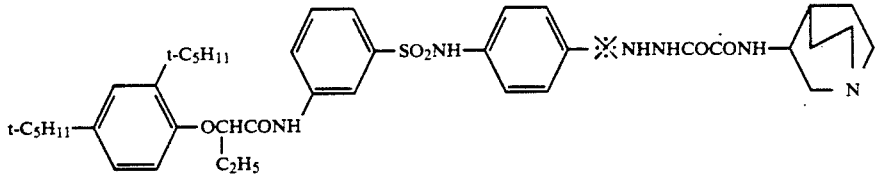
(114)
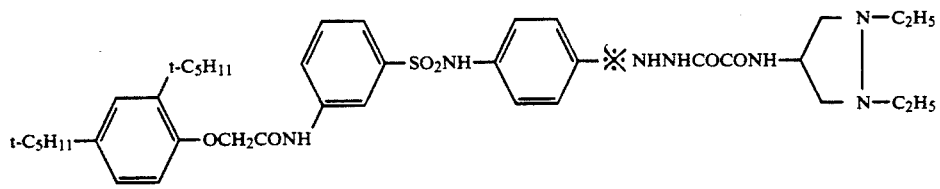

-continued
(115)
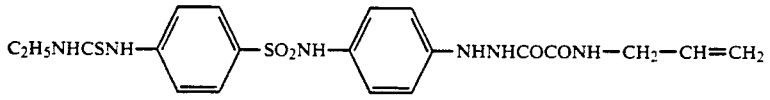
(116)
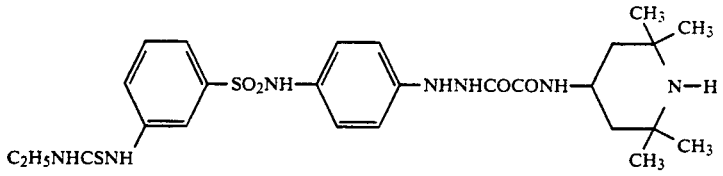
(117)
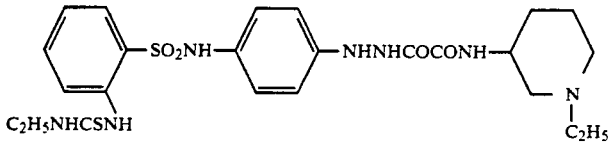
(118)
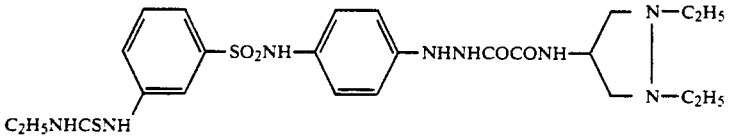
(119)
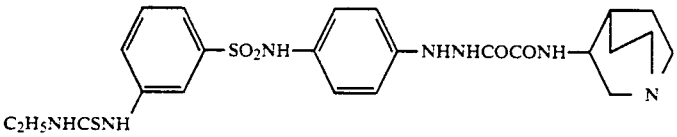
(120)
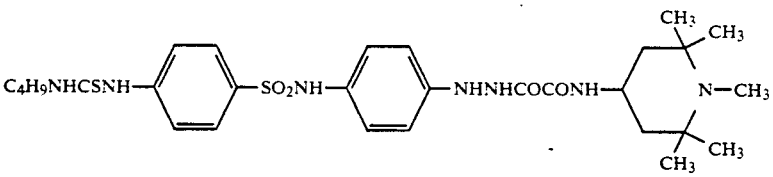
(121)
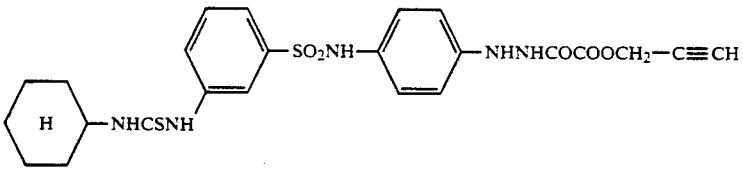
(122)
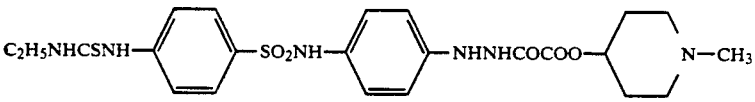
(123)
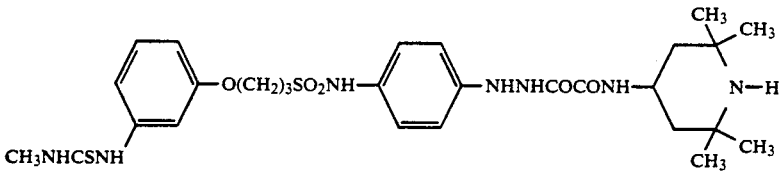
(124)
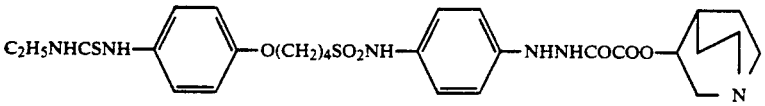

-continued
(125)
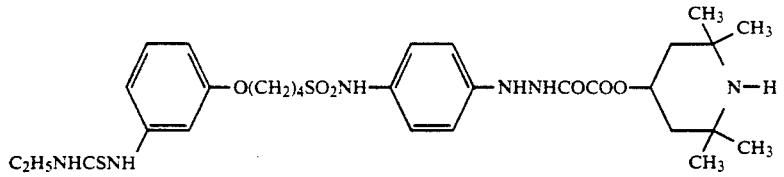
(126)
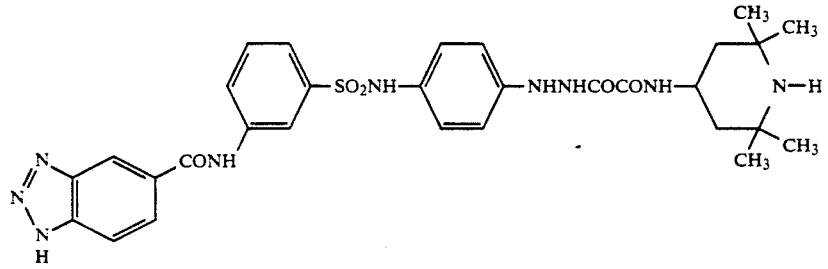
(127)
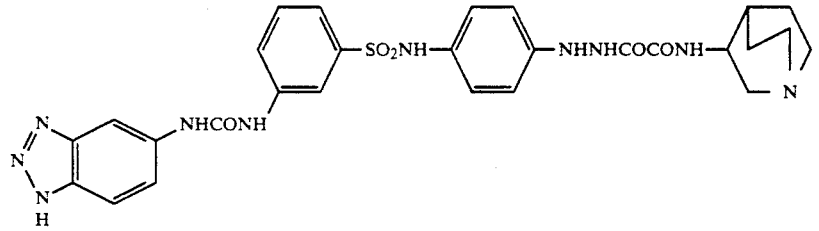
(128)
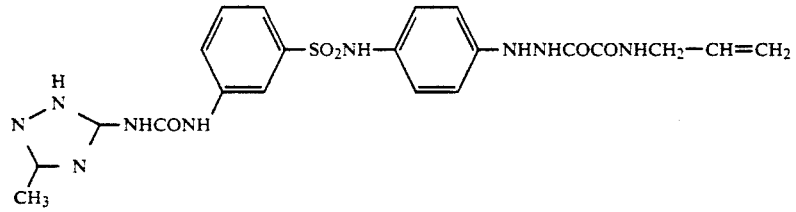
(129)
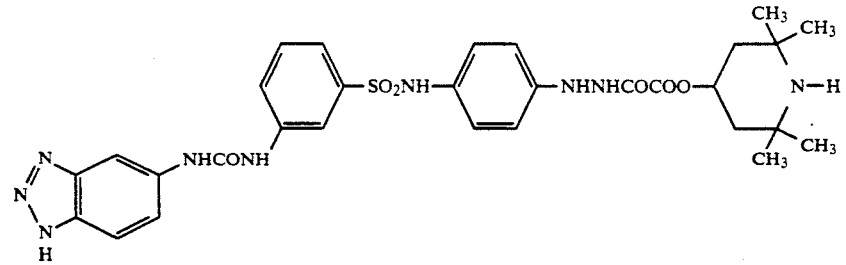
(130)
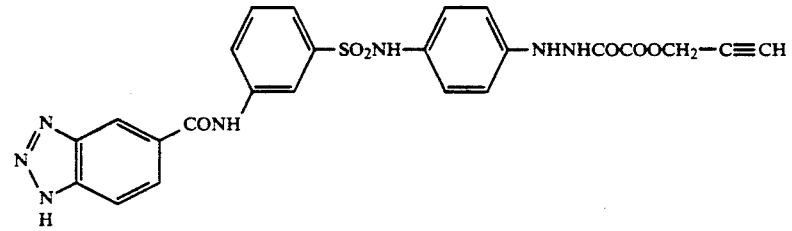

-continued
(131)
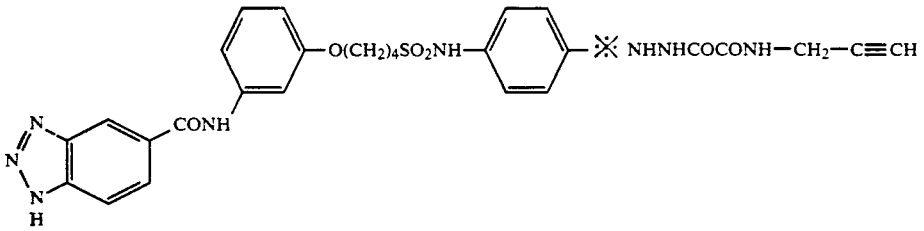
(132)
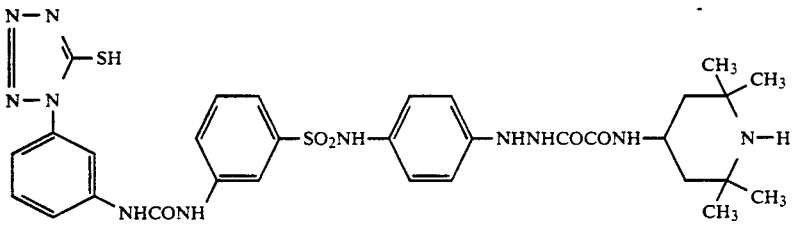
(133)
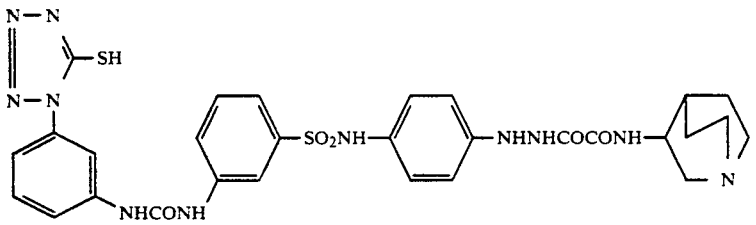
(134)
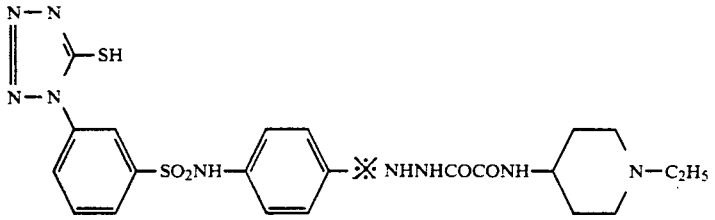
(135)
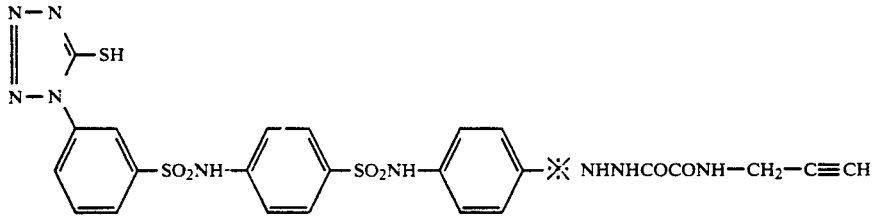
(136)
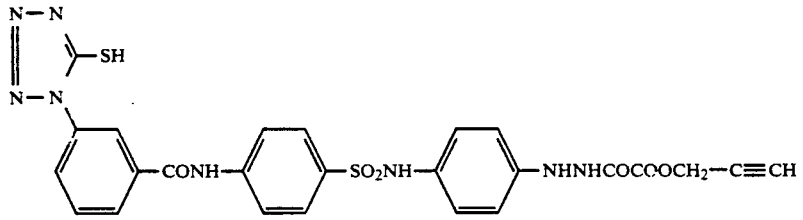
(137)
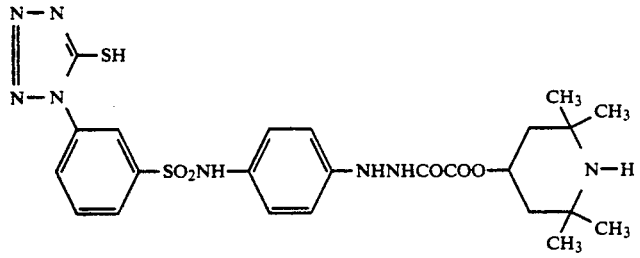

-continued
(138)
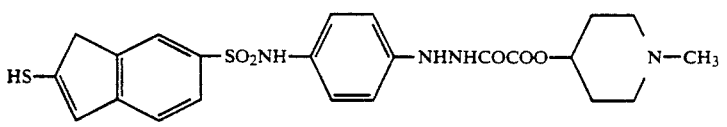
(139)
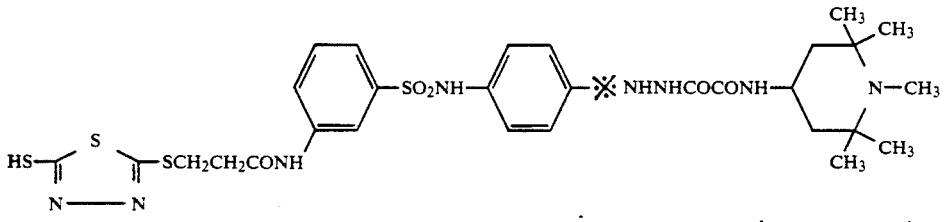
(140)
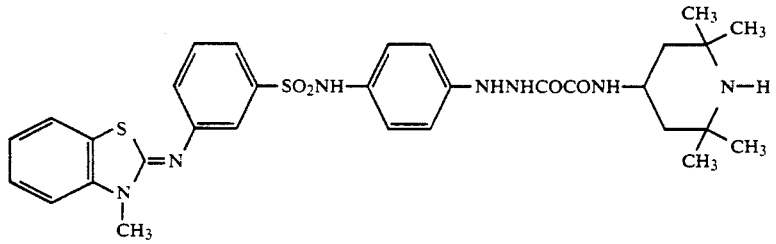
(141)
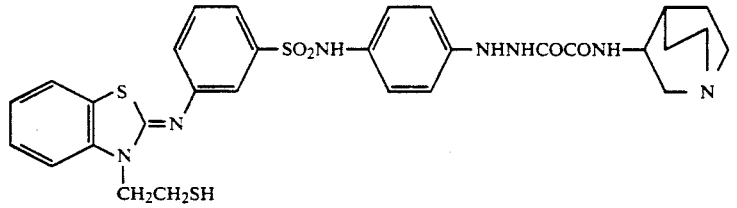
(142)
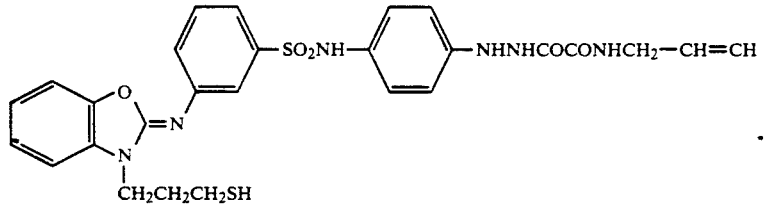
(143)
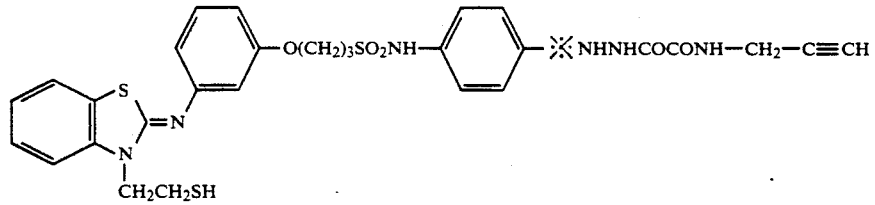
(144)
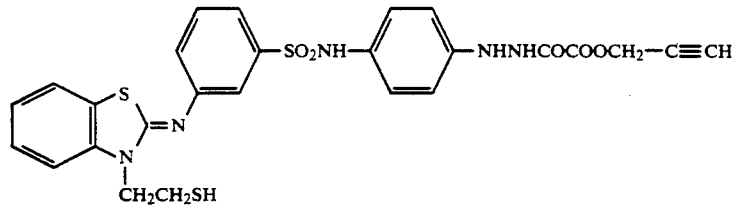
(145)
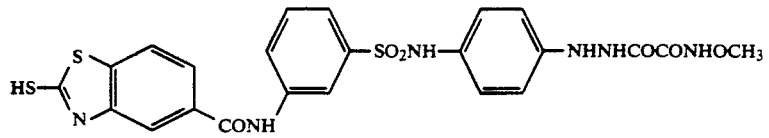

-continued
(146)
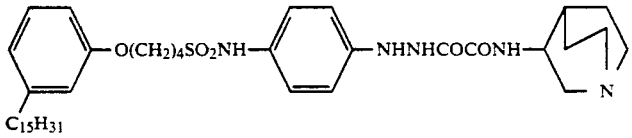
(147)
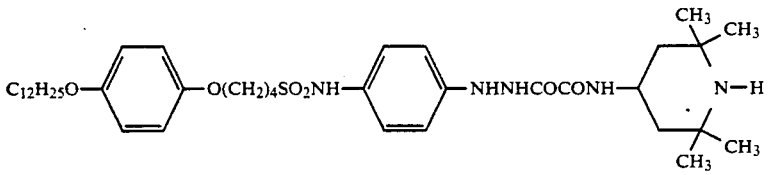
(148)
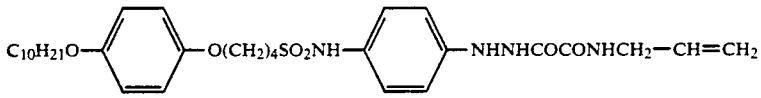
(149)
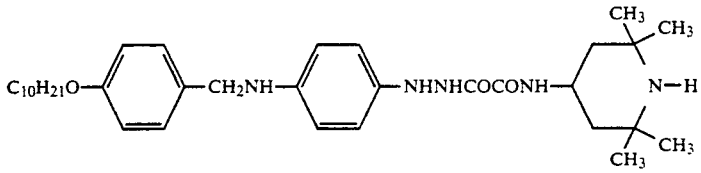
(150)
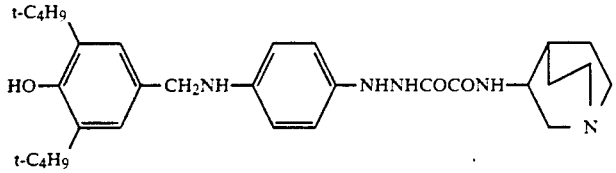
(151)
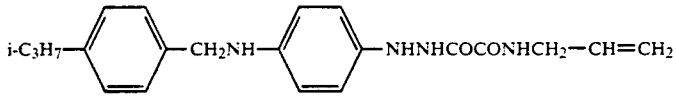
(152)
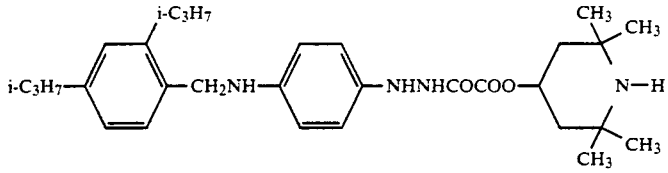
(153)
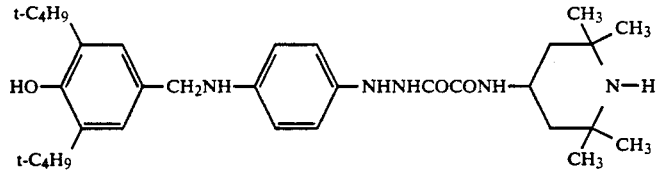
(154)
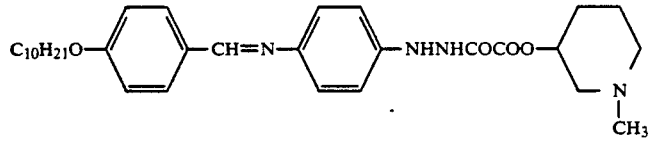
(155)
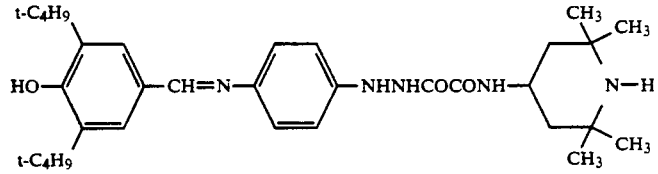

-continued
(156)
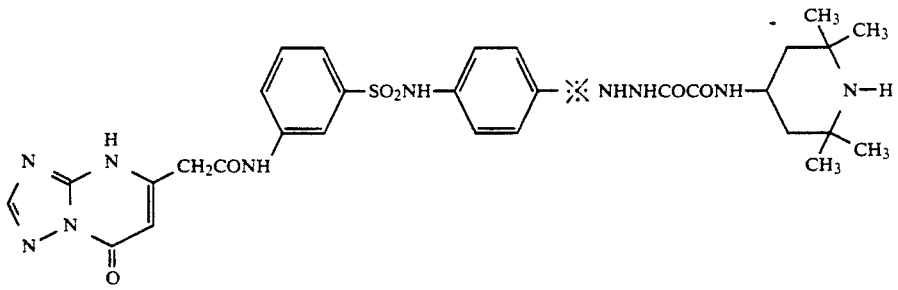
(157)
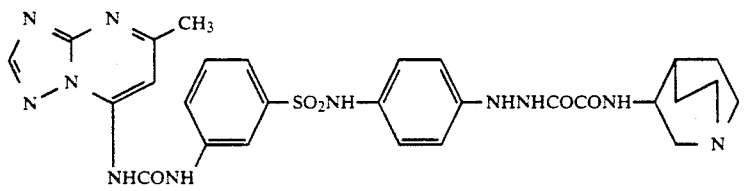
(158)
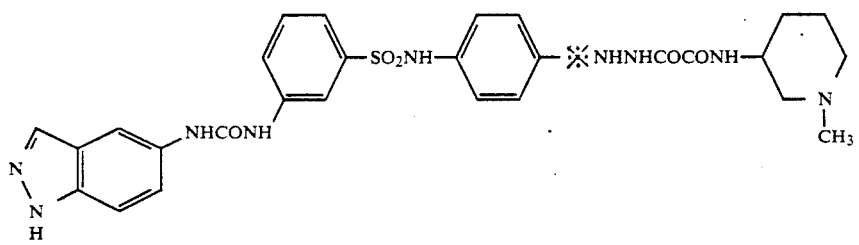
(159)
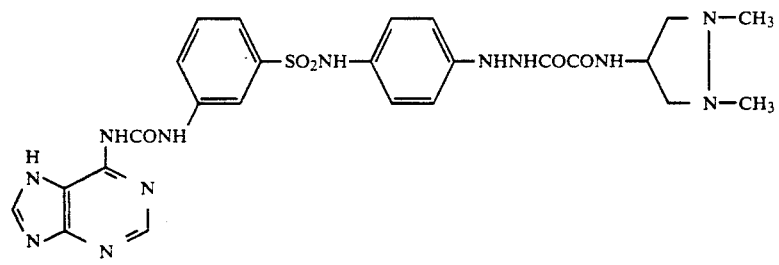
(160)
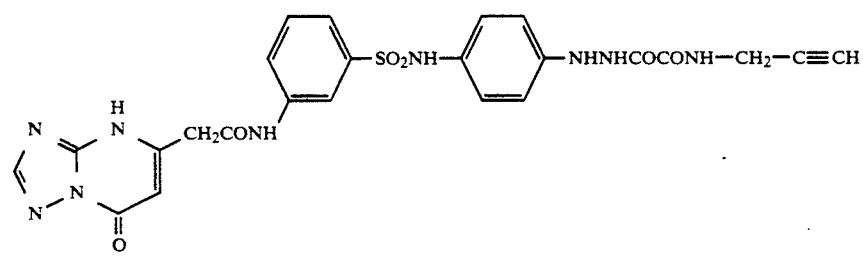
(161)
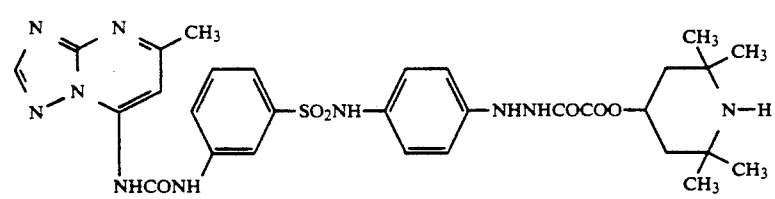

-continued
(162)
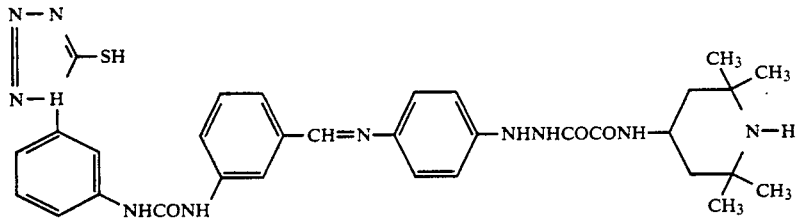
(163)
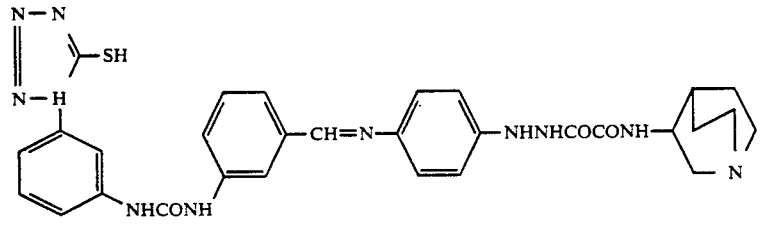
(164)
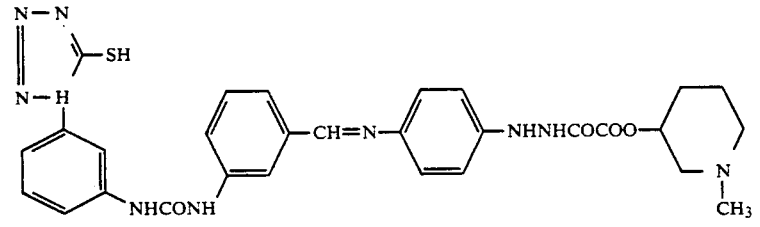
(165)
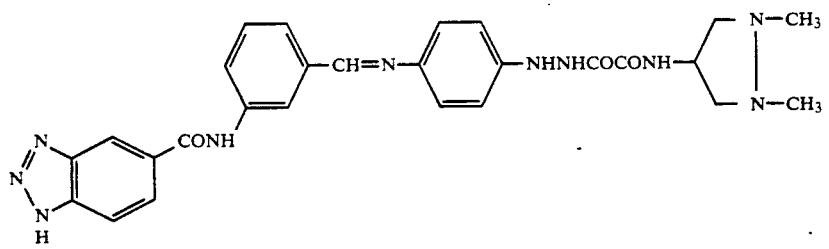
(166)
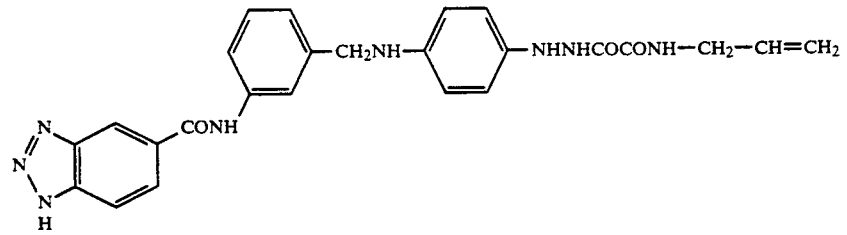
(167)
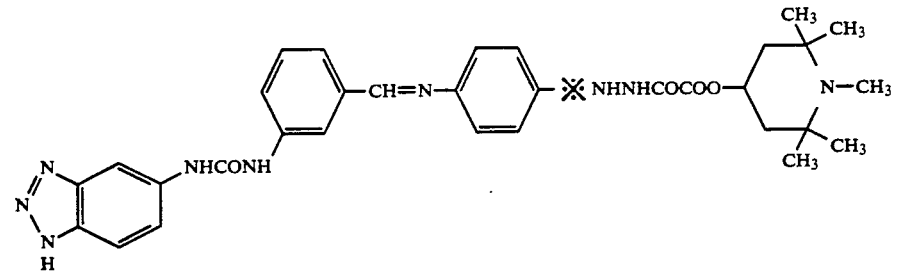

-continued
(168)
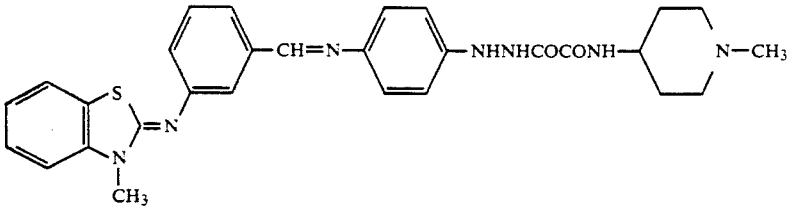
(169)
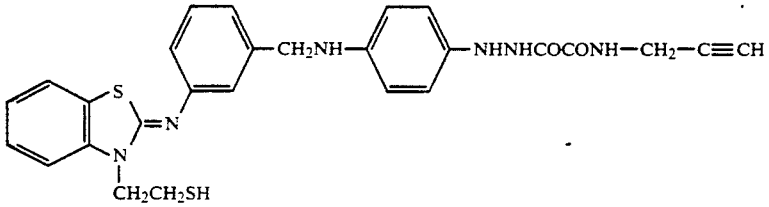
(170)
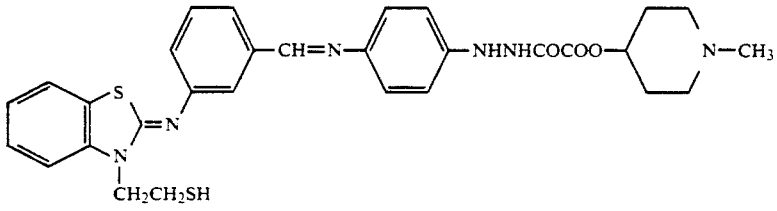
(171)
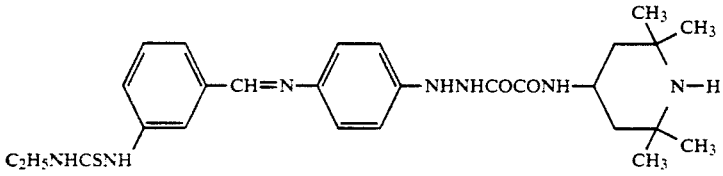
(172)
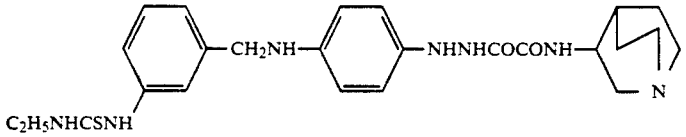
(173)
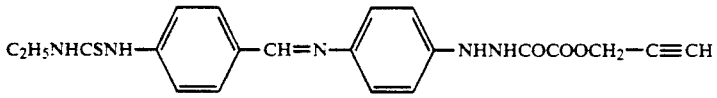
(174)
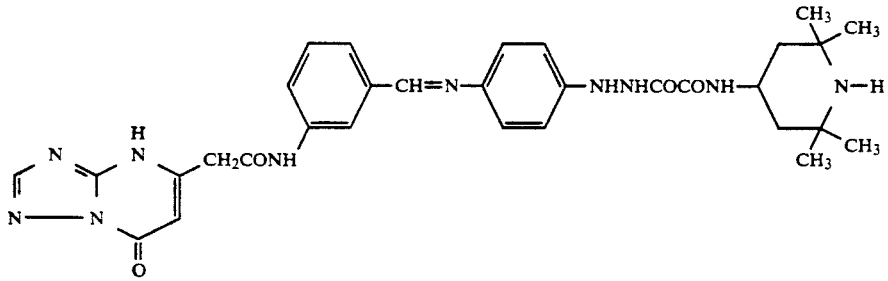
(175)
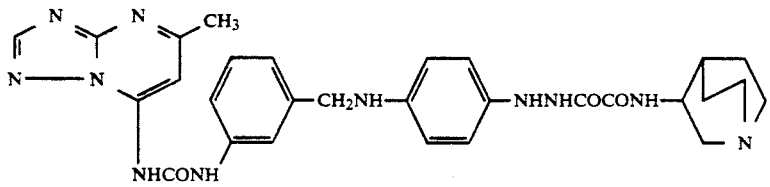

-continued (176)

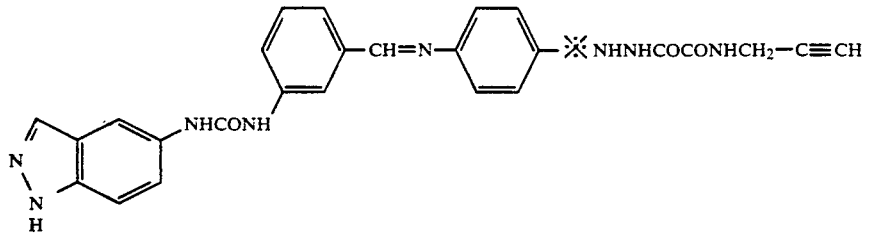

(177)

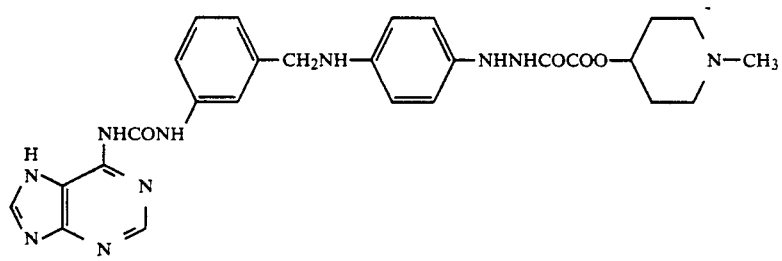

Now, formula C will be detailed below.

$R_4$ represents an alkyl group including, for example, an octyl, t-octyl, decyl, dodecyl or tetradecyl group, an aryl group including, for example, a phenyl, p-propyl, phenyl or napthyl group, or a heterocyclic group including, for example, a pyridyl, tetrazoline, oxazoline, benzoxazoline, benzothiazolyl or benzoimidazolyl group. The preferable alkyl groups represented by $R_4$ include, for example, those having each 6 to 20 carbon atoms.

The preferable aryl groups represented by $R_4$ include, for example, those represented by the following formula;

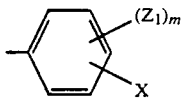

X represents a substituted or unsubstituted alkyl group including, for example, a methyl, ethyl, methoxy or i-propyl group, an acylamino group including, for example, an octanamido or tetradecanamido group, a ureido group including, for example, ahexylureido or δ-(2,4-di-t-acylphenoxy)butyl ureido group, a hydrazinocarbonylamino group including, for example, a 2,2-dibutylhydrazinocarbonylamino or 2-phenyl-2-methylhydrazinocarbonylamino group, a sulfonamido group including, for example, a hexadecanesulfonamido, 4-butoxybenzenesulfonamido or morpholinosulfonamido group, an aminosulfonamido group including, for example, an N,N-dibutylsulfamoylamino or N,N-dimethylsulfamoylamino group, an oxycarbonyl amino group including, for example, an octyloxycarbonylamino or benzyloxycarbonylamino group, an —S— carbonylamino group including, for example, a $C_8H_{17}SCONH$— or $C_6H_5SCONH$— group, a

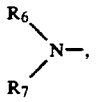

or an $R_8$—)— group.

$R_6$ and $R_7$ each a hydrogen atom, an alkyl group including, for example, a methyl, ethyl, propyl, butyl or cyclohexyl group, an aryl group including, for example, a phenyl, thienyl, piperidino or morpholino group. However, $R_6$ and $R_7$ may form a ring such as a piperidino, piperazino or morpholino ring with a nitrogen atom, and they may also form a

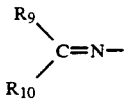

group.

$R_9$ and $R_{10}$ represent each a hydrogen atom or a substitutable group including, for example, an alkyl, aryl or heterocyclic group and may also form a ring including, for example, a cyclohexane, thiazole, oxazole or benzothiazole ring.

$R_8$ represents a hydrogen atom, an aryl group including, for example, a phenyl or naphthyl group, or a heterocyclic group including, for example, a piperidino, morpholino, tetrahydro-pyranyl, pyridyl or thienyl group $Z_1$ represents a substitutable group including, for example, an alkyl, aryl, heterocyclic, hydroxy, alkoxy, amino, acylamino, ureido, hydrozinocarbonylamino, sulfonamido, aminosulfonamido, oxycarbonylamino, —S-carbonylamino,

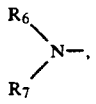

$R_8$—O—, carbamoyl, sulfamoyl or halogen group. And m is an integer of 0 to 4, preferably 0 or 1.

$R_5$ represents a hydrogen atom or a blocking group such as an alkyl group including, for example, a methyl, ethyl, benzyl, methoxymethyl, trifluoromethyl, phenoxymethyl, hydroxymethyl, methylthiomethyl or phenylthiomethyl group, an aryl group including, for example, a phenyl or chlorophenyl group, a heterocyclic group including, for example, pyridyl, thienyl or furyl group,

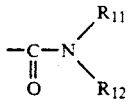

group, or —C—O—$R_{13}$ group. $R_{11}$ and $R_{12}$ are each represent a hydrogen atom, an alkyl group including, for example, a methyl, ethyl or benzyl group, an alkenyl group including, for example, an allyl or butenyl group, an alkynyl group including, for example a propargyl or butynyl group, an aryl group including, for example, a phenyl group or naphthyl group, a heterocyclic group including, for example, 2,2,6,6,-tetramethylpiperidinyl, N-ethyl-N'-ethylpyrazolidinyl or pyridinyl group, or an amino group including, for example, an amino or methylamino group, $R_{11}$ and $R_{12}$ may form a ring together with the nitrogen atom.

$R_{13}$ represents a hydrogen atom, an alkyl group including, for example, a methyl, ethyl or hydroxyethyl group, an alkenyl group, including, for example, an allyl or butenyl group, an alkynyl group including, for example, a propargyl or butynyl group, an aryl group including, for example, 2,2,6,6,-tetramethylpiperidinyl, N-ethyl-N'-ethyl-pyrazolidinyl or pyridinyl group.

The typical examples of the compounds will be given below.

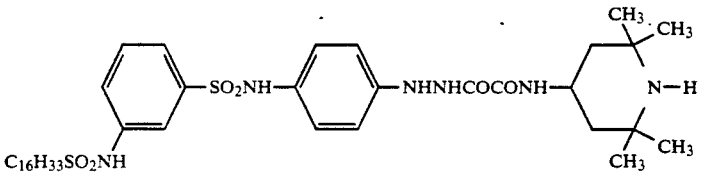

(178)

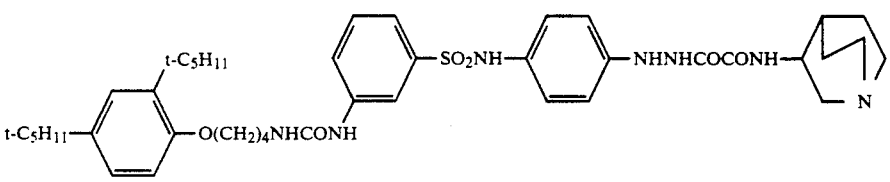

(179)

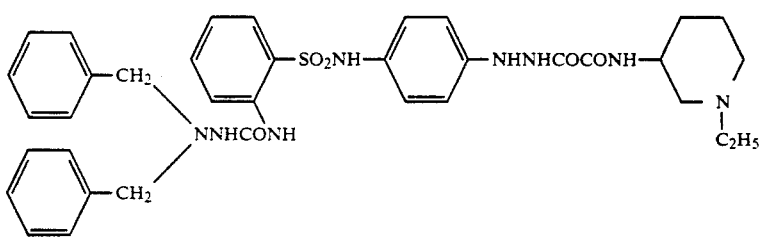

(180)

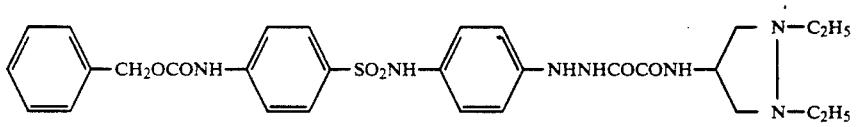

(181)

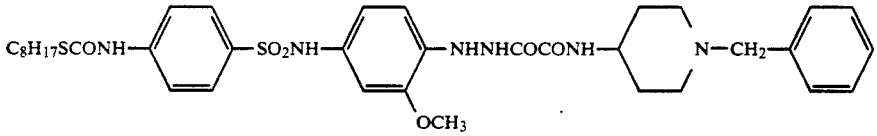

(182)

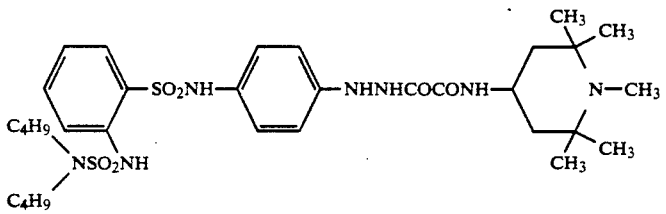

(183)

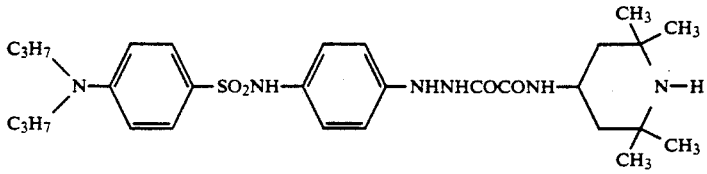

(184)

-continued
(185)
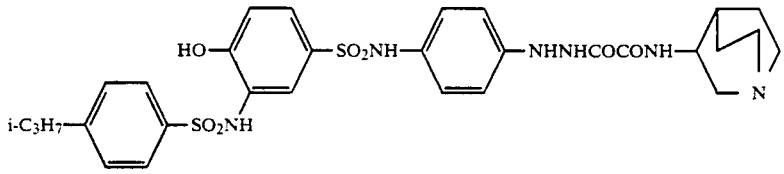
(186)
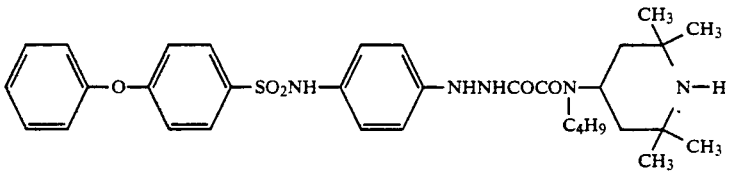
(187)
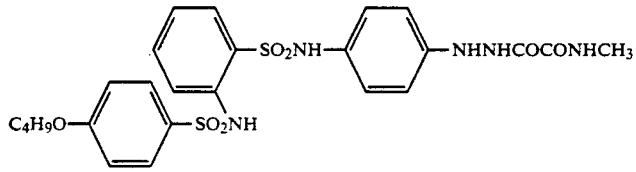
(188)
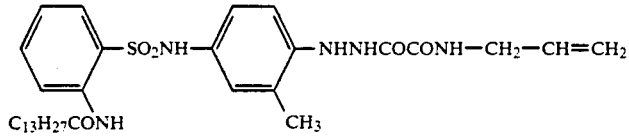
(189)
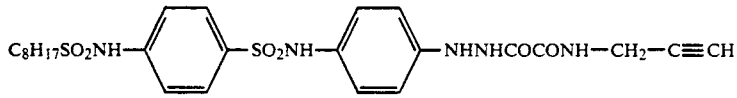
(190)
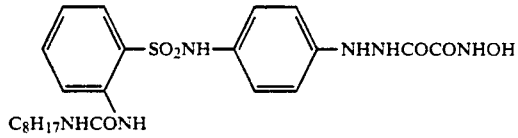
(191)
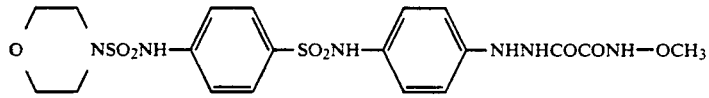
(192)
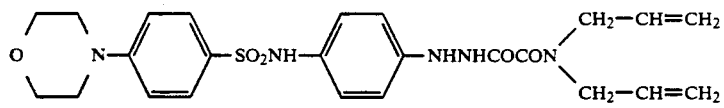
(193)
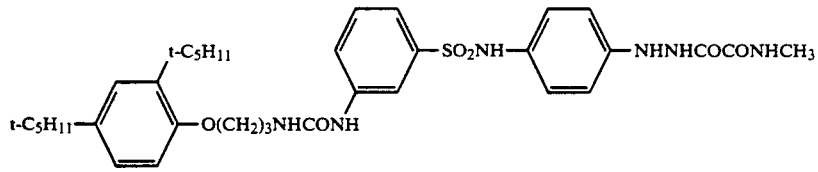
(194)
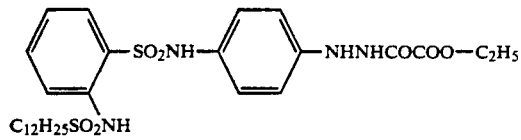

-continued
(195)
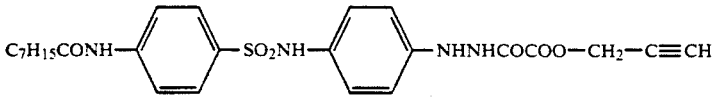
(196)
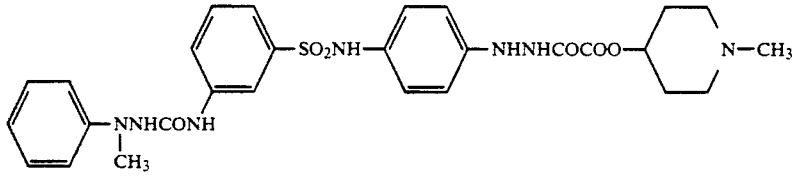
(197)
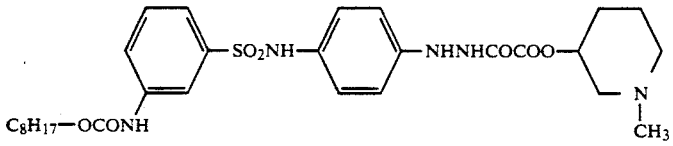
(198)
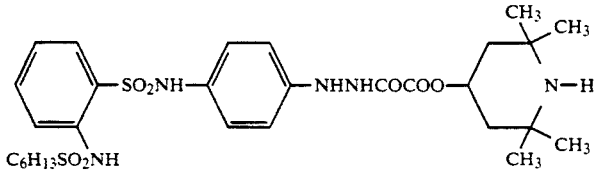
(199)
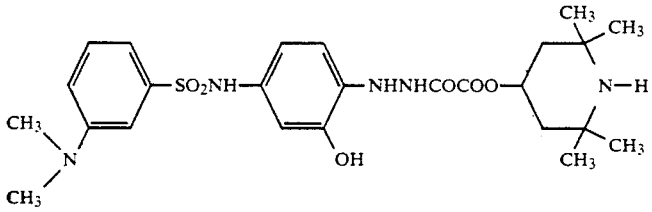
(200)
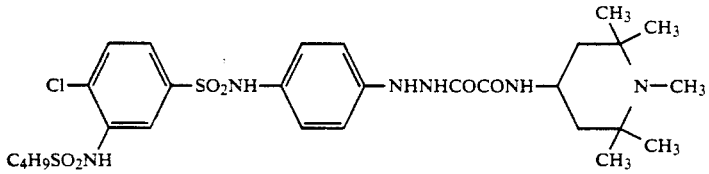
(201)
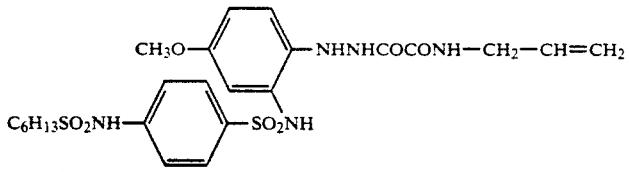
(202)
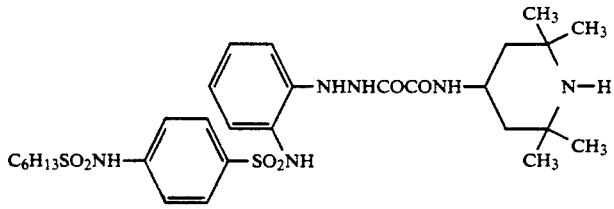
(203)
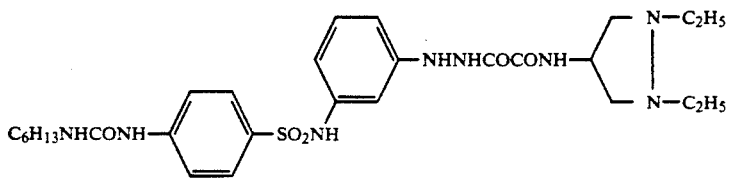

-continued
(204)
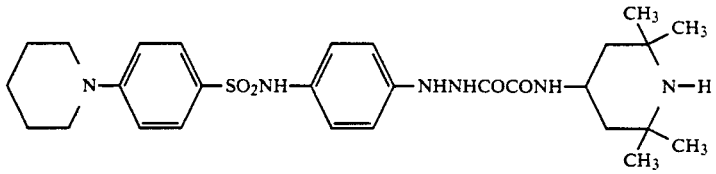
(205)
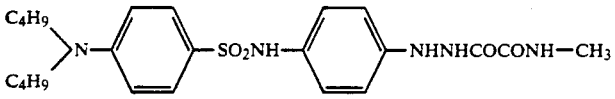
(206)
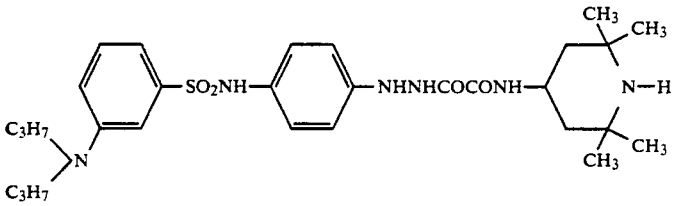
(207)
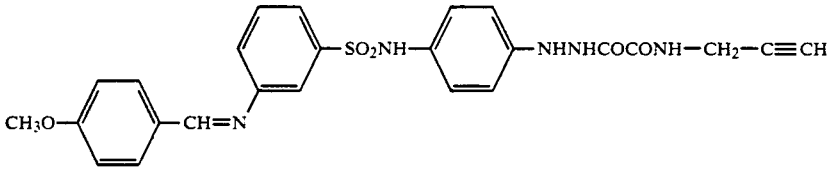
(208)
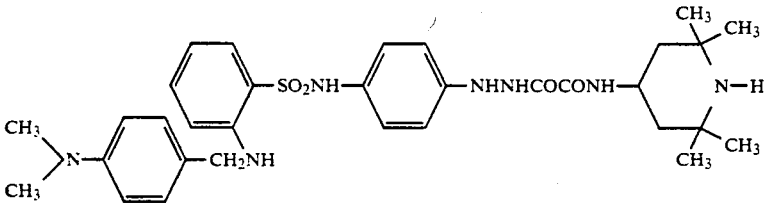
(209)
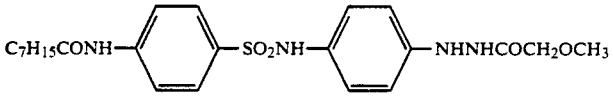
(210)
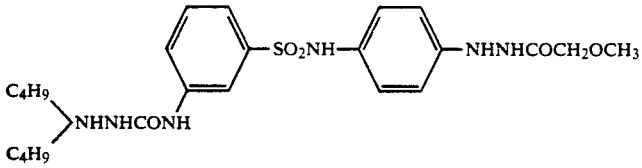
(211)
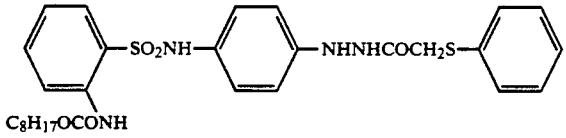
(212)
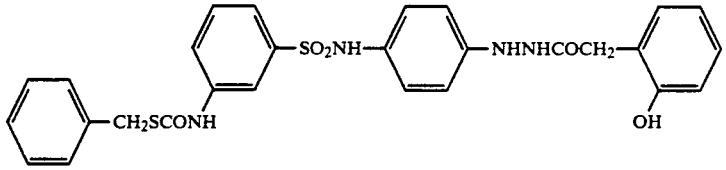

-continued
(213)
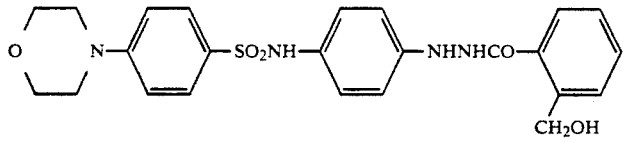
(214)
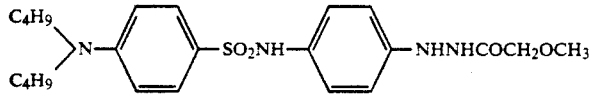
(215)
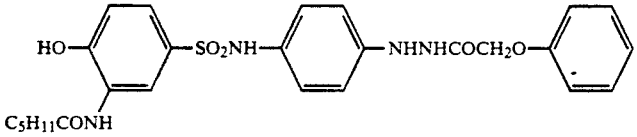
(216)
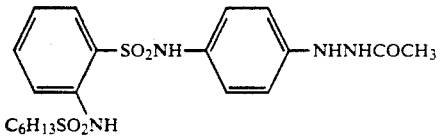
(217)
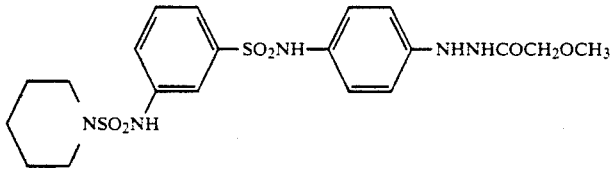
(218)
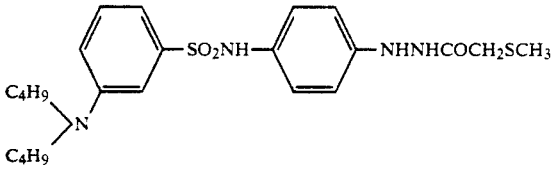
(219)
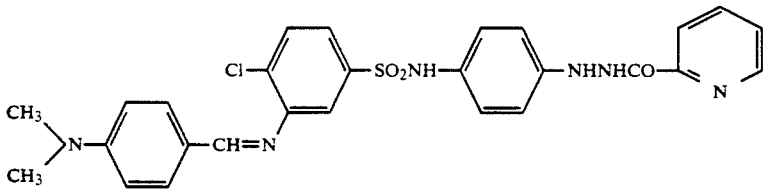
(220)
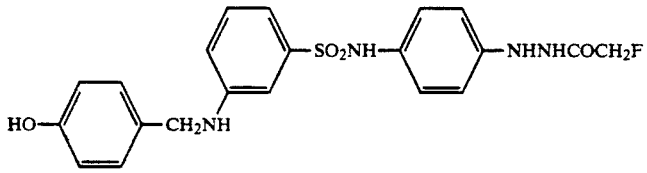
(221)
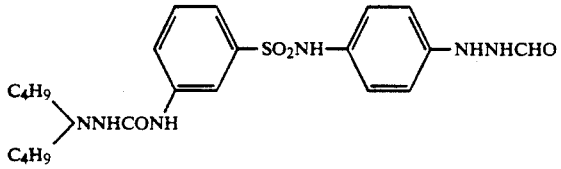

-continued
(222)
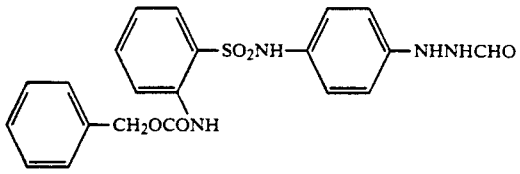
(223)
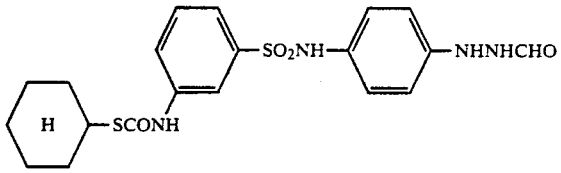
(224)
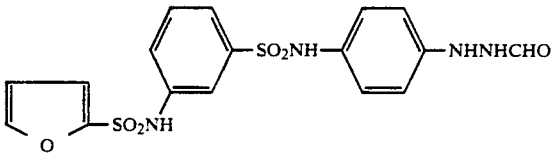
(225)
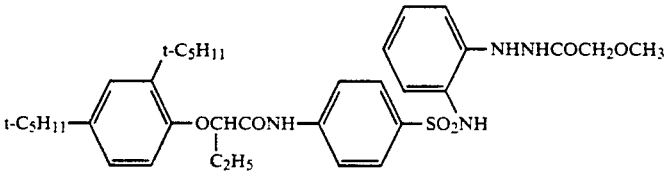
(226)
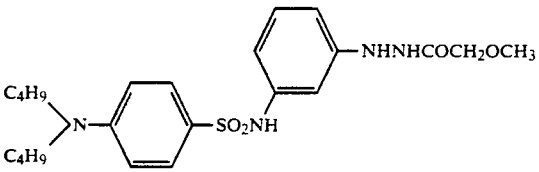
(227)
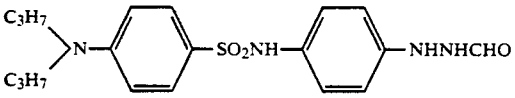
(228)
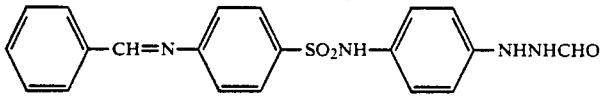
(229)
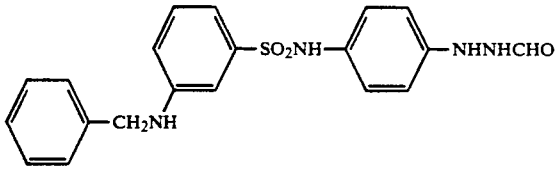
(230)
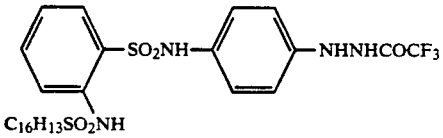
(231)
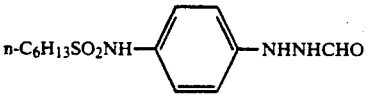

-continued
(232)
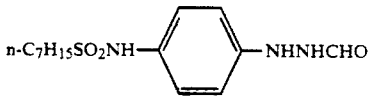
(233)
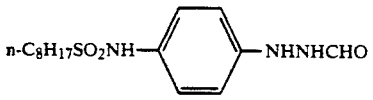
(234)
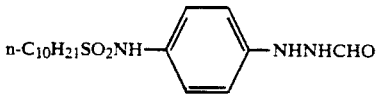
(235)
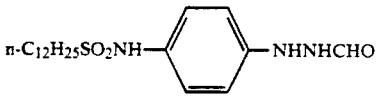
(236)
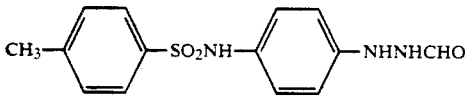
(237)
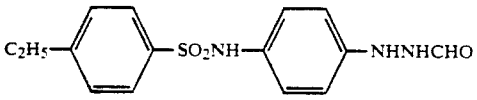
(238)
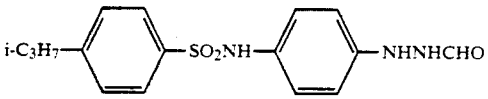
(239)
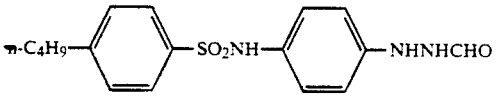
(240)
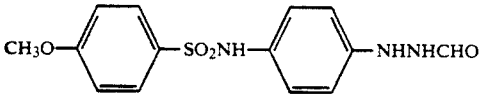
(241)
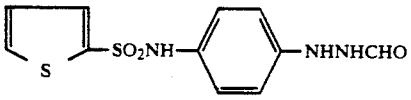
(242)
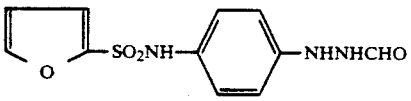
(243)
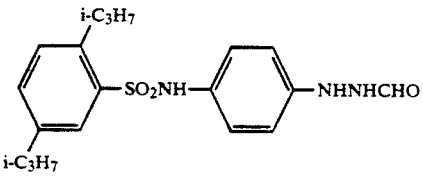

-continued
(244)
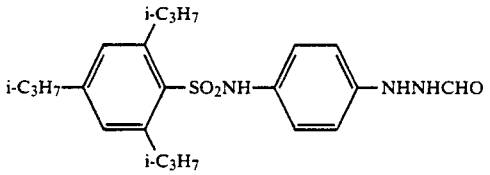
(245)
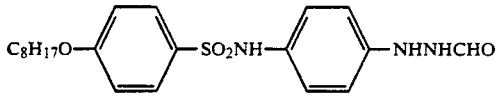
(246)
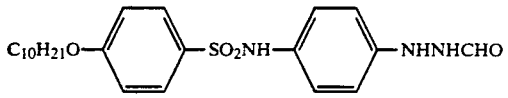
(247)
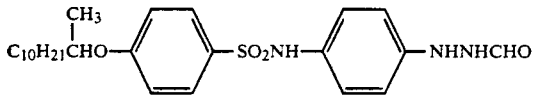
(248)
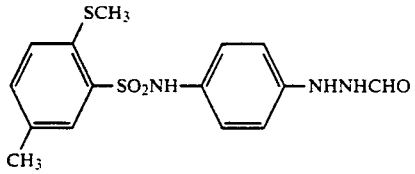
(249)
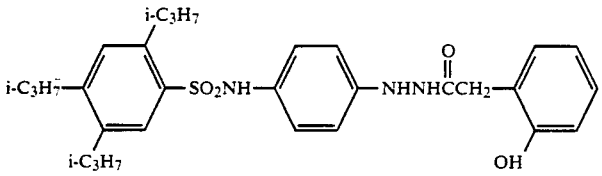
(250)
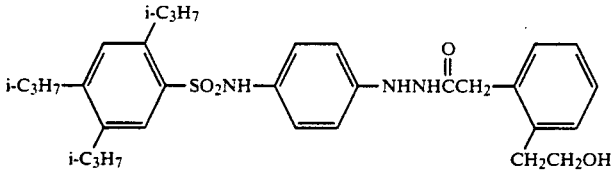
(251)
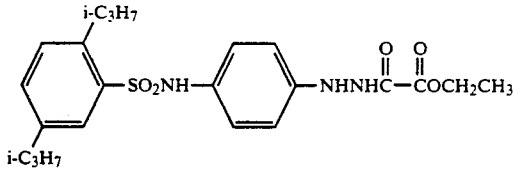
(252)
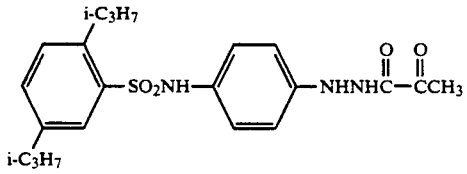
Next, the examples of the processes for synthesizing the compounds relating to the invention will be detailed.
For example, compound (1) can be synthesized in the following process:
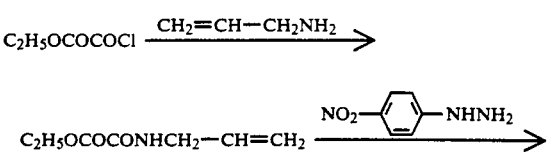

-continued

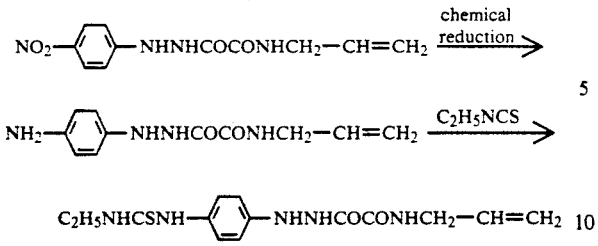

Or, the compound (1) may also by synthesized in the following process.

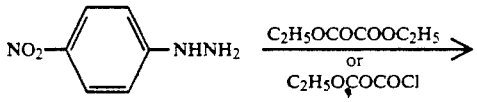

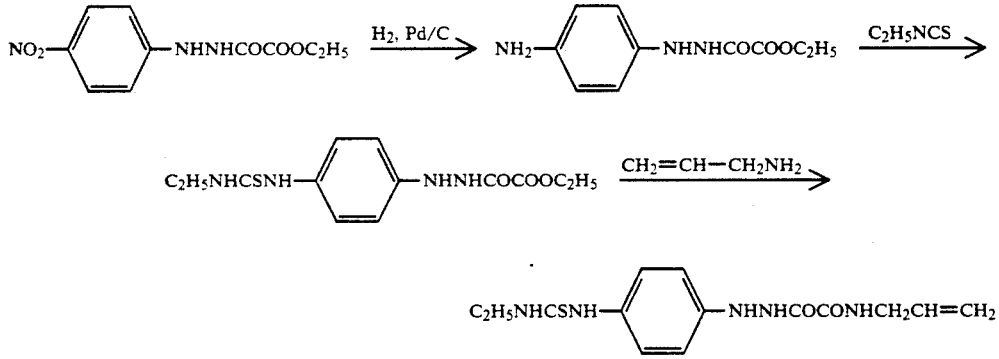

The above-given synthesizing processes may also be referred to the synthesizing processes detailed in U.S. Pat. No. 4,686,167.

Compound (3) can be synthesized in the following synthesizing process.

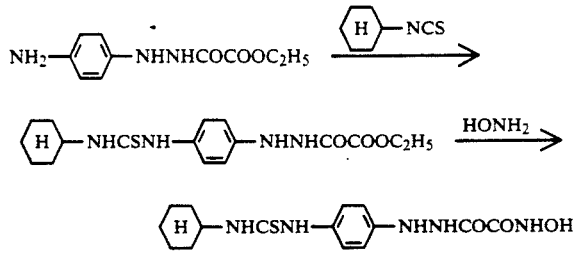

Compound (5) can be synthesized in the following synthesizing process.

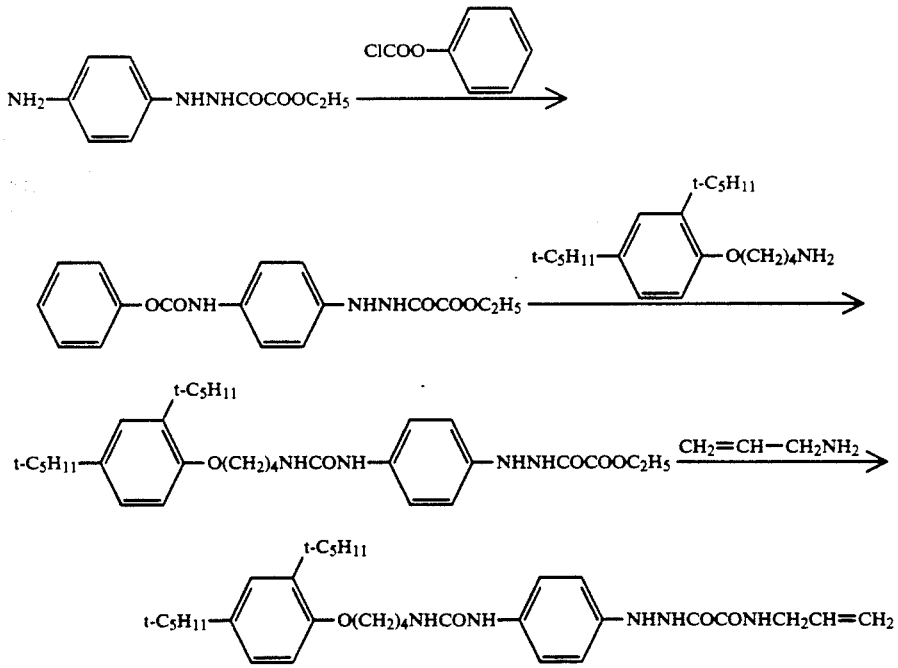

Or, Compound (5) can also by synthesized in the following synthesizing process.

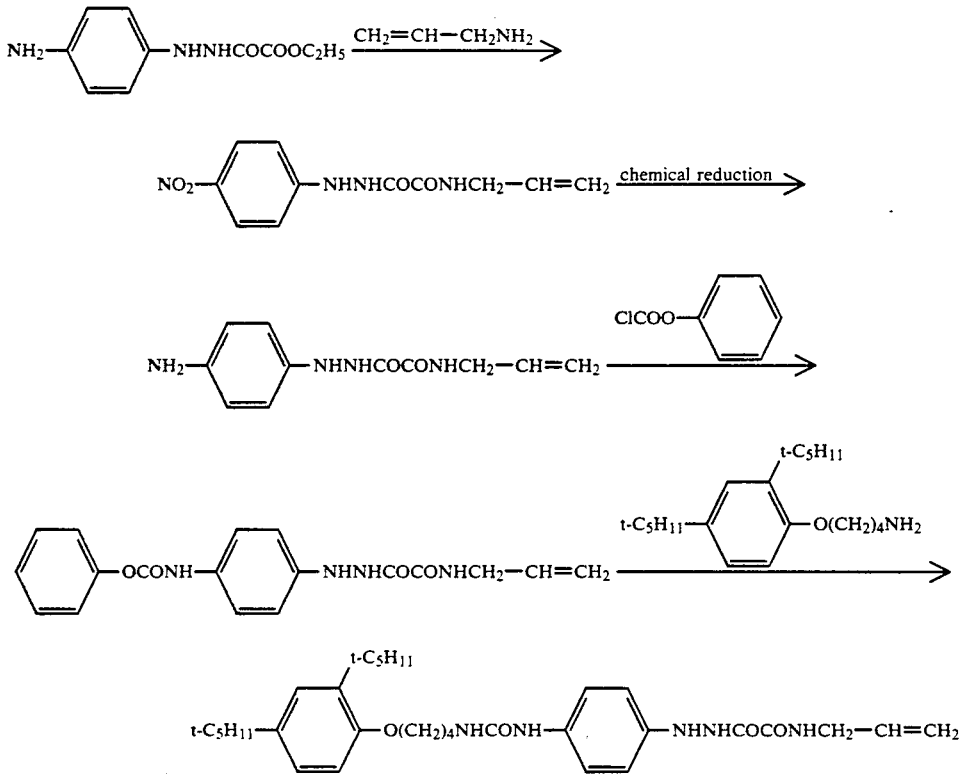
Compound (35) can be synthesized in the following synthesizing process.
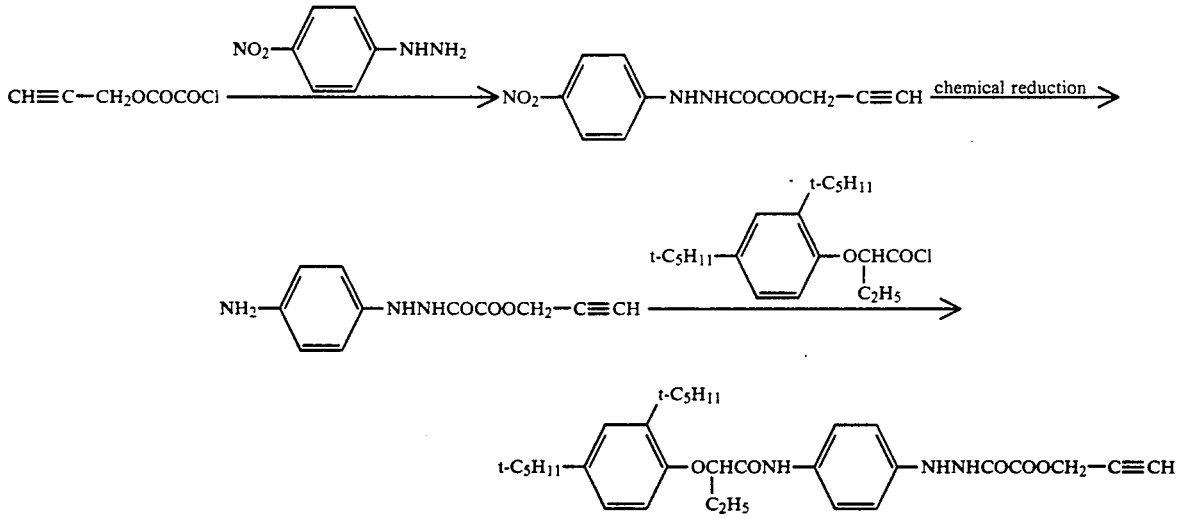
Compound (49) can be synthesized in the following synthesizing process.
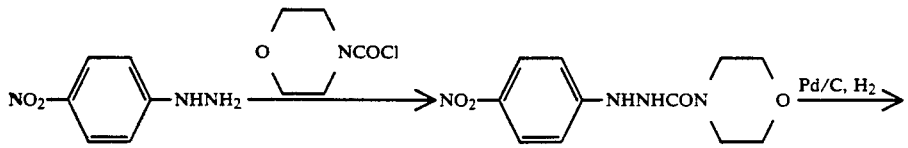

-continued

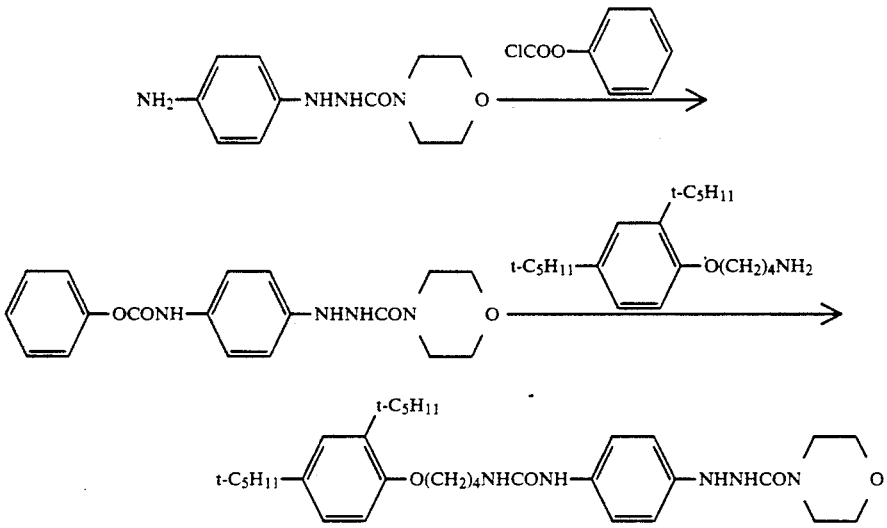

The examples of the other synthesizing processes for compounds (1) and (5) and those of the synthesizing processes for compound (57) will be given below The synthesizing scheme is as follows:

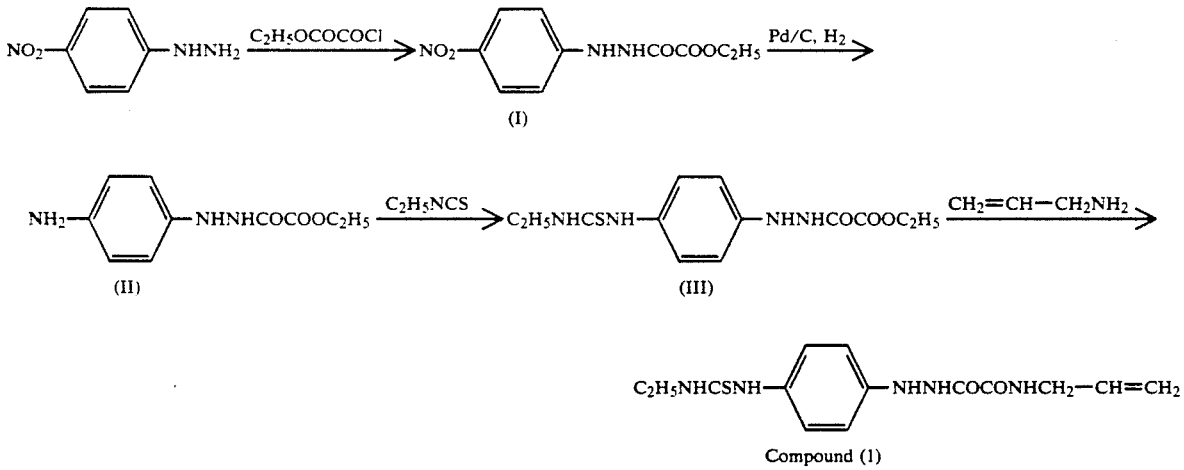

Into the suspension of 15 g of p-nitrophenyl hydrazine and 150 ml of acetonitrile, 19 g of ethoxyoxalyl chloride and then 14 g of triethylamine were successively dropped under an ice-water cooling condition. After completing the dropping, the resulting mixture was stirred for one hour at room temperature After removing the insoluble matters through filtration, the filtrate was concentrated and the residues were dissolved in 400 ml of chloroform. After washing with aqueous dilute alkaline solution and fractioning, the resulting chloroform layer was concentrated, so that 29.7 g of a crude product could be obtained. The resulting crude product was refined by washing it with stirring in 120 ml of isopropanol, so that 16.9 g of compound (1) could be obtained Compound (1) of 16 g and 5 g of Pd/C catalyst were added into 160 ml of acetic acid and stirred at the ordinary pressure and temperature under hydrogen gassified flow. After completing a reaction, the residue of the catalyst was removed and the filtrate was then concentrated, so that a crude product could be obtained. The resulting crude product was refined using column chromatography, so that 5.6 g of compound (II) could be obtained.

Into a suspension of 8.1 g of compound (II) and 80 ml of acetonitrile, 9 5 g of ethylisocyanate were dropped while it was kept heated under reflux. After the mixture was additionally heated under reflux for two hours and was then concentrated, 11 g of a crude product could be obtained. The resulting crude product was refined by recrystallizing it with acetonitrile, so that 4.5 g of compound (III) could be obtained.

Compound (III) of 5.0 g was dissolved in 40 ml of allylamine and the mixture was then heated under reflux for 2 hours. After the reaction was completed, it was concentrated, so that 4.9 g of a crude product could be obtained. The resulting crude product was washed with stirring in 25 ml of chloroform and was then refined, so that 4.3 g of compound (I) could be obtained.

Melting point: 206.9° C.

$M^{+}+1=322$ was detected out in FAB-MS.

Synthesis of compound (5)

The synthesizing scheme is as follows:

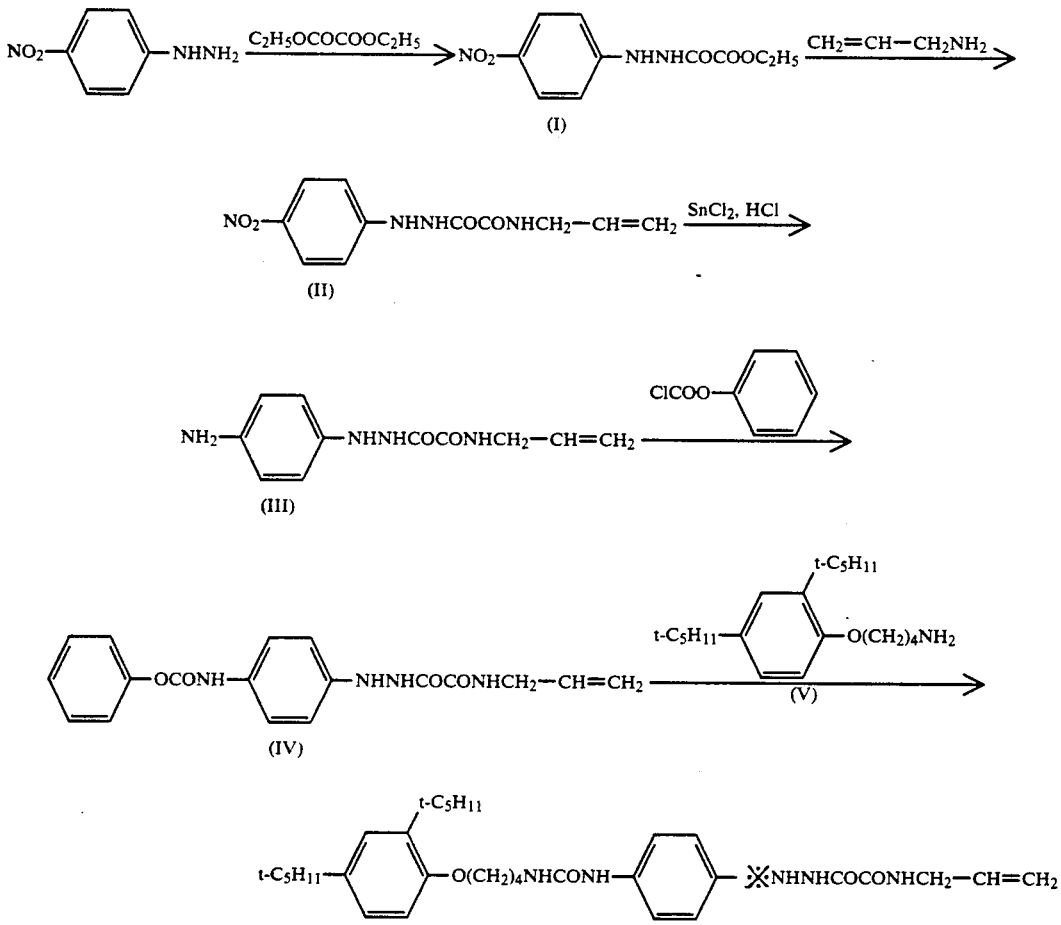

Compound (5)

Following the process detailed in U.S. Pat. No. 4,686,167, compound (I) was synthesized. Compound (I) of 31. 3 g, 300 ml of ethanol and 10.6 g of arylamine were heated at a under reflux so as to make a reaction for overnight and the resulting reacted solution was then concentrated. The residue was added with 600 ml of benzene and cooled down to 5° C. The resulting deposited crystals were filtered, so that 30 g of compound (II) could be obtained.

Compound (II) of 30 g was dissolved in 540 ml of THF -tetrahydrofuran- and 150 ml of concentrated hydrochloric acid was further added thereto. Then, 540 ml of THF solution containing 150.8 g of $SnCl_2$ was added thereto at room temperature and the resulting solution was reacted overnight at a temperature within the range of 40° to 50° C. After completing the reaction, the deposited crystals were filtered and the residue was suspended in one liter of methanol. The suspension was adjusted with stirring so as to have a pH within the range of 7.5 to 8 with $NH_4CH$ and was then stirred for one hour. After then, the methanol was concentrated by half and the resulting crystals were filtered after cooling down to 0° C, so that 19.8 g of compound (III) could be obtained.

After 15 g of compound (III) was dissolved in 600 ml of pyridine, 11 g of phenyl chloroformate was dropped, at the internal temperature of not higher than 15° C., into the resulting mixture while cooling them from the exterior. After completing the dropping, the resulting mixture was reacted overnight at room temperature. After completing the reaction, the pyridine solution was concentrated and the resulting residue was stirred and washed with 200 ml of acetone and then separated by filtration, so that 17 g of compound (IV) could be obtained.

Compound (IV) of 16.2 g was dissolved in 160 ml of pyridine and 16.8 g of compound (v) was added into 160 ml of the pyridine solution. The mixed solution was then heated and reacted for 3 hours under reflux. After completing the reaction, the pyridine was distilled off and 300 ml of n-hexane was added into the resulting residue. The mixture was stirred and washed, so that crystals could be separated by filtration. The resulting crude crystals were dissolved by heating in 60 ml of DMF -dimethyl formamide- and 180 ml of acetone was further added thereto. The mixture was cooled down to 0° C. and the deposited crystals were taken out, so that 13.8 g of compound (5) could be obtained.

Melting point: 198.5° to 199.5° C.

$M^+=565$ was detected in FAB-MS.

Synthesis of compound (57)

The synthesizing scheme was as follows:

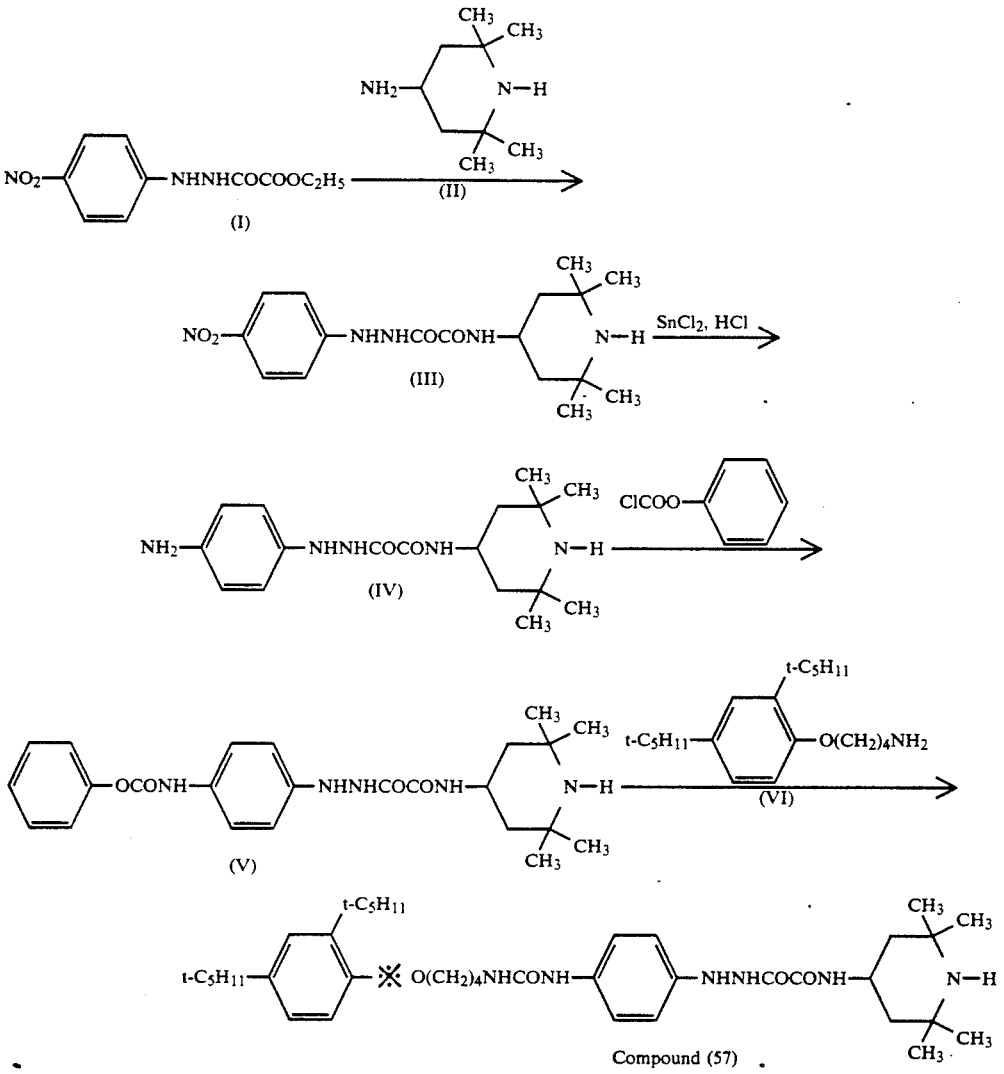

A mixture of 27 g of compound (I), 250 ml of ethanol and 25 g of compound (II) was reacted overnight with heating under reflux. After completing the reaction, the resulting reaction solution was cooled down so as to separate crystals by filtration and the crystals were washed. The resulting crude crystals of 31 g were recrystallized with 3 liters of methanol, so that 20.8 g of compound (III) could be obtained.

Compound (III) of 19 g was dissolved in 400 ml of THF and 115 ml of concentrated hydrochloric acid was further added thereto. Then, 300 ml of THF solution containing 69.4 g of $SnCl_2$ was added thereto at room temperature and the resulting solution was reacted overnight at a temperature within the range of 40° to 50° C. After completing the reaction, the deposited crystals were separated by filtration and the filtrate was dissolved in 420 ml of methanol. After dissolving, the dissolved solution was suspended by adding it in 1680 ml of THF with stirring and the suspension was adjusted with stirring so as to have a pH of 8.5 with $NH_4CH$ and was then stirred for 15 minutes. After then, the resulting crystals were filtered, so that 11.5 g of compound (IV) could be obtained.

After 10 g of compound (IV) was dissolved in one liter of pyridine, 5.2 g of phenyl chloroformate was dropped, at the internal temperature of not higher than 15° C., into the resulting mixture while cooling them from the exterior. After completing the dropping, the resulting mixture was reacted overnight at room temperature.

After completing the reaction, the solution was concentrated so as to be 700 to 800 ml and 400 ml of acetone was added to the concentrated solution. The mixture thereof was stirred, so that 17 g of compound (IV) could be obtained.

The resulting crude crystals were suspended in 200 ml of acetone and reduced. Then, 260 ml of DMF was dropped thereinto and dissolved together. The insoluble matters were removed therefrom and the residual solution was cooled down to 0° C. and deposited crystals were filtered, so that 8.5 g of compound (V) could be obtained.

Compound (V) of 10 g was suspended in 200 ml of pyridine and 100 ml of pyridine solution containing 8.1 g of compound VI was further added thereinto. The resulting mixed solution was reacted with reflux for 3 hours. After completing the reaction, 2 liters of acetone was added into the resulting reaction solution and crystallized so that the crystals could be separated by filtration. The resulting crude crystals were suspended in 85 ml of acetone and reduced. Immediately after dropping 85 ml of methanol thereto and dissolving them together, the solution was cooled down to 0° C. and the resulting crystals were separated by filtration, so that 6 g of compound (57) could be obtained.

Melting point: 230° to 231° C.

$M^{+}+1=565$ was detected in FAB-MS.

Synthesis of compound (61)

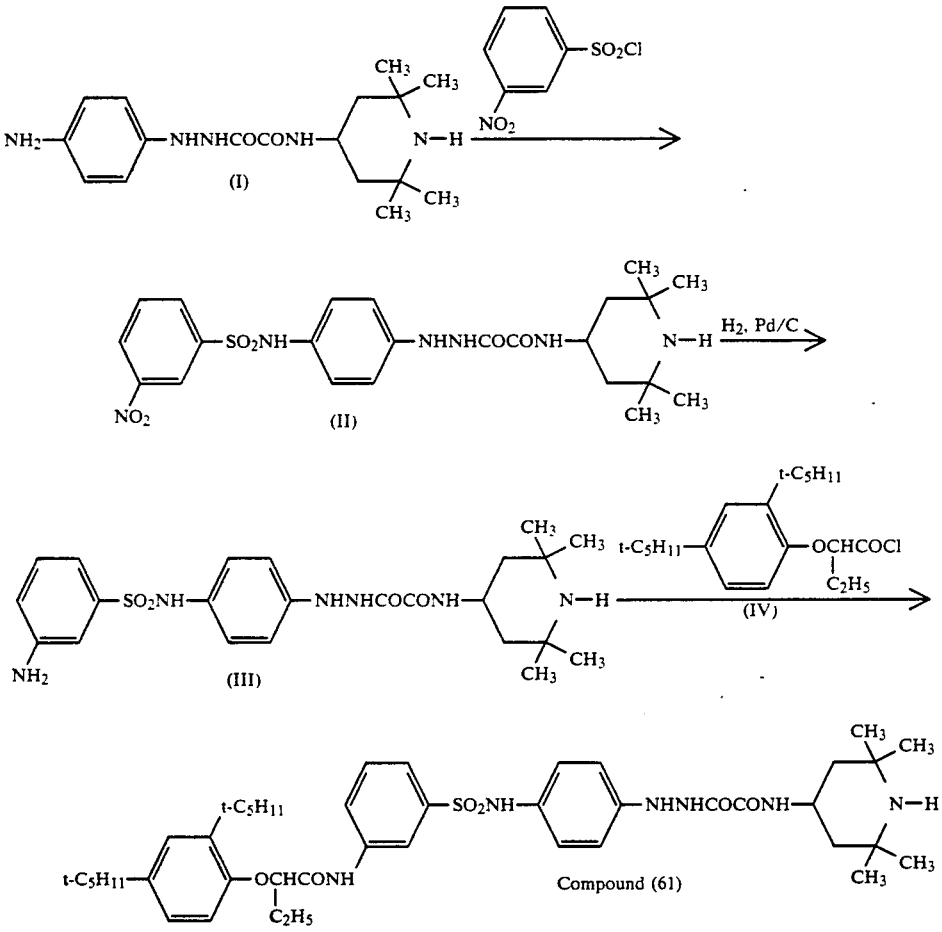

m-nitrobenzenesulfonyl chloride of 6.6 g was added into 50 ml of a pyridine solution containing 10 g of compound (I), while cooling them in an ice-water bath from the exterior. After reacting them together at room temperature for 10 hours, the remaining solvent was distilled off and water was added, so that solids could be separated by filtration. The separated solids were refined in column-chromatography (in which the proportion of chloroform/methanol was 3/2), so that 5.9 g of compound (II) could be obtained.

A mixed solution of compound (II) of 5.5 g, 1.0 g of Pd/C of wet 5%, and 150 ml of MEDH was subjected to a hydrogenation-reduction at an ordinary procedure.

After completing the reaction, Pd/C was removed and the solvent was distilled off, so that compound (III) could be obtained. The resulting compound (III) was dissolved in 50 ml of pyridine and 10 ml of a pyridine solution containing 4.0 g of compound (IV) was dropped thereinto while cooling them in an ice-water bath from the exterior. After the mixture was stirred at room temperature for 5 hours, the remaining solvent was distilled off and water was added, so that solids could be obtained. After the resulting solids were refined in column-chromatography (in which the proportion of methylene chloride/methanol was 5/1), the resulting refined solids were recrystallized with ethyl acetate-n-hexane, so that 1.0 g of compound (61) could be obtained.

Melting point: 165° to 172° C.

The structure of the compound was confirmed in MS and NMR.

Compound (62) can be synthesized in the following process:

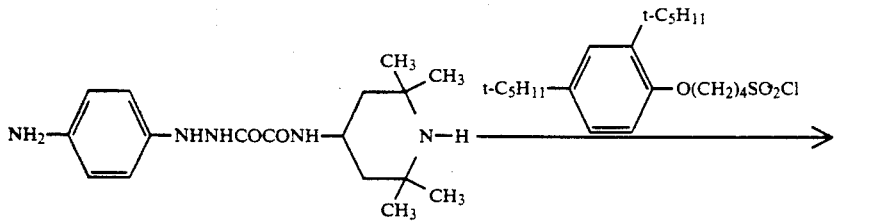
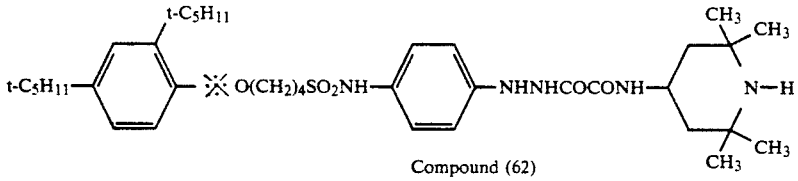
Compound (62)
Compound (116) can be synthesized in the following process:
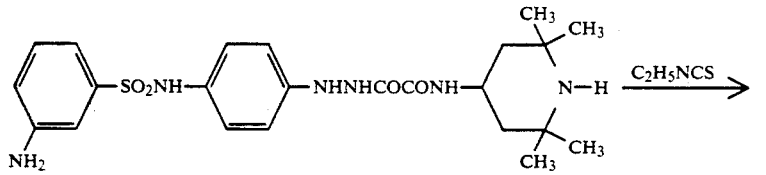
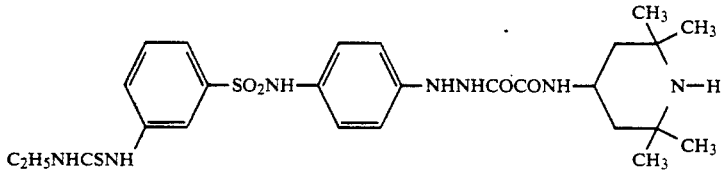
Compound (116)
Compound (133) can be synthesized in the following process:
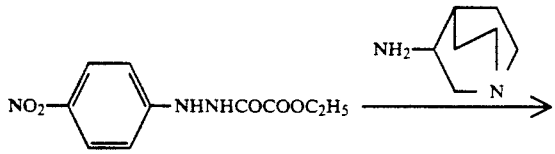
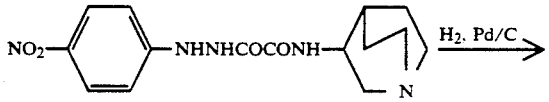
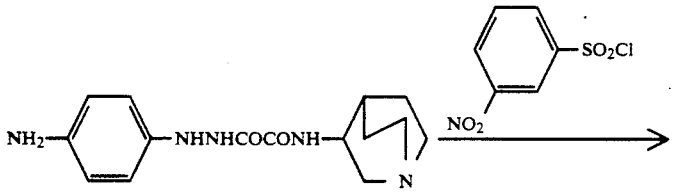
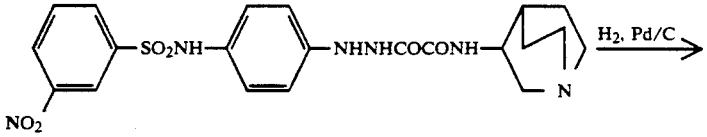

-continued
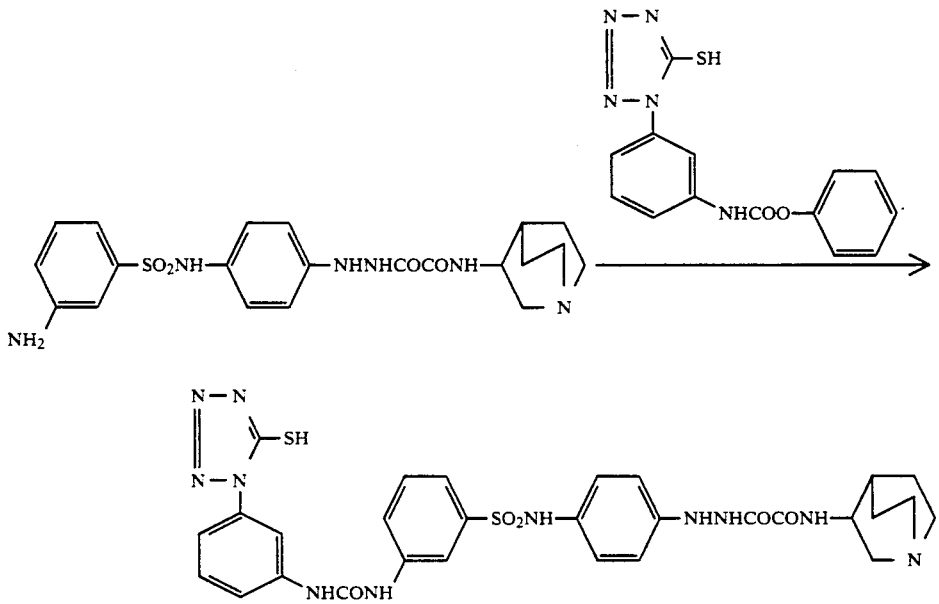
Compound (133)
Compound (140) can be synthesized in the following process:
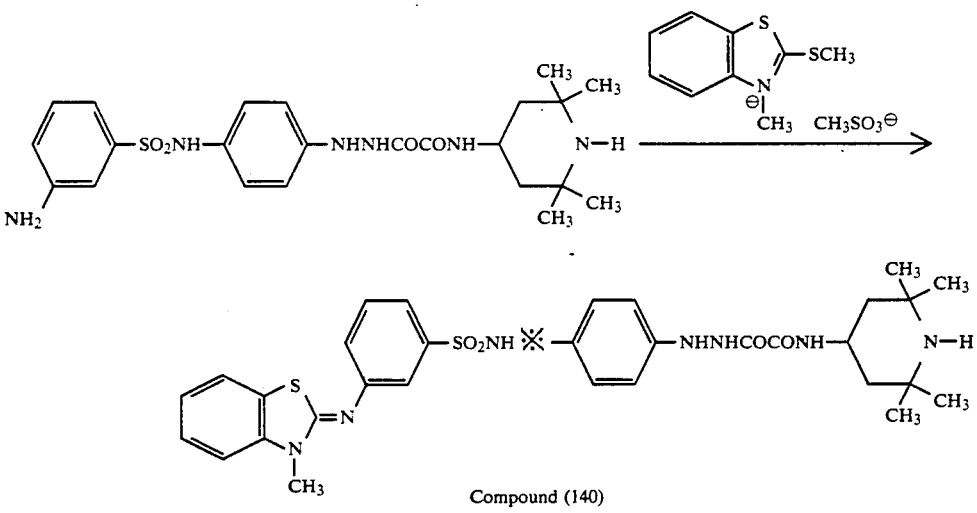
Compound (140)
Compound (71) can be synthesized in the following process:
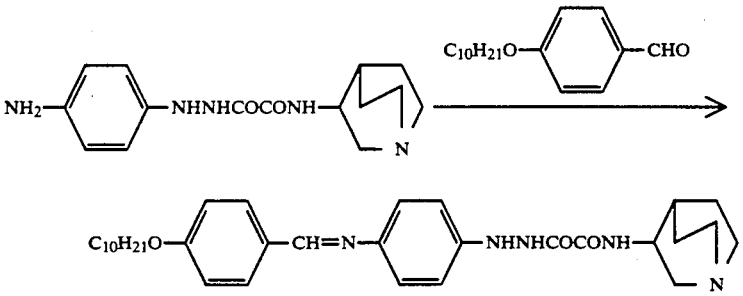
Compound (71)
Compound (149) can be synthesized in the following process:

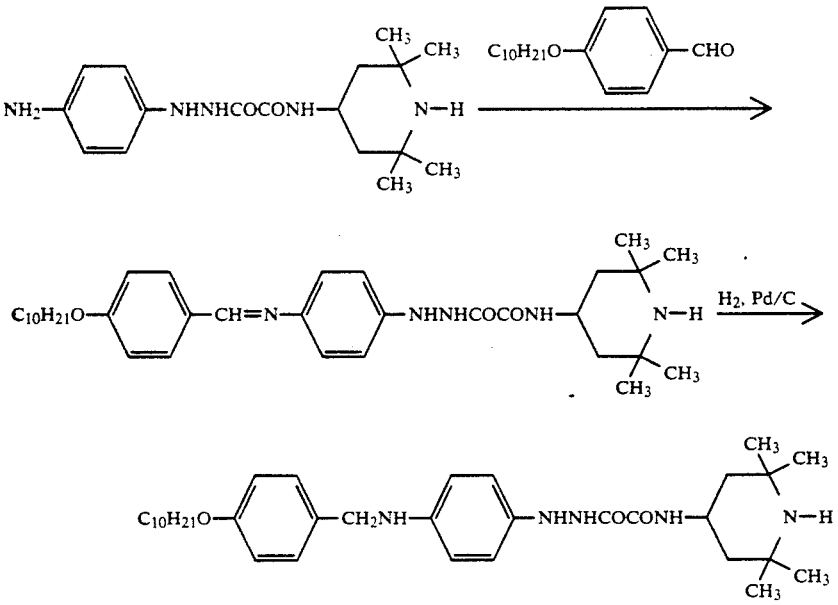
Compound (149)
Compound (178) can be synthesized of the intermediates detailed in European Patent No. 330,109 in the following sunthesizing process:
Compound (209) can be synthesized of the intermediates detailed in Japanese Patent Application No. 62-336565/1987 in the following manner:
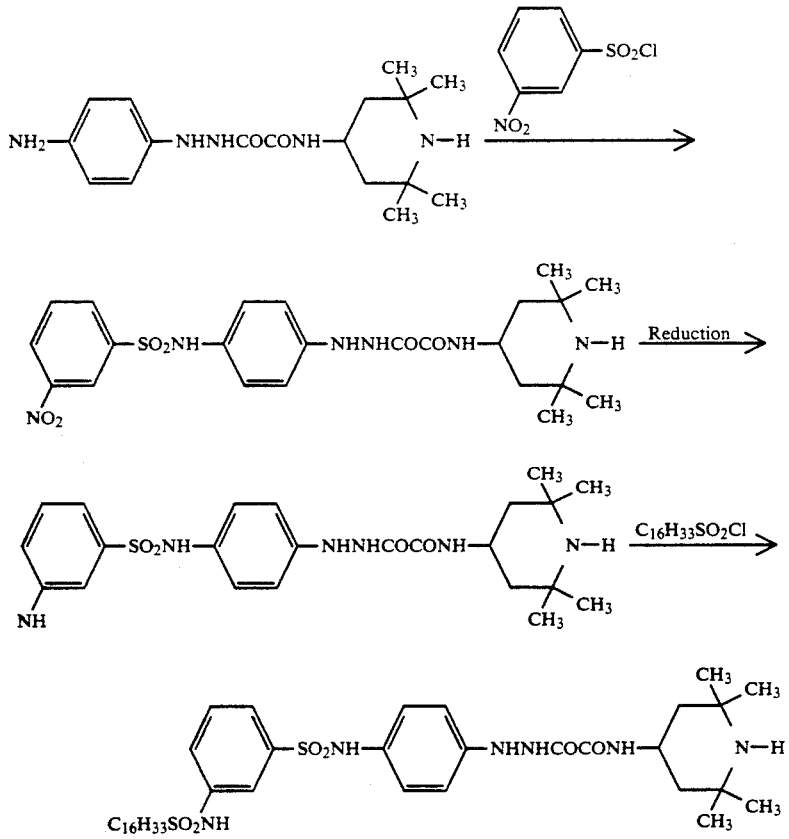

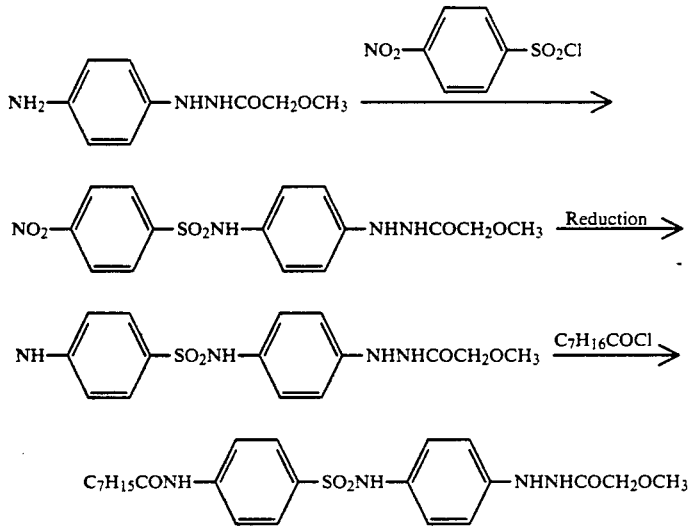

The other compounds can also be synthesized in the similar processes.

Described next are the preferable embodiments of the silver halide photographic light sensitive material of the invention when it is served as a light sensitive material capable of displaying the photographic characteristics of high contrast.

In the invention, the amine compounds and quaternary onium salt compounds, which are jointly applicable together with the compounds represented by the aforegiven formula A, B or C, include for example, the compounds represented by the following formulas I through VI. Among them, the preferable compounds include for example the compounds represented by formula V-I, V-II, V-III, VI-I, VI-II or VI-III. Compounds represented by formula V-I, V-II, VI-I or VI-II are more preferable and compounds of formula VI-II are most preferable.

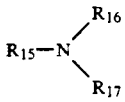

Formula I wherein $R_{15}$, $R_{16}$ and $R_{17}$ represent each a hydrogen atom or a substituent, provided, two or three of $R_{15}$, $R_{16}$ and $R_{17}$ may and $R_{17}$ are not hydrogen atoms at the same time. The substituents represented by $R_{15}$, $R_{16}$ and $R_{17}$ include, for example, alkyl groups such as a methyl, ethyl, propyl, butyl, hexyl and cyclohexyl groups; alkenyl groups such as allyl, and butenyl groups; alkynyl groups such as a propargyl and butynyl groups; aryl groups such as a phenyl and naphthyl groups; and saturated and unsaturated heterocyclic groups such as piperidinyl, piperazinyl, norpholinyl, pyridyl, furyl, thienyl, tetrahydrofuryl, tetrahydrothienyl and sulforanyl groups.

$R_{15}$, $R_{16}$ and $R_{17}$ may be so coupled to each other as to form a ring such as those of piperidine, morpholine, piperazine, quinuclidine and pyridine.

The groups represented by $R_{15}$, $R_{16}$ and $R_{17}$ may be substituted by the Substituents such as hydroxy, alkoxy, aryloxy, carboxyl, sulfo, alkyl and aryl groups. When $R_{15}$ is an alkyl group. It preferably has a hydroxy group, a carboxy group or a sulfo group as a substituent thereof.

$R_{15}$, $R_{16}$ and $R_{17}$ preferably represent each a hydrogen atom or an alkyl group, except that all of the $R_{15}$ to $R_{17}$ are not hydrogen atoms at the same time.

The examples of the compounds represented by Formula I include, typically, the following compounds:

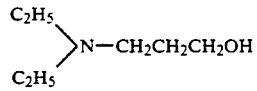

I-1

$CH_3NHCH_2CH_2OH$ I-2

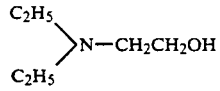

I-3

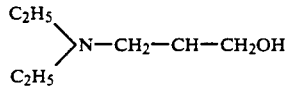

I-4

$NH_2(CH_2)_5)H$ I-5

I-6

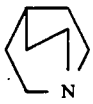

$(C_2H_5)_3N$ I-7

I-8

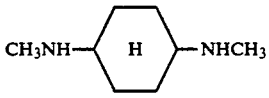

$(i\text{-}C_3H_7)_2NH$ I-9

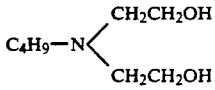

I-10

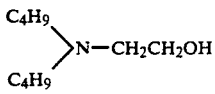

I-11

-continued

I-12

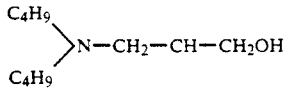

I-13

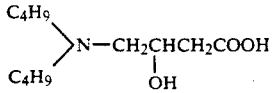

I-14

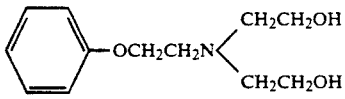

I-15

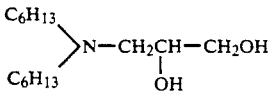

I-16

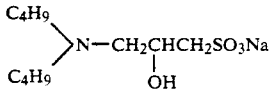

I-17

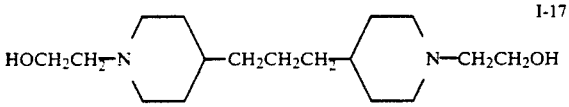

I-18

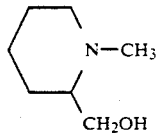

I-19

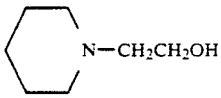

I-20

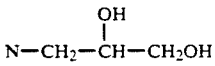

I-21

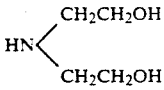

I-22

$N(CH_2CH_2OH)_3$

-continued

I-23

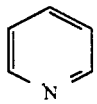

I-24

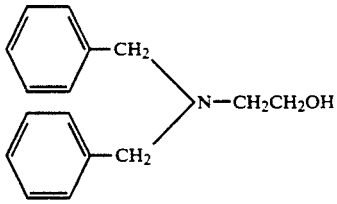

I-25

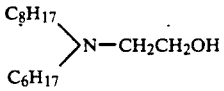

I-26

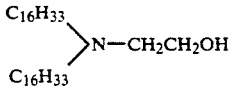

Formula II

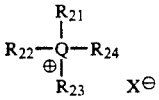

In the formula II, Q represents an N or P atom, $R_{21}$, $R_{22}$, $R_{23}$ and $R_{24}$ represent each a hydrogen atom or a substituent group; and $X^{\ominus}$represent an anion, provided $R_{21}$, $R_{22}$, $R_{23}$ and $R_{24}$ are not hydrogen atoms at the same time.

Two or three of $R_{21}$, $R_{22}$, $R_{23}$ and $R_{24}$ may be coupled to each other as to form a ring. The substituent groups represented by $R_{21}$, $R_{22}$, $R_{23}$ and $R_{24}$ include, for example, each of an alkyl, alkenyl, alkynyl, aryl, saturated or unsaturated heterocyclic and amino groups. They also include, typically, those groups represented by $R_{15}$, $R_{16}$ and $R_{17}$ denoted in formula I. The rings which can be formed by $R_{21}$, $R_{22}$, $R_{23}$ and $R_{24}$ denoted in formula I may be given, for example, as the rings similar to those detailed in the rings formed by two or three of $R_{15}$, $R_{16}$ and $R_{17}$ denoted in formula I. The anions represented by $X^{\ominus}$include, for example, inorganic and organic anions such as a halide ion, sulfate ion, nitrate ion, acetate ion, and paratoluene sulfonate ion.

Now, the typical examples of the compounds represented by formula II will be given below:

II-1

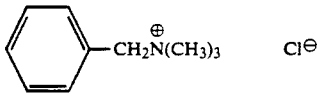

II-2

II-3

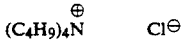

II-4

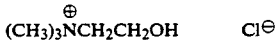

II-5

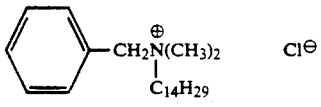

II-6

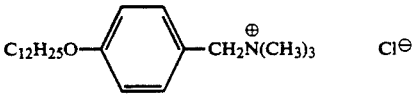

II-7

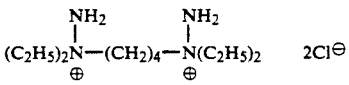

II-8

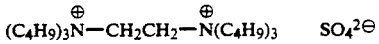

-continued
II-9
$(C_2H_5)_3\overset{\oplus}{N}-(CH_2)_8-\overset{\oplus}{N}(C_2H_5)_3$ $2Cl^{\ominus}$
II-10
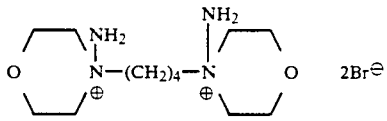
II-11
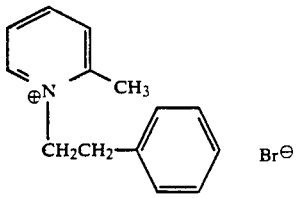
II-12
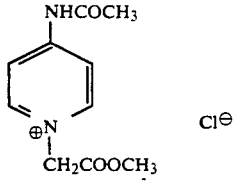
II-13
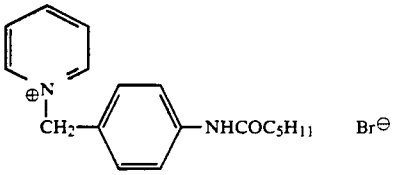
II-14
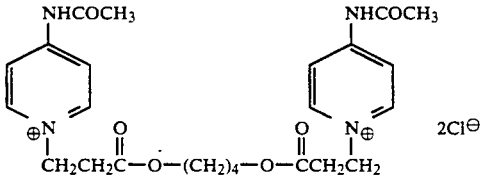
II-15
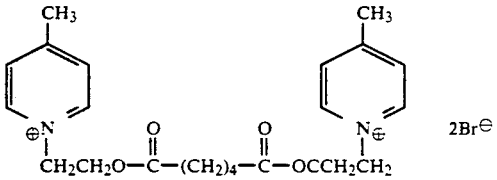
II-16
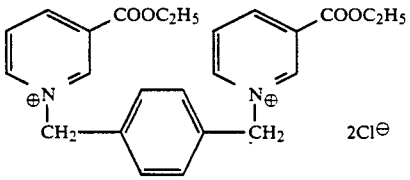
II-17
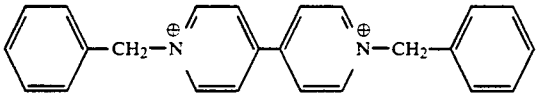
II-18
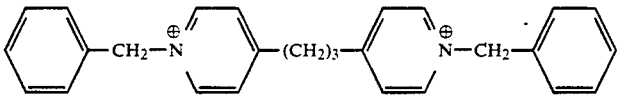
II-19
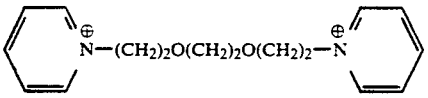
II-20
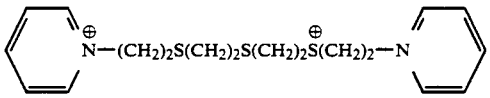
II-21
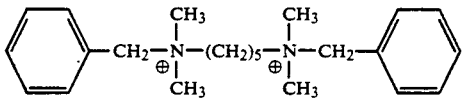
II-22
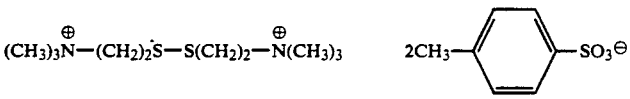
II-23
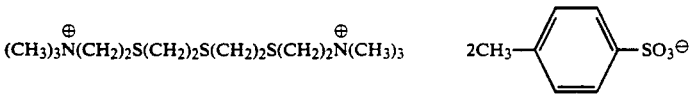

-continued

II-24

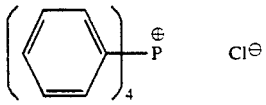

II-25

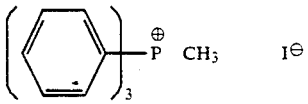

II-26

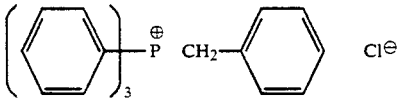

II-27

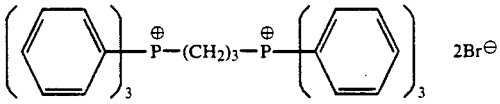

II-28

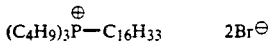

II-29

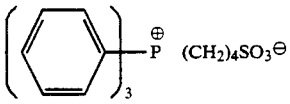

Formula III

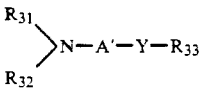

In the formula III above, $R_{31}$ and $R_{32}$ represent each an alkyl group, provided, $R_{31}$ and $R_{32}$ may be so coupled to each other as to form a ring; $R_{33}$ represents an alkyl, aryl or heterocyclic group; and A' represents an alkylene group.

Y represents a —$CONR_{34}$—, —$OCONR_{34}$—, $NR_{34}CONR_{34}$—, —$NR_{34}COO$—, —COO—, —OCO—, —CO—, —OCOO—, —$NR_{34}CO$—, —$SO_2NR_{34}$—, —$NR_{34}SO_2$—, —$NR_{34}SO_2NR_{34}$—, —$SO_2$—, —S—, —O—, $NR_{34}$, or —N= group; and $R_{34}$ represents a hydrogen atom or an alkyl group.

The alkyl groups represented by $R_{31}$ or $R_{32}$ include, for example those similar to the alkyl groups represented by $R_{15}$, $R_{16}$ and $R_{17}$ detailed for formula I; and the rings formed in the above case include, for example, those similar thereto.

The alkyl, aryl and heterocyclic groups each represented by $R_{33}$ also include, for example, those represented by $R_{15}$, $R_{16}$ and $R_{17}$ detailed for formula I.

The alkylene groups represented by A' include, for example, a methylene, ethylene, trimethylene, or tetramethylene group; and the substituents for A' include, for example, an aryl, alkoxy or hydroxy group, or a halogen atom.

The alkyl groups represented by $R_{34}$ include, preferably, a lower alkyl or aralkyl group having 1 to 5 carbon atoms, such as a benzyl group.

The typical examples of the compounds represented by formula III will be given below:

III-1

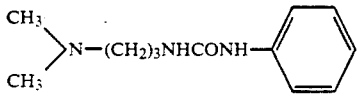

III-2

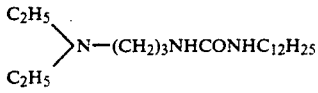

III-3

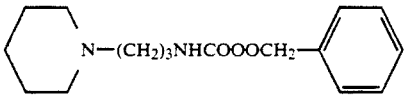

III-4

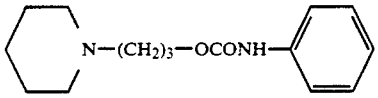

III-5

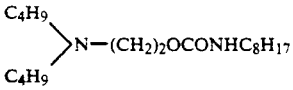

III-6

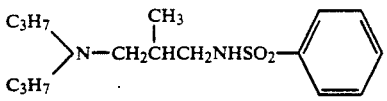

III-7

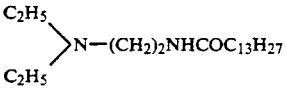

III-8

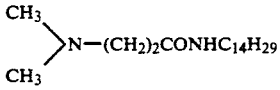

III-9

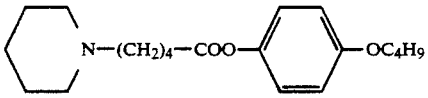

III-10

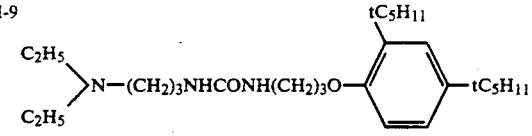

III-11

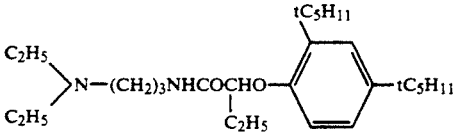

III-12

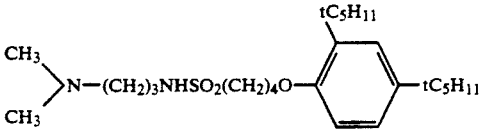

-continued

III-13

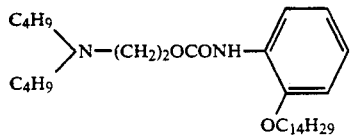

III-14

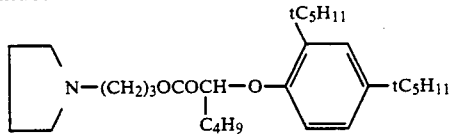

III-15

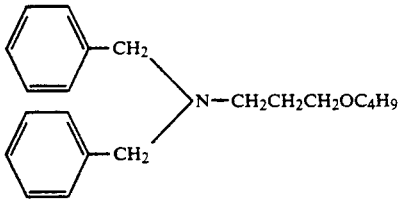

III-16

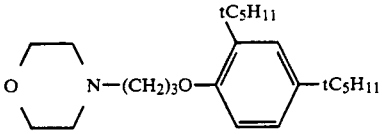

III-17

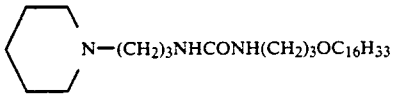

III-18

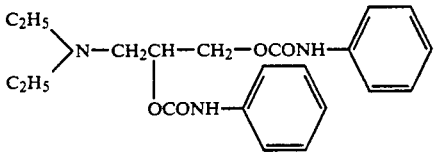

III-19

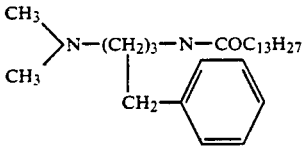

III-20

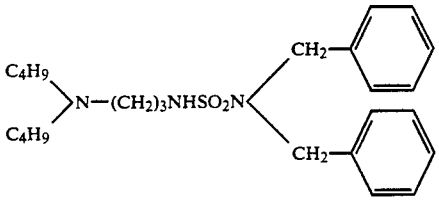

III-21

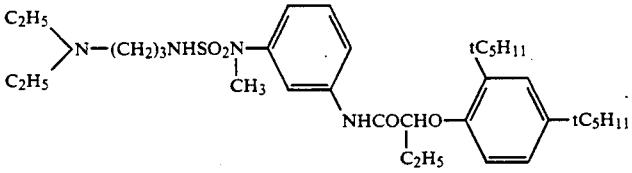

III-22

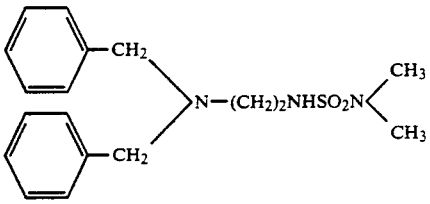

III-23

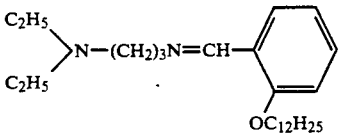

III-24

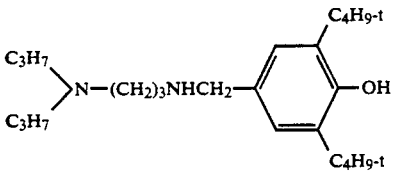

III-25

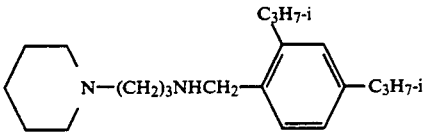

Formula IV

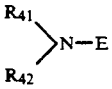

wherein $R_{41}$ and $R_{42}$ represent each a hydrogen atom, or an alkyl, alkenyl, alkynyl aryl or heterocyclic group; provided $R_{41}$ and $R_{42}$ may form a ring.

E represents a group having at least one group represented by $-(CH_2CH_2O)_n-$ in which n is an integer of 2 or more.

The alkyl, alkenyl, alkynyl, aryl and saturated and unsaturated heterocyclic groups each represented by $R_{41}$ and $R_{42}$ and the rings formed by $R_{41}$ and $R_{42}$ include the same as detailed in $R_{15}$, $R_{16}$ and $R_{17}$ denoted in formula I.

The typical examples of the compounds represented by formula IV will be given below:

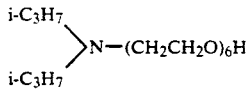
IV-1
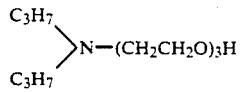
IV-2
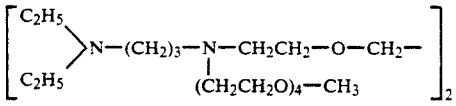
IV-3
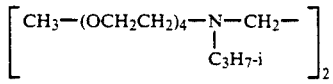
IV-4
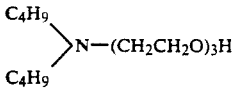
IV-5
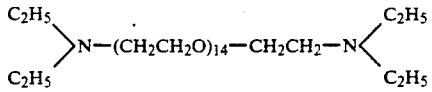
IV-6
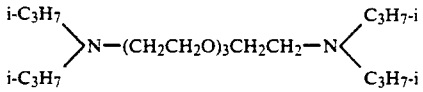
IV-7
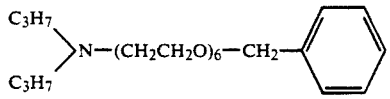
IV-8
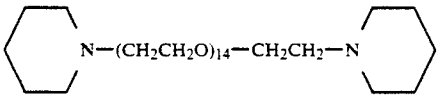
IV-9
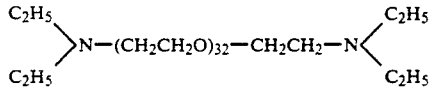
IV-10
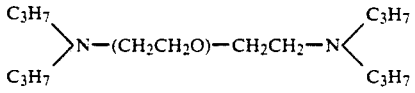
IV-11
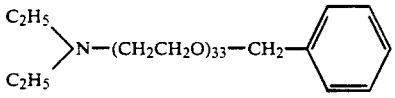
IV-12
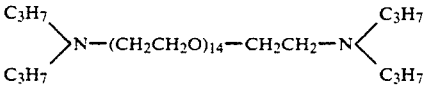
IV-13
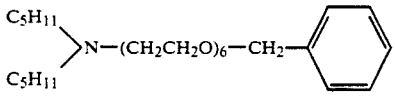
IV-14
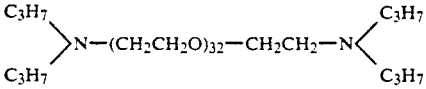
IV-15
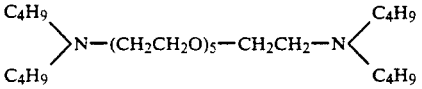
IV-16
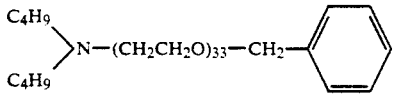
IV-17
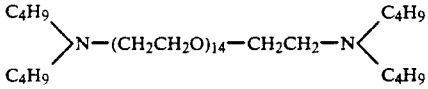
IV-18
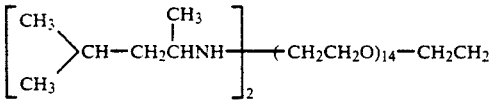
IV-19
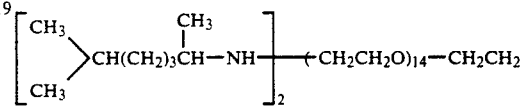
IV-20
$C_5H_{11}NH-(CH_2CH_2O)_{14}-CH_2CH_2NHC_5H_{11}$ IV-21
$C_7H_{15}NH-(CH_2CH_2O)_{14}CH_2CH_2NHC_7H_{15}$ IV-22
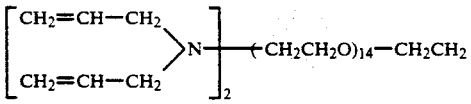
IV-23
$[CH_2{=}CH-CH_2NH]_2-(CH_2CH_2O)_{14}CH_2CH_2$ IV-24
$[CH{\equiv}C-CH_2NH]_2(CH_2CH_2O)_{14}CH_2CH_2$ IV-25
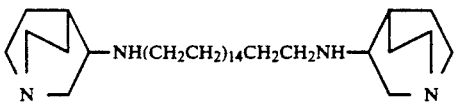
IV-26
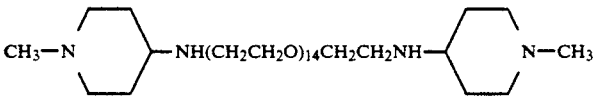
IV-27
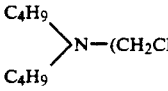
IV-28
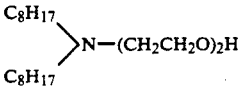
IV-29

-continued

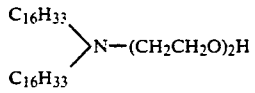

IV-30

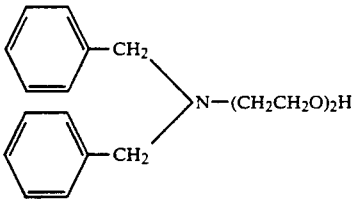

IV-31

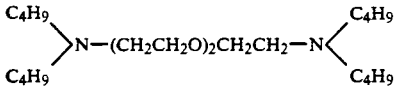

IV-32

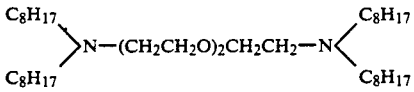

IV-33

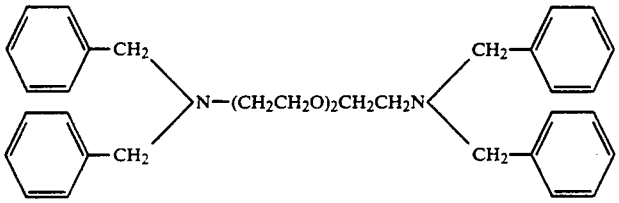

IV-34

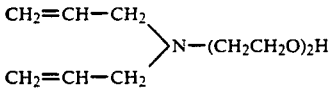

IV-35

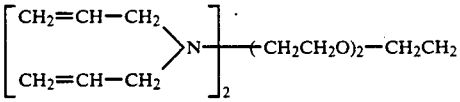

IV-36

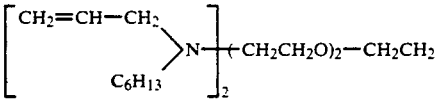

IV-37

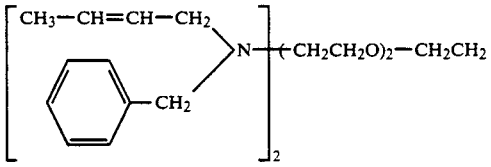

IV-38

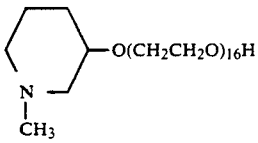

IV-39

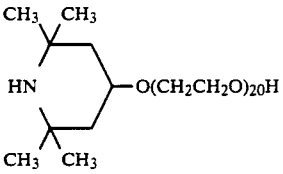

IV-40

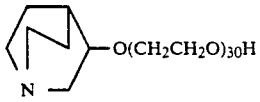

IV-41

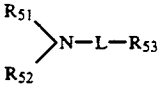

Formula V-I wherein $R_{51}$, $R_{52}$ and $R_{53}$ represent each an alkyl, alkenyl, alkynyl, aryl or heterocyclic group; provided, at least one of $R_{51}$, $R_{52}$ and $R_{53}$ represents an alkenyl or alkynyl group, or at least one of $R_{51}$ and $R_{52}$ represents an aryl or saturated or unsaturated heterocyclic group. $R_{51}$ and $R_{52}$ may form a ring. L represents a linking group.

The alkyl, alkenyl, alkynyl, aryl and heterocyclic groups represented each by $R_{51}$, $R_{52}$ and $R_{53}$ include the groups similar to those represented by $R_{15}$, $R_{16}$ and $R_{17}$ denoted in formula I. The ring formed by $R_{51}$ and $R_{52}$ includes, for example, the heterocyclic rings of piperidine, morpholine or pyrrolidine.

The linking groups represented by L include, for example, —A'—Y— given in formula III.

The typical examples of the compounds represented by formula V-I will be given below:

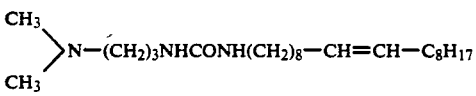

V-I-1

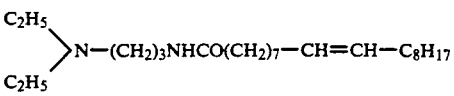

V-I-2

-continued
V-I-3
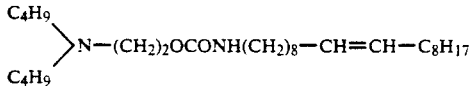
V-I-4
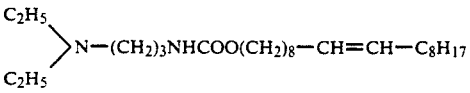
V-I-5
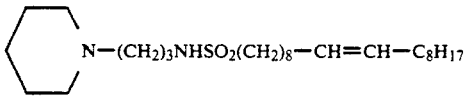
V-I-6
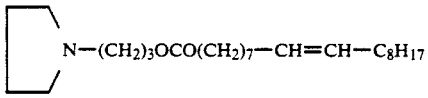
V-I-7
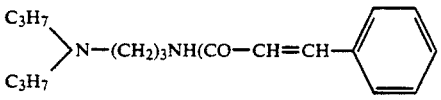
V-I-8
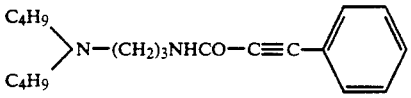
V-I-9
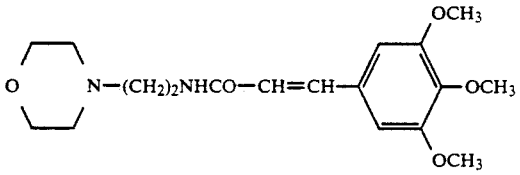
V-I-10
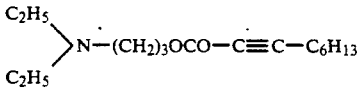
V-I-11
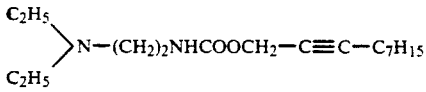
V-I-12
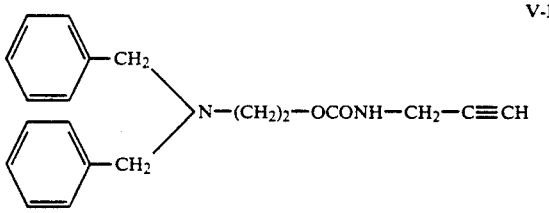
V-I-13
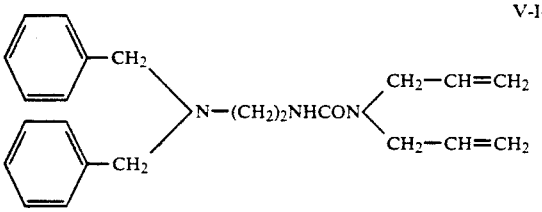
V-I-14
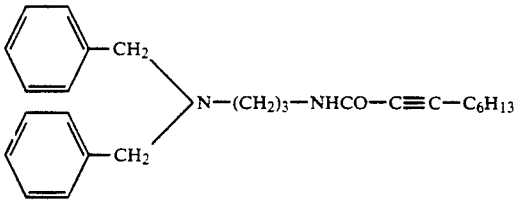
V-I-15
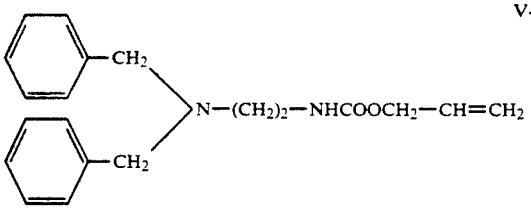
V-I-16
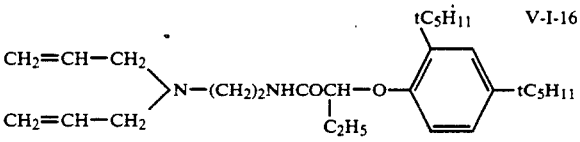
V-I-17
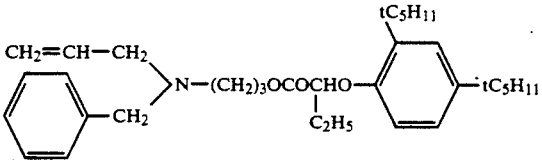
V-I-18
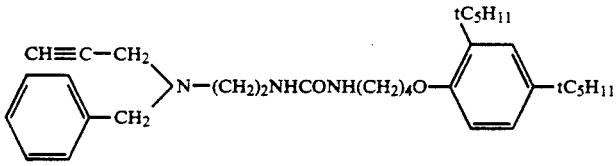
V-I-19
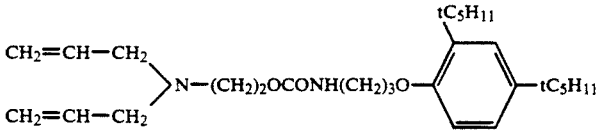

-continued

V-I-20

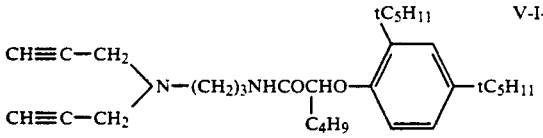

V-I-21

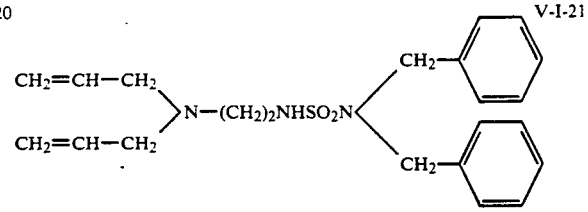

V-I-22

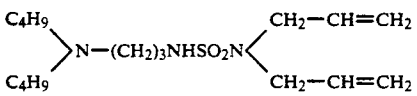

V-I-23

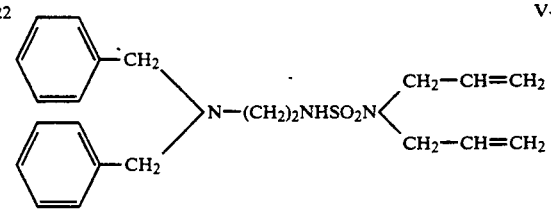

V-I-24

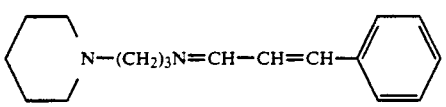

V-I-25

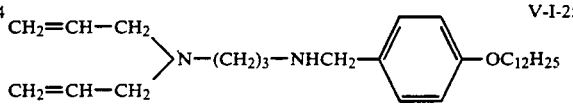

V-I-26

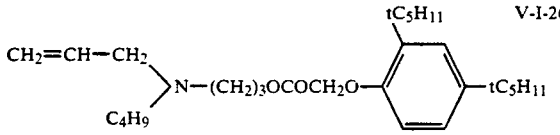

V-I-27

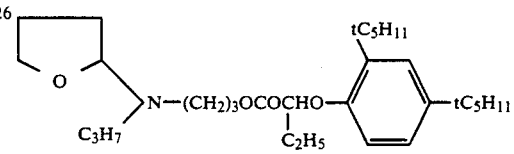

Formula V-II

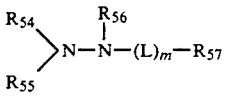

wherein $R_{54}$, $R_{55}$ and $R_{57}$ represents an alkyl, alkenyl, alkynyl, aryl or saturated or unsaturated heterocyclic group; and $R_{56}$ represents a hydrogen atom or a substitutable group.

L represents a linking group; and m is an integer of 0 or 1. $R_{54}$, $R_{55}$, $R_{56}$ and $R_{57}$ may be so linked to each other as to form a ring. The alkyl, alkenyl, alkynyl, aryl and heterocyclic groups represented by $R_{54}$, $R_{55}$ and $R_{57}$ include, for example, the groups similar to those detailed in $R_{15}$, $R_{16}$ and $R_{17}$ denoted in formula I.

The substitutable groups among the groups represented by $R_{56}$ include, for example, an alkyl, alkenyl, alkynyl, aryl and heterocyclic groups, and those similar to the above-mentioned may also be given.

L represents a linking group including, for example, —CO—, —COO—, —CONR$_{58}$—, —SO$_2$— and —SO$_2$NR$_{58}$— groups.

$R_{58}$ represents a hydrogen atom or a substituent.

The ring formed by $R_{54}$ and $R_{55}$ includes, for example, the heterocyclic rings of piperidine or morpholine.

The typical examples of the compounds represented by formula V-II will be given below:

V-II-1

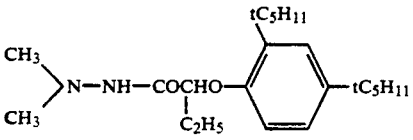

-continued

V-II-2

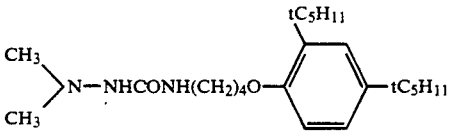

V-II-3

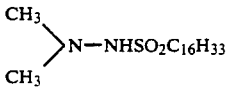

V-II-4

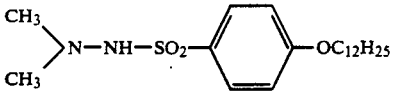

V-II-5

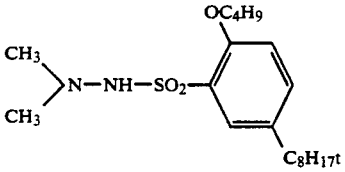

V-II-6

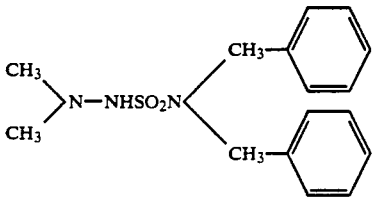

-continued
V-II-7
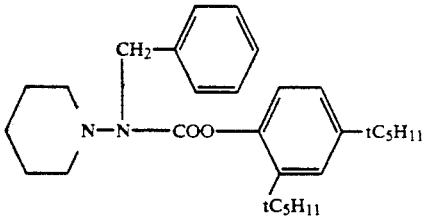
V-II-8
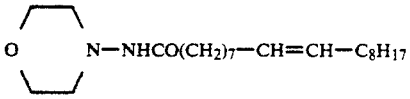
V-II-9
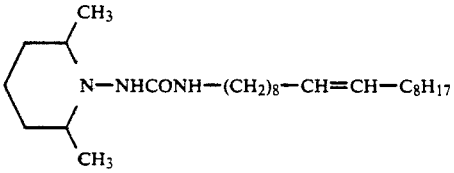
V-II-10
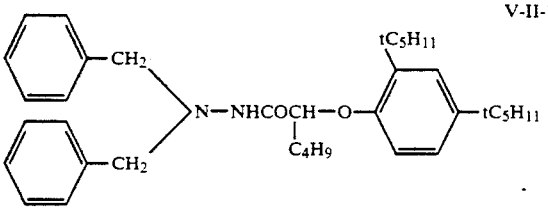
V-II-11
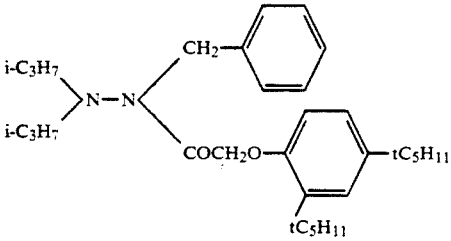
V-II-12
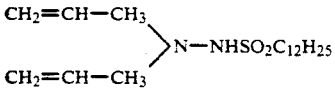
V-II-13
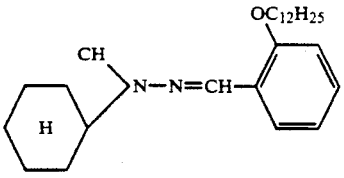
V-II-14
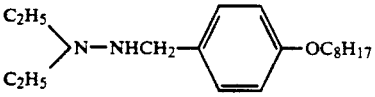
V-II-15
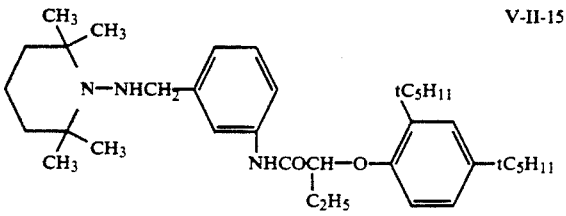
-continued
V-II-16
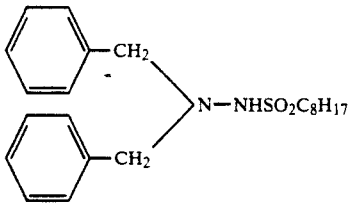
V-II-17
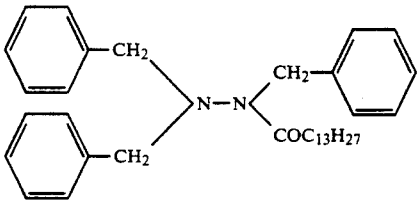
V-II-18
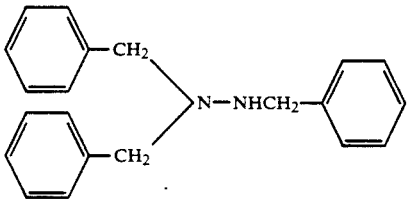
V-II-19
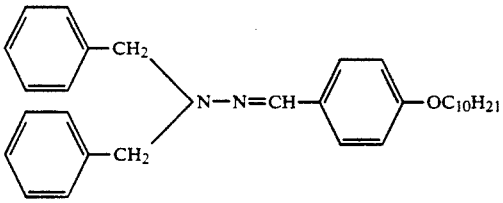
V-II-20
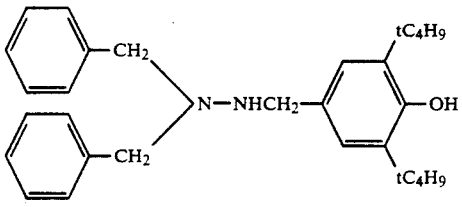
V-II-21
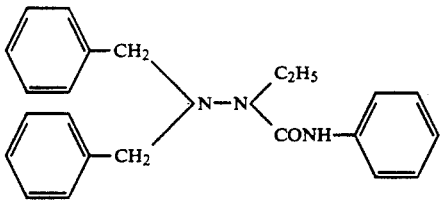
V-II-22
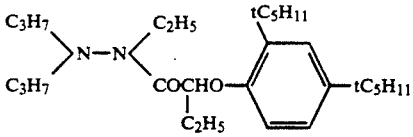
V-II-23
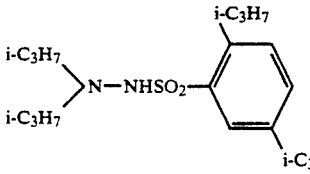

-continued

V-II-24

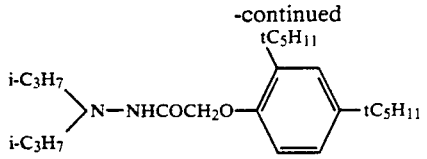

V-II-25

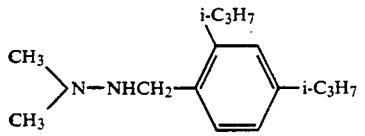

V-II-26

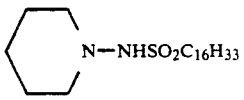

V-II-27

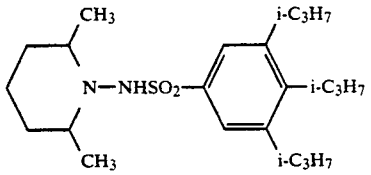

V-II-28

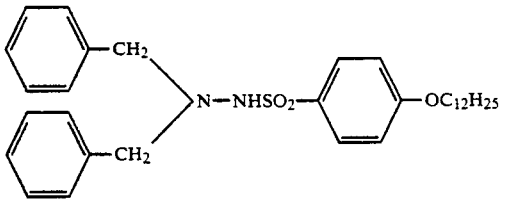

V-II-29

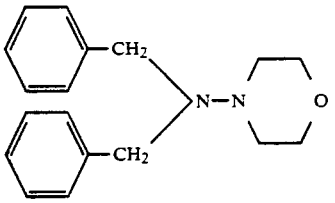

V-II-30

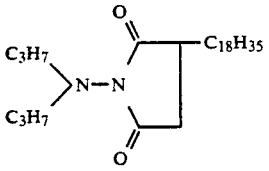

Formula V-III

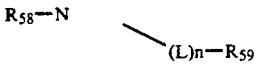

wherein $R_{58}$ represents a hydrogen atom or a substituent; $R_{59}$ represents an alkyl, alkenyl, alkynyl, aryl or heterocyclic group; and L represents a linking group.

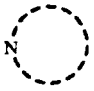

represents a nitrogen-containing hetero ring; and n is an integer of 0 or 1.

$R_{58}$ may form a ring, together with

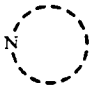

The alkyl, alkenyl, alkynyl, aryl and heterocyclic group represented by $R_{59}$ include the groups similar to those detailed in $R_{15}$, $R_{16}$, and $R_{17}$ denoted in formula I.

The substituents among the groups represented by $R_{58}$ include, for example, the groups similar to those detailed in the above-described $R_{59}$.

The heterocyclic rings represented by

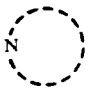

and the heterocyclic rings formed by

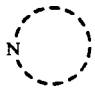

and $R_{58}$ include, for example, the heterocyclic rings of quinuclidine, piperidine or pyrazolidine.

The linking groups represented by L include, for example, the groups similar to those represented by Y denoted in formula III.

The typical examples of the compounds represented by formula V-III will be given below:

V-III-1

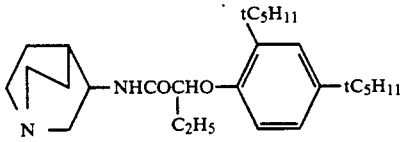

V-III-2

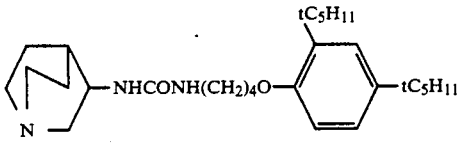

V-III-3

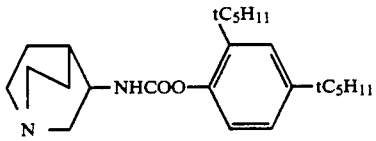

V-III-4

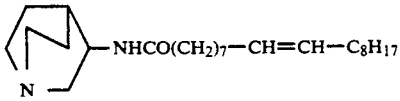

V-III-5

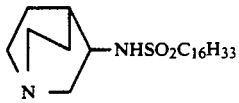

V-III-6

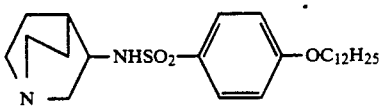

-continued
V-III-7
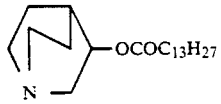
V-III-8
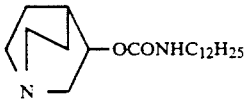
V-III-9
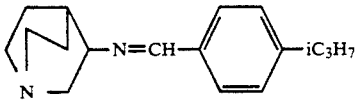
V-III-10
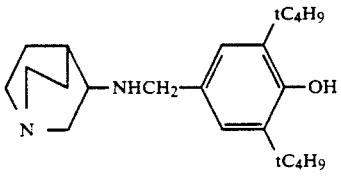
V-III-11
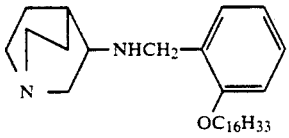
V-III-12
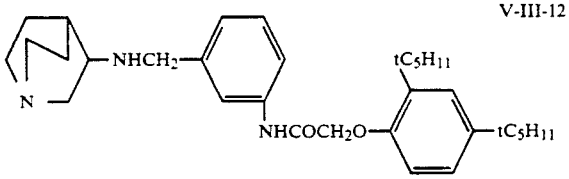
V-III-13
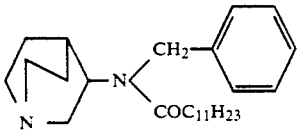
V-III-14
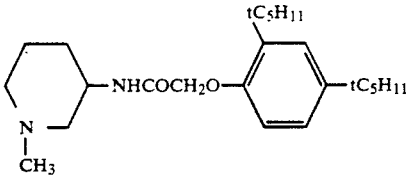
V-III-15
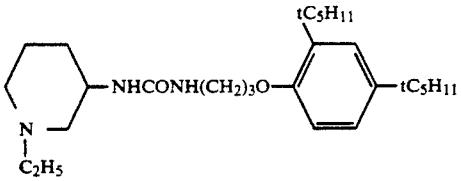
V-III-16
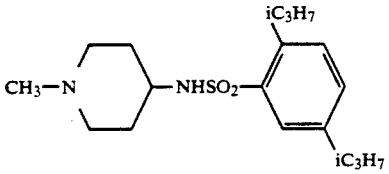
-continued
V-III-17
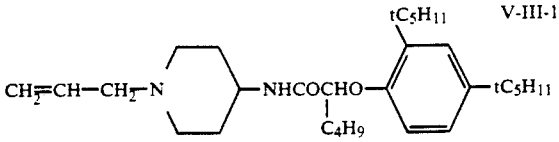
V-III-18
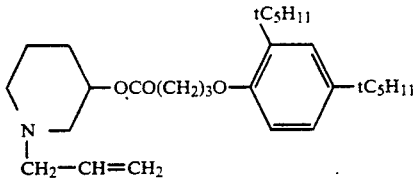
V-III-19
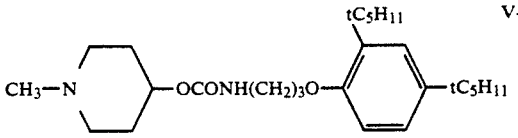
V-III-20
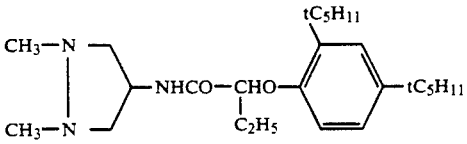
V-III-21
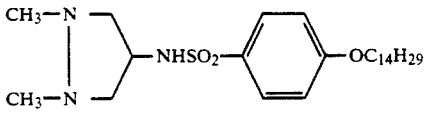
V-III-22
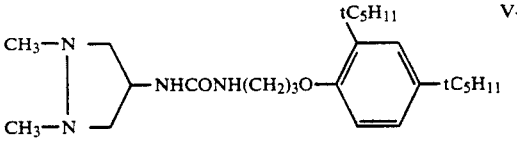
V-III-23
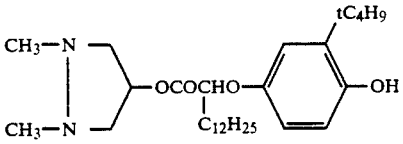
V-III-24
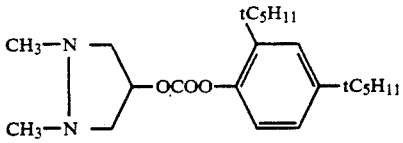
V-III-25
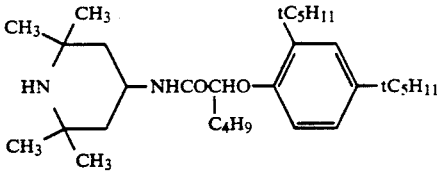
V-III-26
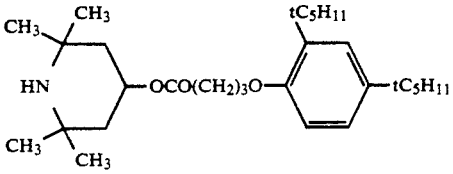

-continued

V-III-27

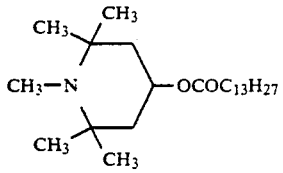

V-III-28

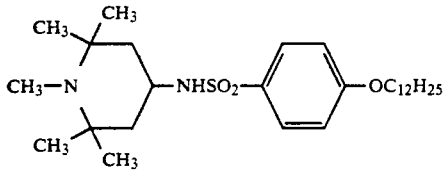

V-III-29

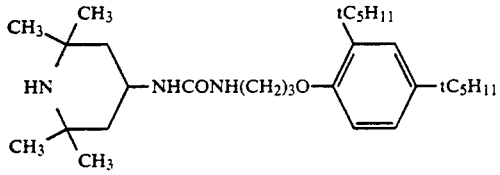

V-III-30

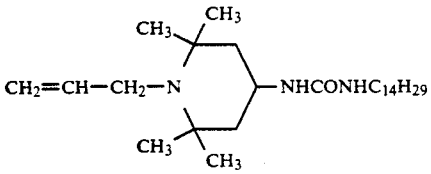

V-III-31

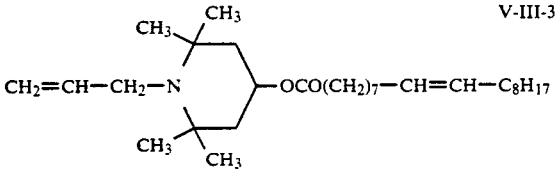

V-III-32

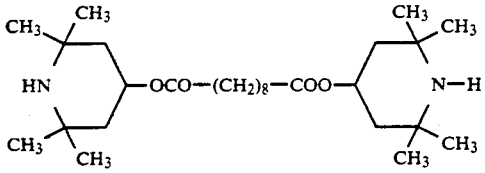

V-III-33

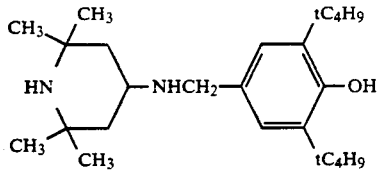

V-III-34

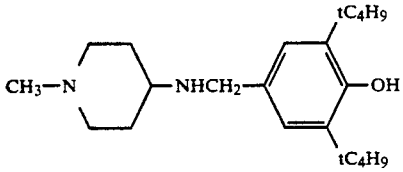

-continued

V-III-35

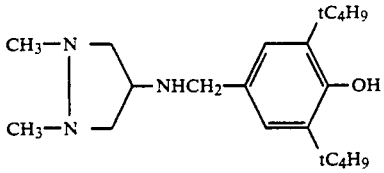

Formula VI-I

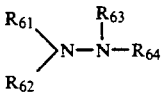

wherein $R_{61}$ and $R_{62}$ represent each an alkyl, alkenyl, alkynyl, aryl or heterocyclic group; and $R_{63}$ represents a hydrogen atom or a substituent.

$R_{64}$ represents a group containing at least one group represented by

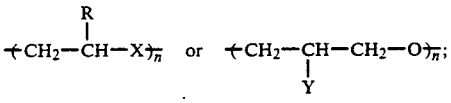

R represents a hydrogen atom or an alkyl group; X represents an O, S or NH group; Y represents a hydrogen atom or an OH group; and n is an integer of not less than 2.

Two of $R_{61}$, $R_{62}$, $R_{63}$ and $R_{64}$ may be so coupled to each other as to form a ring. The alkyl, alkenyl, alkynyl, aryl and heterocyclic groups include the groups similar to those detailed in $R_{15}$, $R_{16}$ and $R_{17}$ denoted in formula I.

The substituents represented by $R_{63}$ include, for example, an alkyl, alkenyl, alkynyl, aryl, saturated and unsaturated heterocyclic, acyl, sulfonyl, oxycarbonyl and carbamoyl groups.

Among the substituents represented by $R_{63}$, the alkyl, alkenyl, alkynyl, aryl and saturated and unsaturated heterocyclic groups include, for example, the groups similar to those detailed in $R_{15}$, $R_{16}$ and $R_{17}$ denoted in formula I.

The acyl groups include, for example, an acetyl or benzoyl group. The sulfonyl groups include, for example, a methanesulfonyl or toluene sulfonyl group. The oxycarbonyl groups include, for example, an ethoxycarbonyl or phenoxycarbonyl group. The carbamoyl groups include, for example, a methylcarbamoyl or phenylcarbamoyl group.

The rings formed by two of $R_{61}$, $R_{62}$, $R_{63}$ and $R_{64}$ include, for example, a ring of piperidine or morpholine.

Among the groups represented by R, the alkyl groups include, for example, methyl and ethyl groups, and the methyl groups may be preferable.

The typical examples of the compounds represented by formula VI-I will be given below:

VI-I-1

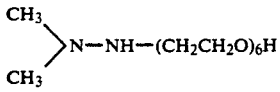

-continued
VI-I-2
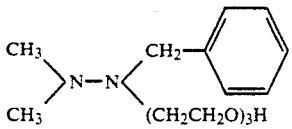
VI-I-3
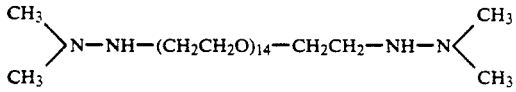
VI-I-4
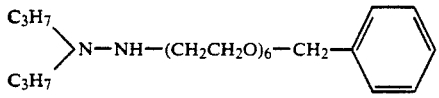
VI-I-5
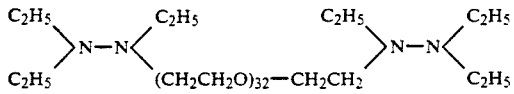
VI-I-6
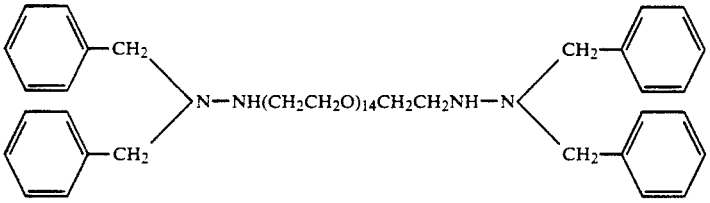
VI-I-7
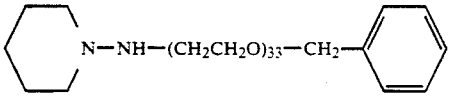
VI-I-8
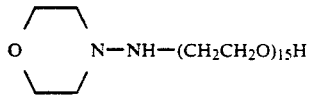
VI-I-9
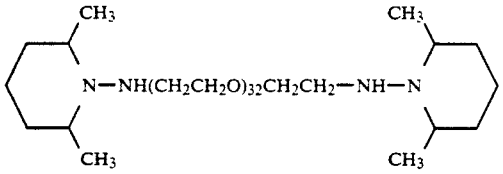
VI-I-10
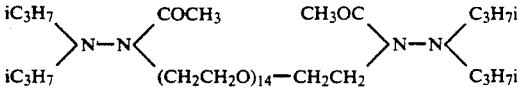
VI-I-11
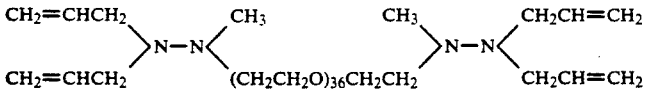
VI-I-12
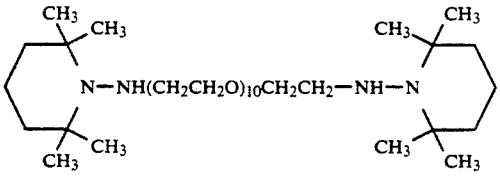

-continued
VI-I-13
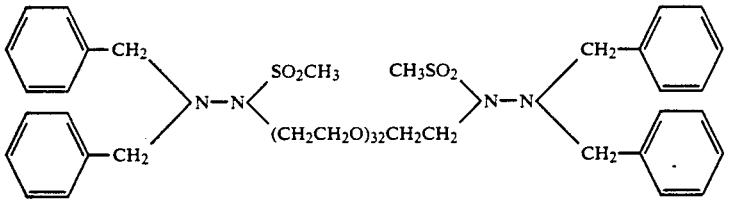
VI-I-14
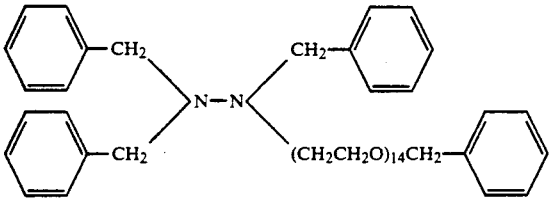
VI-I-15
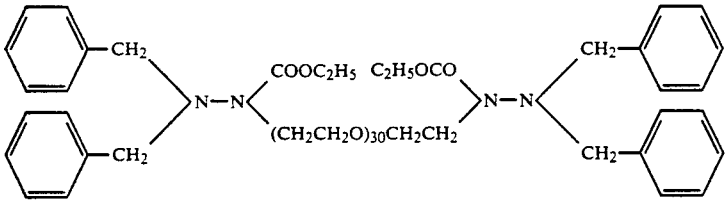
VI-I-16
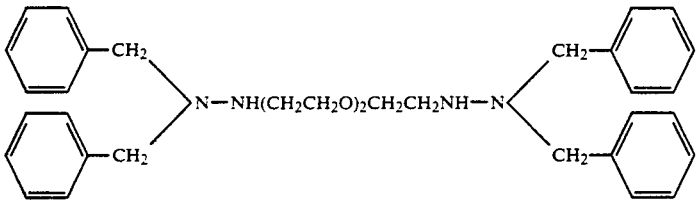
VI-I-17
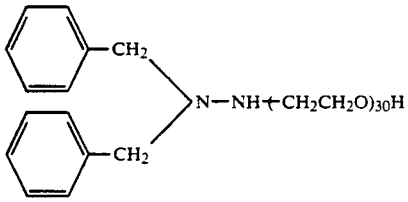
VI-I-18
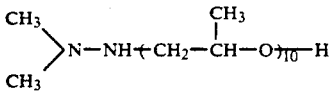
VI-I-19
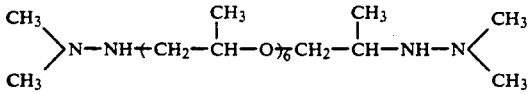
VI-I-20
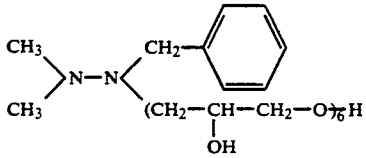
VI-I-21
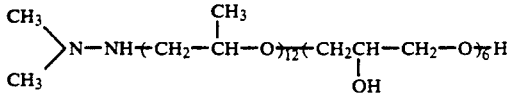

-continued
VI-I-22
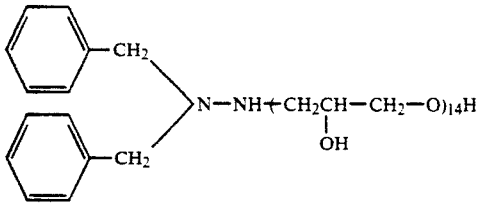
VI-I-23
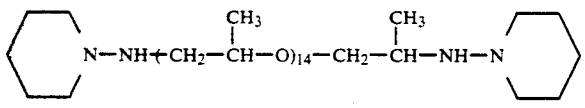
VI-I-24
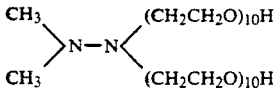
VI-I-25
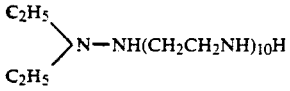
VI-I-26
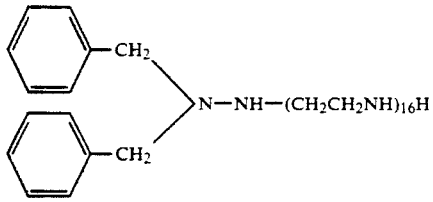
VI-I-27
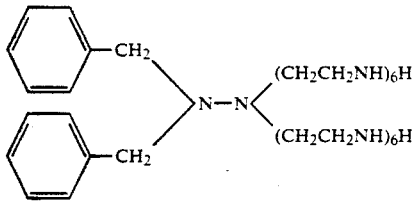
VI-I-28
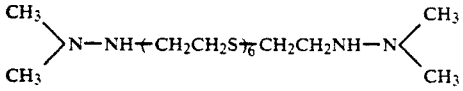
VI-I-29
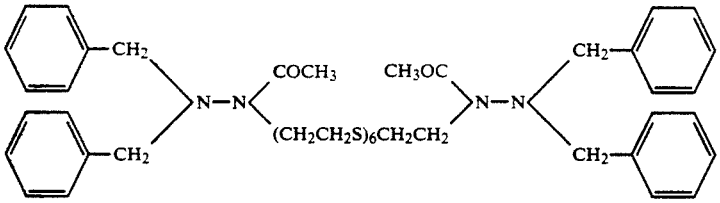
VI-I-30
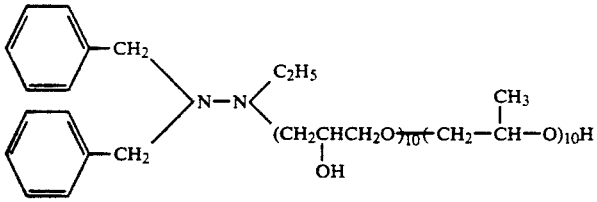
VI-I-31
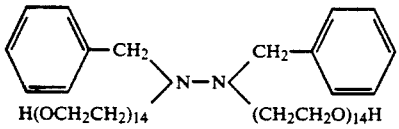

-continued
VI-I-32
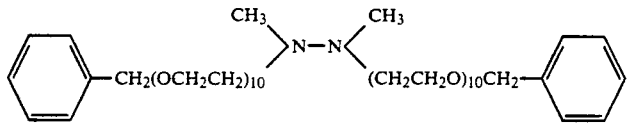
VI-I-33
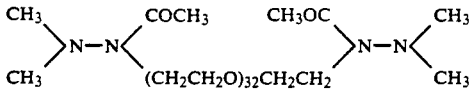
VI-I-34
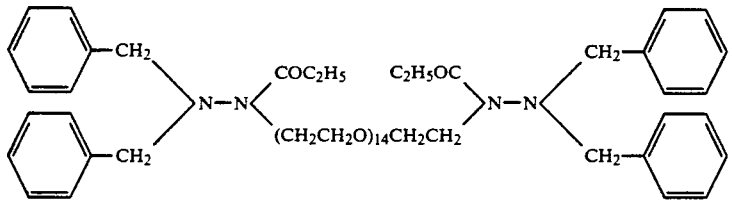
VI-I-35
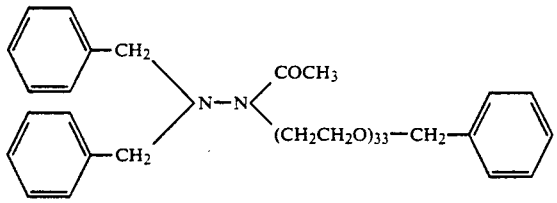
VI-I-36
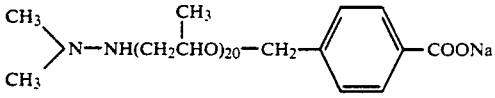
VI-I-37
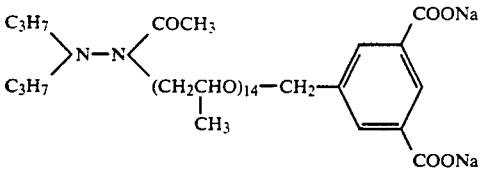
VI-I-38
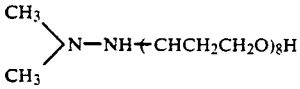
VI-I-39
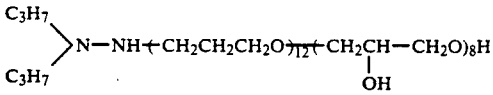
VI-I-40
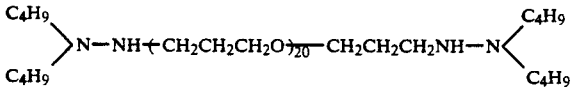
VI-I-41
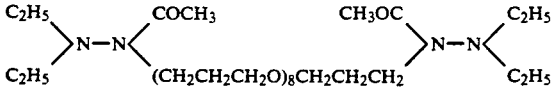
VI-I-42
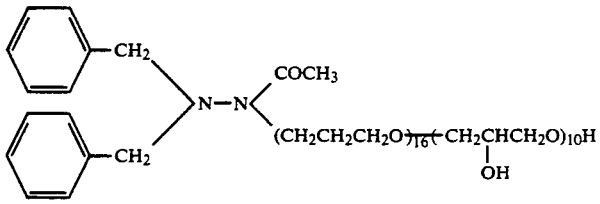

-continued

VI-I-43

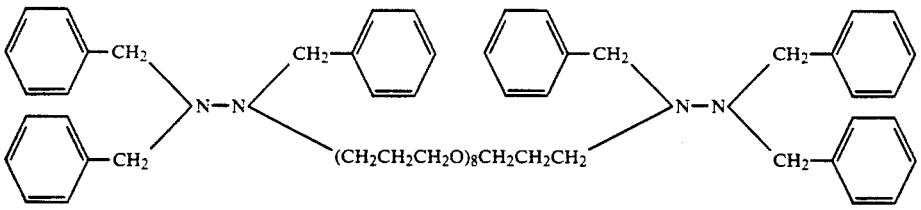

VI-I-44

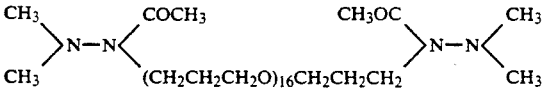

Formula VI-II

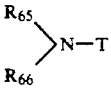

wherein $R_{65}$ and $R_{66}$ represent each a hydrogen atom or an alkyl, alkenyl, alkynyl, aryl or saturated or unsaturated heterocyclic group; provided $R_{65}$ and $R_{66}$ may form a ring. T represents a group containing at least one group represented by $\text{-}(CH_2-\overset{R}{\overset{|}{C}H}-X)_n\text{-}$ or $\text{-}(CH_2-\underset{Y}{\underset{|}{C}H}-CH_2-O)_n\text{-}$:

R represents a hydrogen atom or an alkyl group; X represents an O, S or NH group; Y represents a hydrogen atom or an OH group; and n is an integer of not less than 2; provided, when R represents a hydrogen atom, X shall represent an S or NH group. Among the groups represented by $R_{65}$ or $R_{66}$, the alkyl, alkenyl, alkynyl aryl and heterocyclic groups include, for example, the groups similar to those detailed in $R_{15}$, $R_{16}$ and $R_{17}$ denoted in formula I. The ring formed by $R_{65}$ and $R_{66}$ includes, for example, the heterocyclic rings of piperidine, morpholine, quinuclidine or pyrazolidine. The alkyl groups represented by R include, for example, a methyl or ethyl group and, among them, the methyl groups are preferable.

The typical examples of the compounds represented by formula VI-II will be given below:

VI-II-1

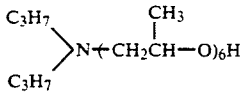

VI-II-2

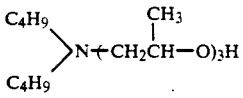

VI-II-3

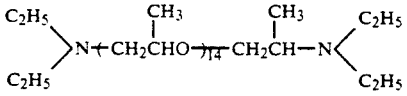

VI-II-4

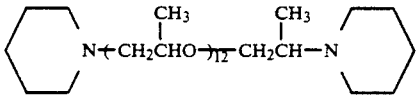

VI-II-5

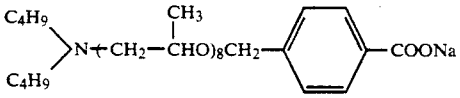

VI-II-6

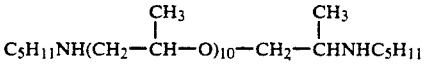

VI-II-7

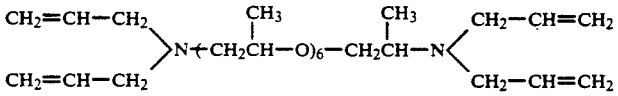

VI-II-8

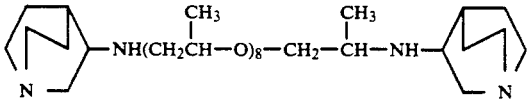

VI-II-9

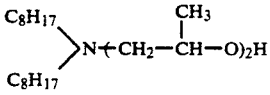

VI-II-10

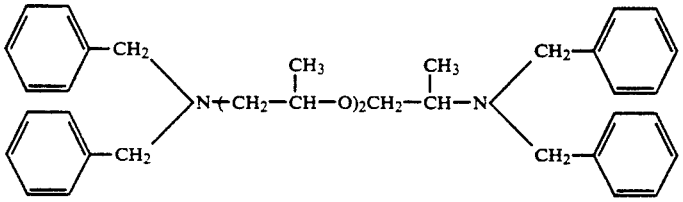

-continued
VI-II-11
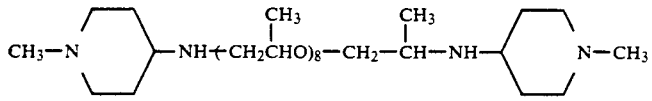
VI-II-12
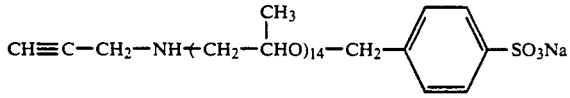
VI-II-13
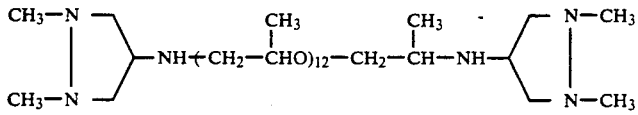
VI-II-14
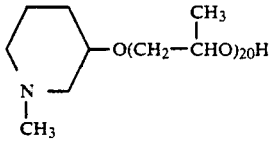
VI-II-15
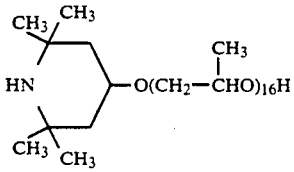
VI-II-16
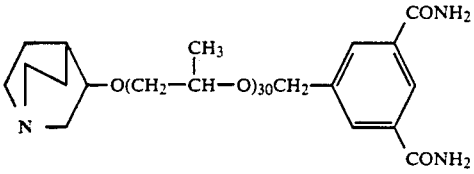
VI-II-17
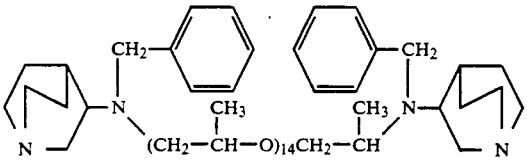
VI-II-18
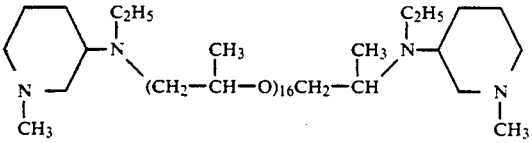
VI-II-19
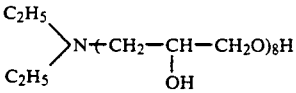
VI-II-20
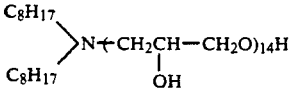
VI-II-21
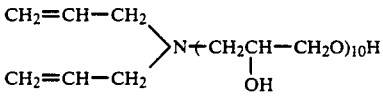
VI-II-22
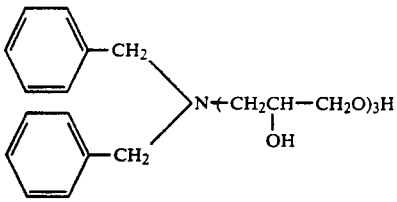
VI-II-23
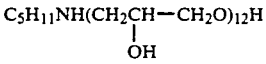
VI-II-24
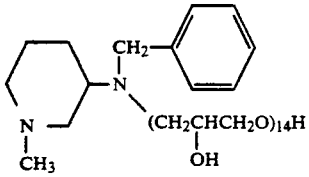
VI-II-25
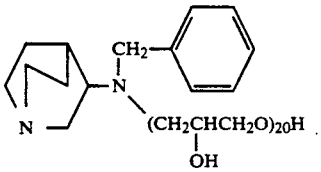
VI-II-26
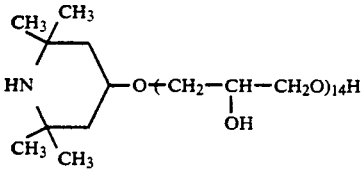
VI-II-27
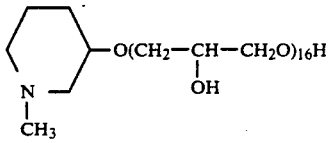

-continued
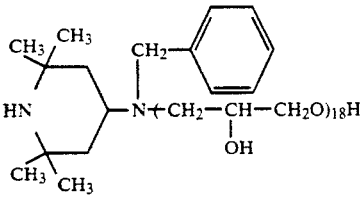
VI-II-28
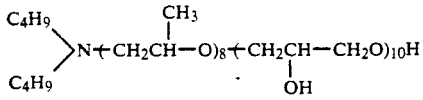
VI-II-29
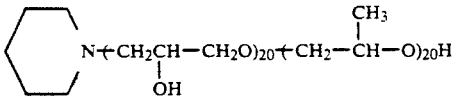
VI-II-30
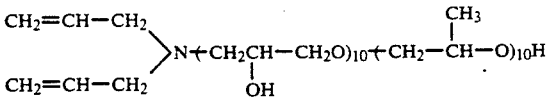
VI-II-31
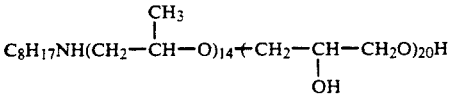
VI-II-32
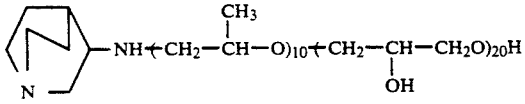
VI-II-33
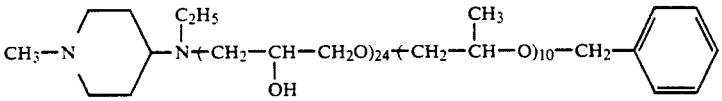
VI-II-34
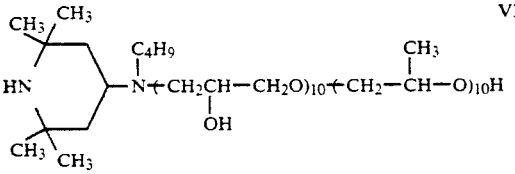
VI-II-35
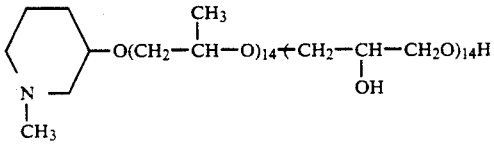
VI-II-36
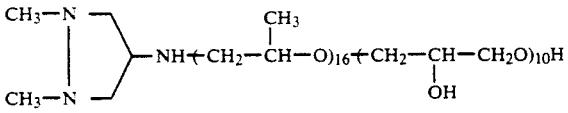
VI-II-37
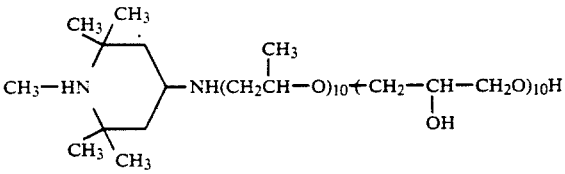
VI-II-38
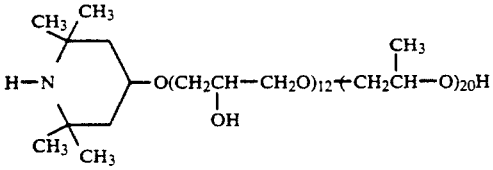
VI-II-39
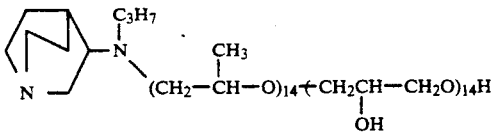
VI-II-40
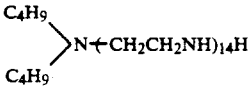
VI-II-41
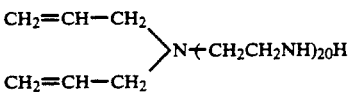
VI-II-42
$C_8H_{17}NH(CH_2CH_2NH)_{16}H$
VI-II-43
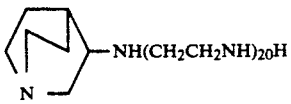
VI-II-44

-continued
VI-II-45
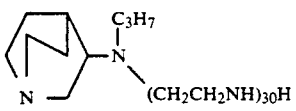
VI-II-46
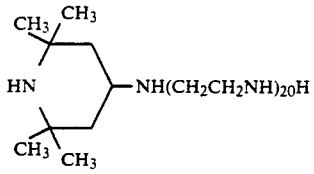
VI-II-47
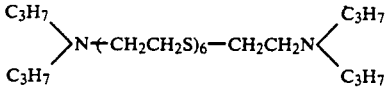
VI-II-48
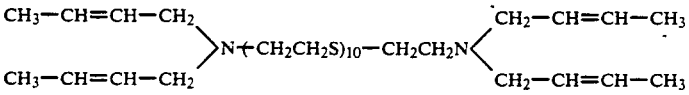
VI-II-49
$C_6H_{13}NH(CH_2CH_2S)_{12}-CH_2CH_2NHC_6H_{13}$
VI-II-50
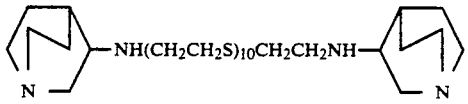
VI-II-51
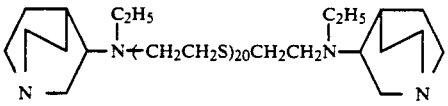
VI-II-52
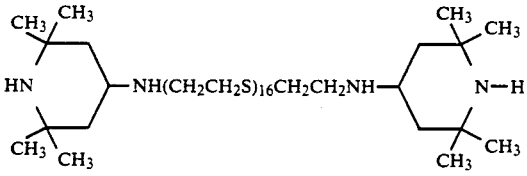
VI-II-53
$CH\equiv C-CH_2NH(CH_2CH_2S)_{20}-CH_2CH_2NHCH_2-C\equiv CH$
VI-II-54
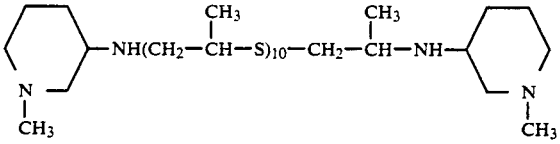
VI-II-55
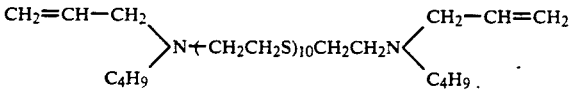
VI-II-56
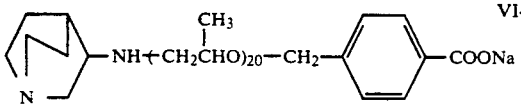
VI-II-57
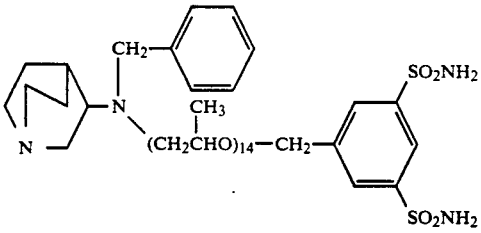
VI-II-58
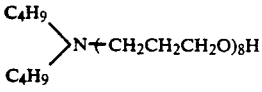
VI-II-59
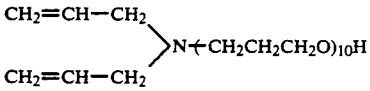
VI-II-60
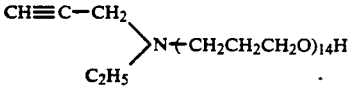
VI-II-61
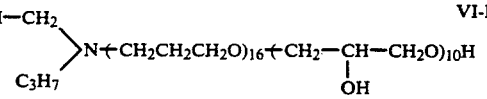
$C_5H_{11}NH(CH_2CH_2CH_2O)_{12}H$
VI-II-62
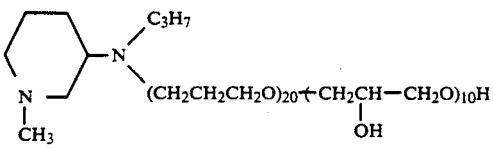
VI-II-63

-continued

VI-II-64

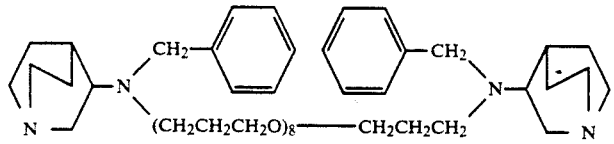

VI-II-65

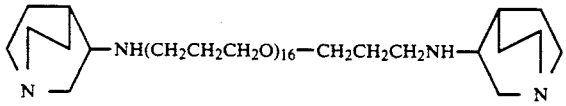

VI-II-66

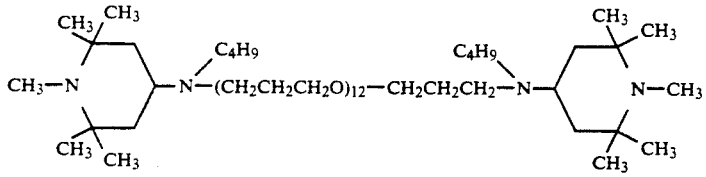

VI-II-67

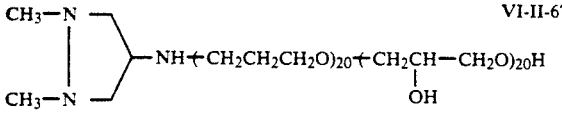

VI-II-68

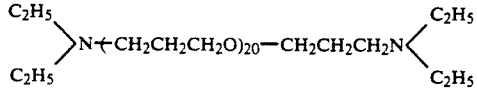

Formula VI-III

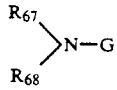

wherein $R_{67}$ and $R_{68}$ represent each a hydrogen atom or an alkyl, alkenyl, alkynyl, aryl or heterocyclic group; provided $R_{67}$ and $R_{68}$ may form a ring.

G contains at least one group represented by $\text{-}(CH_2CH_2O)_n\text{-}$ and at least two substituents each having a hydrophobic substituent constant $\pi$ within the range of $-0.5$ to $-1.0$ or at least one substituent having a $\pi$ value smaller than $-1.0$. n is an integer of not less than 2. Among the groups represented by $R_{67}$ or $R_{68}$, the alkyl, alkenyl, alkynyl, aryl and heterocyclic groups include, for example, the groups similar to those detailed in $R_{15}$, $R_{16}$ and $R_{17}$ denoted in formula I.

The ring formed by $R_{67}$ and $R_{68}$ includes, for example, the rings of piperidine, quinuclidine and morpholine.

The above-mentioned hydrophobic substituent constant $\pi$ is detailed in "The Structural Activity Correlation of Chemical Substances", 1979, pp. 79-103, Nanko-Do Publishing Co The substituents having a $\pi$ value within the range of $-0.5$ to $-1.0$ include, for example, the groups of —CN, —OH, $-OSO_2CH_3$, $-OCOCH_3$,

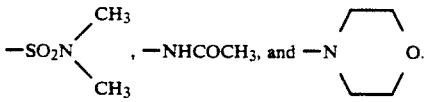

The substituents having a $\pi$ value smaller than $-1.0$ include, for example, the groups of $-CONH_2$, —CONHOH, $-CONHCH_3$, $-NH_2$, $-NHCONH_2$, $-NHCSNH_2$, $-NHSO_2CH_3$, $-N^{\oplus}(CH_3)_3$, $-O^{\ominus}$, $-OCONH_2$, $-SO_3^{\ominus}$, $-SO_2NH_2$, $-SCCH_3$, $-SO_2CH_3$, and $-COO^{\ominus}$.

The typical examples of the compounds represented by formula VI-III will be given below:

VI-III-1

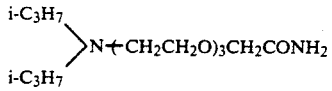

VI-III-2

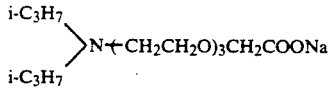

VI-III-3

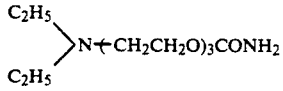

VI-III-4

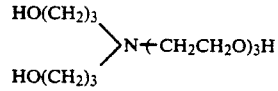

VI-III-5

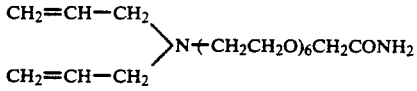

VI-III-6

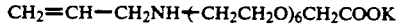

VI-III-7

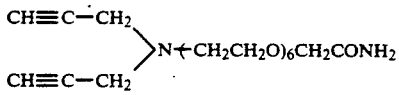

VI-III-8

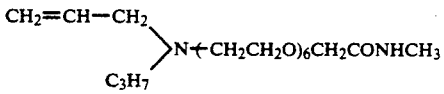

VI-III-9

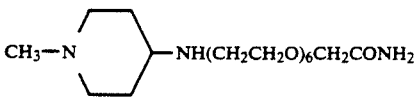

-continued
VI-III-10
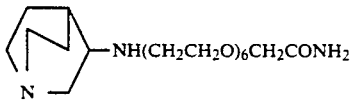
VI-III-11
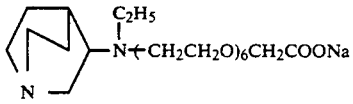
VI-III-12
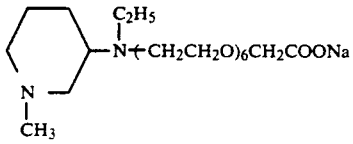
VI-III-13
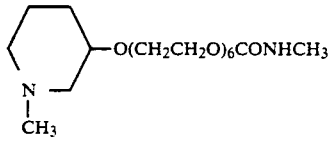
VI-III-14
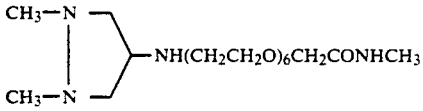
VI-III-15
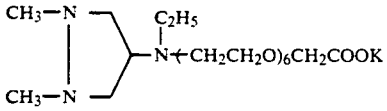
VI-III-16
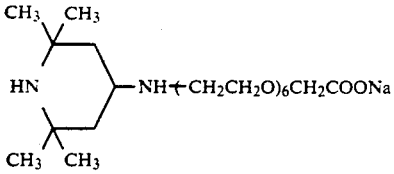
VI-III-17
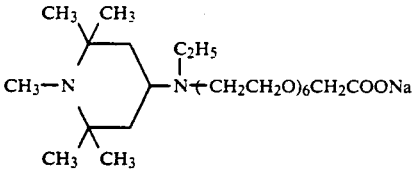
VI-III-18
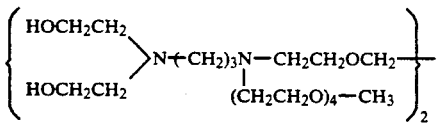
VI-III-19
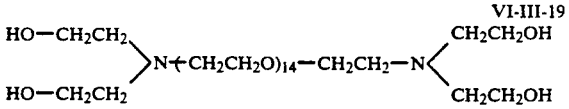
VI-III-20
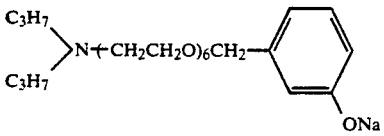
-continued
VI-III-21
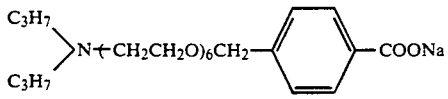
VI-III-22
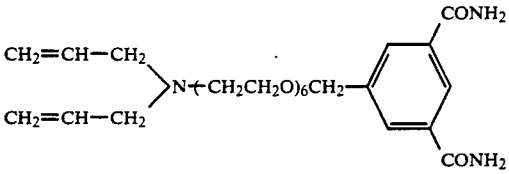
VI-III-23
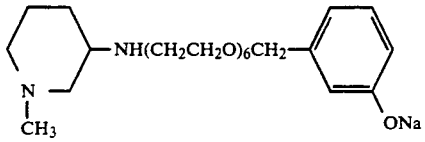
VI-III-24
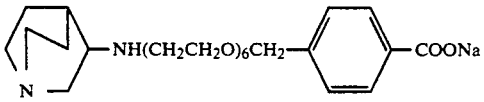
VI-III-25
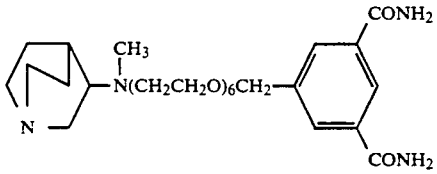
VI-III-26
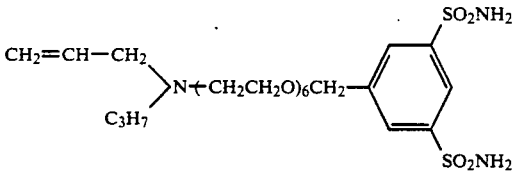
VI-III-27
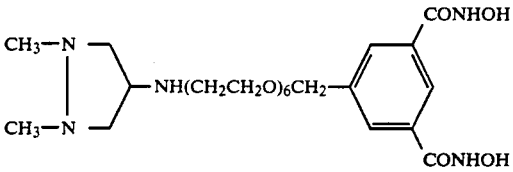
VI-III-28
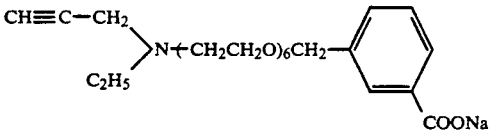
VI-III-29
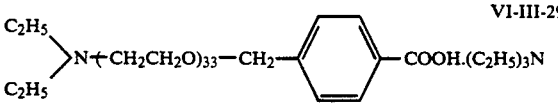
VI-III-30
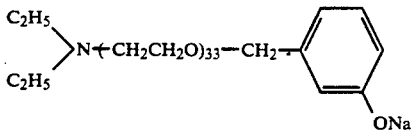

-continued

VI-III-31

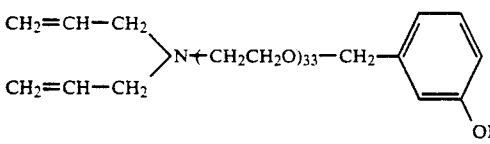

VI-III-32

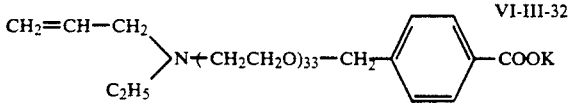

VI-III-33

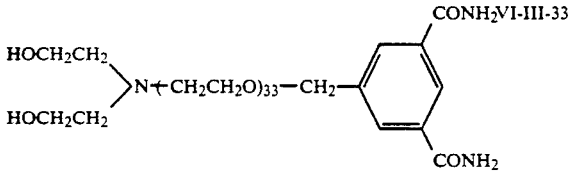

VI-III-34

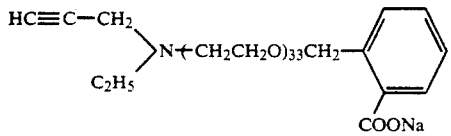

VI-III-35

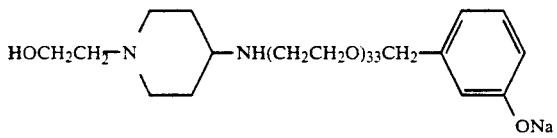

VI-III-36

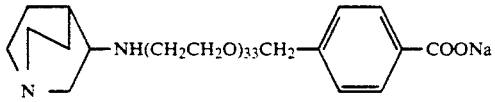

VI-III-37

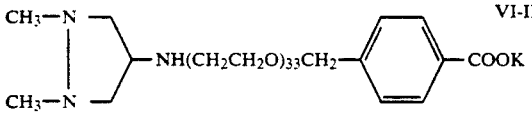

Into a silver halide photographic light sensitive material of the invention capable of obtaining a high contrast image, at least one kind of the hydrazine compounds represented by the afore-given formulas A, B and C and at least one kind of the compounds represented by the afore-given formulas I through VI are contained. The amounts of the compounds represented by A, B and C and formulas I through VI are each preferably in an amount within the range of $5\times10^{-7}$ mols to $5\times10^{-1}$ mols per mol of the silver halide contained in the photographic light sensitive material.

In particular, the above-specified range is preferably within the range of $5\times10^{-6}$ mols to $1\times10^{-2}$ mol per the silver halide content.

The silver halide photographic light sensitive materials of the invention have each at least one of silver halide emulsion layers. In other words, at least one of the silver halide emulsion layers may be arranged either onto one side of a support, or onto the both sides of the support. And, the silver halide emulsion may be coated on a support either directly or with the interposition of the other layer such as a hydrophilic colloidal layer not containing any silver halide emulsion. Further, a hydrophilic colloidal layer may be coated to serve as a protective layer on the silver halide emulsion layer. Still further, the silver halide emulsion layer may also be coated by separating them into two silver halide emulsion layers having each the different sensitive speeds such as a high-speed for one and a low-speed for the other. In this instance, an interlayer may also be arranged between the two silver halide emulsion layers. In other words, an interlayer comprising a hydrophilic colloid may be arranged therebetween, if required, and a non-light sensitive hydrophilic colloidal layer such as an interlayer, protective layer, antihalation layer or backing layer may also arranged between a silver halide emulsion layer and a protective layer.

In the invention, the layer surface on the side coated with an emulsion layer is required to have a pH of not lower than pH 5.9 and, preferably, within the range of pH 6.0 to 7.5.

For adjusting the pH value of the layer surface into the required range, an alkali or an acid is added to the emulsion layer or another layer coated on the emulsion side of the support. As the alkali agent, for example, sodium hydroxide, sodium carbonate, potassium carbonate, sodium hydrogen carbonate and potassium metaborate are preferably applicable. As the acid, an inorganic acid including sulfuric acid, hydrochloric acid and nitric acid, and an organic acid including acetic acid, citric acid, oxalic acid and malic acid. When an emulsion layer and a non-light-sensitive outermost layer such as a protective layer are provided on the emulsion side of the support, the alkali or acid is preferably added to the non-light-sensitive outermost layer, and is more preferably added to both of the emulsion layer and the outermost layer. Although the alkali or acid may be added to the emulsion at arbitrary step in the course of production of the emulsion, when the alkali or acid is added to the emulsion, it is preferable to add the alkali or acid at a time between completion of chemical ripening to coating of the emulsion. Another method for adjusting of the pH value is that of coating a solution containing the alkali or acid on a previously coated emulsion layer and the other layer.

In the invention, the pH of a layer means a value obtained in such a manner that a 1 $cm^2$ photographic light sensitive material is added thereon with 0.05 ml of water and is allowed to stand under the atmospheric conditions of not lower than 90% RH for 10 minutes; after then, the pH is measured by means of a flat type glass electrode. The typical examples of the flat type electrodes include, for example, the flat type electrode, Model GST-5313F manufactured by Toa Dempa Kogyo Co., Ltd.

The compounds represented by formulas A, B, C and I through VI are each contained in a silver halide emulsion layer or a hydrophilic colloidal layer adjacent to the silver halide emulsion layer of a silver halide photographic light sensitive material of the invention.

Next, the silver halides applicable to the silver halide photographic light sensitive materials of the invention will be detailed below. Such silver halides include, for example, silver chloroiodobromide or silver iodobromide having a silver iodide content of not more than 4 mol % and, preferably, those having a silver iodide content of 3 mol %. The average grain size of the silver halides preferably applicable is within the range of 0.05 to 0.5 μm and, inter alia, within the range of 0.10 to 0.40 μm.

The distribution of the grain sizes of the silver halide grains applicable to the invention may be arbitrarily selected. However, the value of the monodispersion degrees which will be defined below is so adjusted as to be within the range of, preferably, 1 to 30 and, particularly, 5 to 20.

The term, a "monodispersion degree", is defined as a value obtained by centupling the value obtained by dividing the standard deviation of grain sizes by an average grain size. As a matter of convenience, in the case of a cubic crystal grain, the grain sizes of silver halide grains are represented by the length of the edge thereof and, in the case of the other grains such as those in the forms of octahedron and tetradecahedron, the grain sizes are calculated out by the square root of a projective area.

When embodying the invention, it is allowed to use silver halide grains including, for example, those of the type having a multilayered structure of at least two-layered structure, and the silver halide grains applicable thereto are comprised of, for example, silver iodobromide grains having each the cores comprising silver iodobromide and the shells comprising silver bromide. In this instance, iodine may be contained in a proportion of not more than 5 mol % in any one of the layers.

Silver halide grains applicable to the silver halide emulsions of the invention can be added with a metal ion by making use of at least one kind of salts selected from the group consisting of cadmium salts, zinc salts, lead salts, thallium salts, iridium salts -including the complex salts thereof-, rhodium salts -including the complex salts thereof-, and iron salts -including the complex salts thereof-, in the courses of forming and/or growing the grains. The grains are also allowed to contain the above-given elements in the inside and/or on the surface of each grain. The grains are further allowed to be provided each with a reduction-sensitization nucleus to the inside and/or on the surface of each grain when the grains are suitably put in a reducibile atmosphere.

Still further, the silver halide can be sensitized by making use of a variety of chemical sensitizers. Such sensitizers include, for example: an active gelatin; a sulfur sensitizer such as sodium thiosulfate, allyl thiocarbamide, thiourea, and allyl isothiocyanate; a selenium sensitizer such as N,N-dimethyl selenourea, and selenourea; a reduction sensitizer such as triethylene tetramine, and stannous chloride; and a variety of noble-metal sensitizers including, typically, potassium chloroaurite, potassium aurithiocyanate, potassium chloroaurate, 2-aurosulfobenzothiazole methylchloride, ammonium chloropalladate, potassium chloroplatinate, and sodium chloropalladite. The above-given sensitizers may be used independently or in combination.

When making use of a gold sensitizer, ammonium thiocyanate may also be used together as an assistant.

When the silver halide grains of the invention are treated with the above-given chemical sensitizers, the characteristics of the grains can be improved, because the grains may preferably be used as the so-called 'negative image-providing silver halide grains' comprising the grains having a higher sensitive speed on the surface thereof than in the inside thereof.

The silver halide emulsions applicable to the invention can be stabilized or inhibited from fogging, when making use of a mercapto-compounds such as 1-phenyl-5-mercaptotetrazole, and 2-mercaptobenzothiazole, benzotriazoles such as 5-bromobenzotriazole, and 5-methylbenzotriazole, benzimidalzoles such as 6-nitrobenzimidazole, or indazoles such as 5-nitroindazole.

For the purposes of increasing sensitive speeds and contrasts or accelerating developments, a light-sensitive silver halide emulsion layer or the layers adjacent thereto may be added therein with the compounds given in Research Disclosure, 17463, Items XXI-B to XXI-D.

The silver halide emulsions applicable to the invention are also allowed to contain a sensitizing dye, a plasticizer, an antistatic agent, a surfactant, or a layer hardener.

In the cases where the compounds represented by the formulas relating to the invention are added in hydrophilic colloidal layers, gelatin is suitably used as the binder for the hydrophilic colloidal layers. However, hydrophilic colloids other than gelatin may also be used. The hydrophilic binders are preferably coated over both surfaces of a support in an amount of not more than 10 g/m$^2$ on each of the support surfaces.

The supports applicable to embody the invention include, for example: a baryta paper; a polyethylene-laminated paper; a synthetic polypropylene paper; a glass plate; a cellulose acetate film, a cellulose nitrate film, and a polyester film such as polyethylene terephthalate film. The above-given supports may suitably be selected so as to meet the application of each silver halide photographic light sensitive material.

For the development process of the silver halide photographic light sensitive materials of the invention, the following developing agents, for example, are to be used.

HO—(CH=CH)n—OH type developing agents which include, typically, hydroquinone and, besides, catechol and pyrogallol.

The HO—(CH=CH)n—OH type developing agents include, typically, an ortho- and para-aminophenol or aminopyrazolone and, further, N-methyl-p-aminophenol, N-$\beta$-hydroxyethyl-p-aminophenol, p-hydroxyphenyl aminoacetic acid, and 2-aminonaphthol.

The heterocyclic type developing agents include, for example, 3-pyrazolidones such as 1-phenyl-3-pyrazolidone, 1-phenyl- 4,4-dimethyl-3-pyrazolidone, 1-phenyl-4-methyl-4-hydroxymethyl-3-pyrazolidone and 1-phenyl-4-methyl-4-hydroxymethyl-3-pyrazolidone.

Besides the above, the developing agents such as those detailed in T. H. James, 'The Theory of the Photographic Process', 4th Ed., pp. 291–334, and 'Journal of the American Chemical Society', Vol. 73, p. 3,100, 1951, may also effectively be utilized in the invention.

The above-given developing agents may be used independently or in combination and it is preferable to use them in combination.

The developers applicable to the development of the light sensitive materials of the invention do not spoil the effects of the invention even if making use of a sulfite such as sodium sulfite or potassium sulfite as a preservative. As for the preservatives, a hydroxylamine or hydrazide compound may be used.

The developers can also be provided with a pH adjusting function and a buffering function by making use of caustic alkali, carbonic alkali or amine which may be used in common black-and-white developers.

The developers applicable to the invention may have a pH lower than 11. The above-mentioned developers are also allowed to contain, if required, the following additives: an inorganic development inhibitor such as potassium bromide; an organic development inhibitor such as 5-methyl benzotriazol, 5-methyl benzimidazole, adenine, guanine, and 1-phenyl-5-mercaptotetrazole; a metal ion scavenger such as ethylenediamine tetraacetic acid; a development accelerator such as methanol, ethanol, benzyl alcohol, and polyalkylene oxide; a surfactant such as sodium alkylaryl sulfonic acid, natural saponin, sugar, and the alkyl esters of the above-given compounds; a hardener such as glutaric aldehyde, formalin, and glyoxal; and an ion strength controller such as sodium sulfate.

The developers applicable to the invention are allowed to contain an organic solvent including, for example: alkanol amines such as diethanol amine or triethanol amine; and glycols such as diethylene glycol or triethylene glycol. It is particularly preferable to use an alkylamino alcohol such as diethylamino-1,2-propane diol and butylaminopropanol.

EXAMPLE 1

Preparation of Silver Halide Photographic Emulsion A

A silver iodobromide emulsion having a silver iodide content of 2 mol % per mol of silver used was prepared in a double-jet precipitation method. In the course of performing the double-jet precipitation method, $K_2IrCl_6$ was added in an amount of $8\times10^{-7}$ mols per mol of silver used. The resulting emulsion was the emulsion comprising the cubic-shaped monodisperse type grains having the average grain size of 0.24 μm and the monodispersion degree of 9.

The resulting emulsion was added therein with an aqueous 1% potassium iodide solution in an amount of 6.5 cc per mol of silver used, and was desalted in an ordinary manner. The resulting pAg obtained after completing the desalting treatment was 8.0 at 40° C.

In the course of carrying out the redispersion, the following 3 kinds of compounds were added as the bacteriostats.

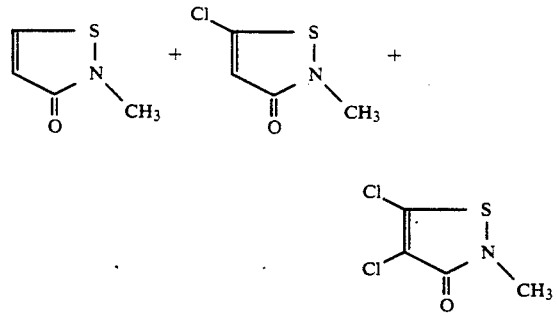

Preparation of a silver halide photographic light sensitive material

A 100 μm-thick polyethylene terephthalate film was provided on both sides thereof each with a 0.1 μm-thick undercoated layer; onto one of the undercoated layers, a silver halide emulsion layer having the following composition 1 was so coated as to be in a gelatin content of 2.0 g/m² and in a silver content of 3 2 g/m². And, onto the undercoated layer of the opposite side, a backing layer having the following composition 3 was so coated as to be in a gelatin content of 2.4 g/m². Further on the backing layer, a backing protective layer having the following composition 4 was so coated as to be in a gelatin content of 1 g/m², so that Sample Nos. 1-1 through 1-18 could be obtained.

Composition 1- The composition of a silver halide emulsion layer-
2.0 g/m²

Gelatin
Silver halide emulsion A- in a silver content-
3.2 g/m²

Sensitizing dyes:

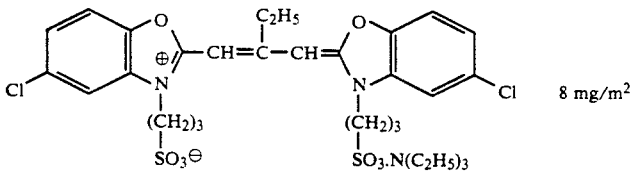

D-1 8 mg/m²

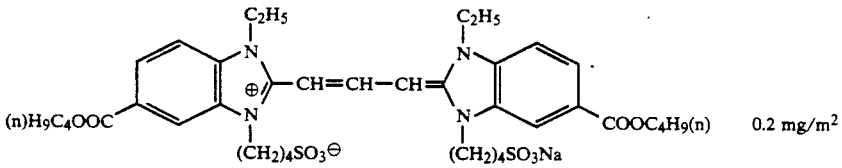

D-2 0.2 mg/m²

Stabilizer, 4-methyl-6-hydroxy-1, 3, 3a, 7-tetrazaindene
30 mg/m²

Antifoggant, adenine
10 mg/m²

Surfactants, saponin
0.1 g/m³

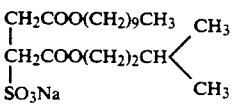

S-1 8 mg/m²

-continued

A compound of formula A, B, or C
The amount indicated in Table 1

A compound of formula I-V or VI
The amount indicated in Table 1

A latex polymer, $$\left(CH_2-\underset{\underset{COOC_4H_9}{|}}{CH}\right)_m \left(CH_3-\underset{\underset{OCOCH_3}{|}}{CH}\right)_n \quad m:n = 50:50$$

1 g/m$^2$

Polyethylene glycol having a molecular weight of 4000
0.1 g/m$^2$

Hardener H-1

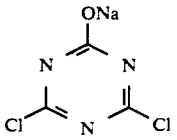

pH controller for layer surfaces,

Sodium carbonate
The amount necessary for adjusting pH to the value in Table 1.

Compositions 2- The composition of a emulsion protective layer-
Gelatin 0.9 g/m$^2$ Surfactants.

$$\begin{array}{l} CH_2COOCH_2(C_2H_5)C_4H_9 \\ | \\ CHCOOCH_2CH(C_2H_5)C_4H_9 \\ | \\ SO_3Na \end{array} \quad 10\ mg/m^2$$ S-2

$$NaO_3S-\underset{\underset{CH_2COOCH_2(CF_2)_6H}{|}}{CHCOOCH_2(CF_2)_6H} \quad 10\ mg/m^2$$ S-3

Matting agent, Silica having an average particle size of 3.5 μm
3 mg/m$^2$

Hardener, formalin
30 mg/m$^2$ pH controller for layer surfaces,
Sodium carbonate
The amount necessary for adjusting pH to the value in Table 1.

Composition 3- the composition of backing layer-

Backing dye (a)

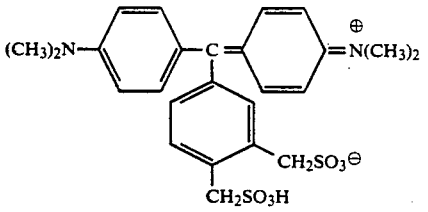

30 mg/m$^2$

Backing dye (b)

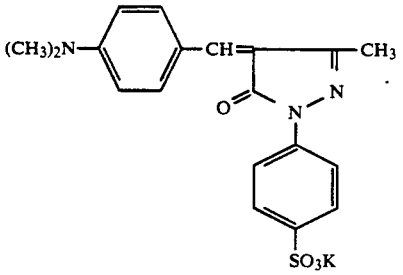

75 mg/m$^2$

-continued

Backing dye (c)

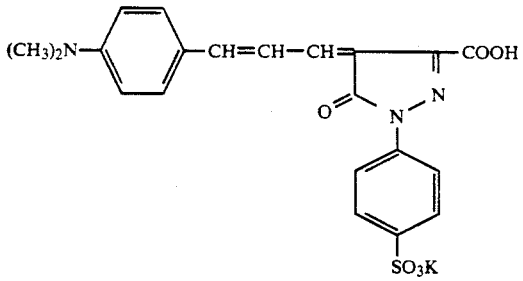

30 mg/m²

Gelatin
2.4 g/m²

Surfactants, Saponin
0.1 g/m²

S-1
6 mg/m²

Composition 4- Composition of backing protective layer
Gelatin 1 g/m²

Matting agent, polymethyl methacrylate having an average particle size within the range of 3.0 to 5.0 μm
15 mg/m²

Surfactant, S-2
10 mg/m²

Layer hardeners, Glyoxal
25 mg/m²

H-1
35 mg/m²

The resulting samples were each brought into contact with an optical step wedge and were then exposed for 5 seconds to tungsten light having 3200K. The exposed samples were processed under the following conditions by making use of a rapid processing automatic processor into which the developer and fixer each having the compositions indicated in the following Table 1. Developers 1 and 2 were MQ and PQ type respectively. The pH values of the layer surfaces of the samples were measured in the manner detailed herein.

| | Developer 1 | Developer 2 |
|---|---|---|
| Compositions of the developers | | |
| Sodium ethylenediaminetetraacetate | 1 g | 1 g |
| Sodium sulfite | 60 g | 60 g |
| Trisodium phosphate, dodeca hydrate | 75 g | — |
| Boric acid | — | 40 g |
| Hydroquinone | 22.5 g | 35 g |
| Sodium hydroxide | 8 g | 8 g |
| Sodium bromide | 3 g | 3 g |
| 5-methylbenzotriazole | 0.25 g | 0.2 g |
| 1-phenyl-5-mercaptotetrazole | 0.08 g | 0.08 g |
| 1-phenyl-4,4-dimethyl-3-pyrazoline | — | 0.2 g |
| Metol | 0.25 g | — |
| Phenethyl picolinium bromide | — | 2.5 g |
| Add water to make | 1 liter | 1 liter |
| Adjust pH with sodium hydroxide to be | pH 10.4 | pH 10.6 |
| Composition of the fixer | | |
| Composition A | | |
| Ammonium thiosulfate, in an aqueous 72.5% w/v solution | 240 ml | |
| Sodium sulfite | 17 g | |
| Sodium acetate, trihydrate | 6.5 g | |
| Boric acid | 6.0 g | |
| Sodium citrate, dihydrate | 2.0 g | |
| Composition B | | |
| Pure water, ion-exchange water | 17 ml | |
| Sulfuric acid, in an aqueous 50% W/V solution | 4.7 g | |
| Aluminium sulfate, in an aqueous solution having an equivalent $Al_2O_3$ content of 8.1% W/V | 26.5 g | |

Before the fixer is to be used, the above-given compositions A and B were dissolved in this order in 500 ml of water and the total amount was made to be 1 liter. The pH of the fixer was adjusted to be 4.8 with acetic acid.

| Processing step | Processing conditions: Temperature | Time |
|---|---|---|
| Developing | 40° C. | 15 sec. |
| Fixing | 35° C. | 15 sec. |
| Washing | 30° c. | 10 sec. |
| Drying | 50° C. | 10 sec. |

In place of the hydrazine derivative relating to the invention which was added into the silver halide emulsion layer having the afore-given composition 1, the following compound a was added for the comparison.

Compound a

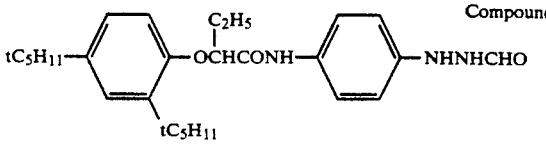

The processed samples were measured with a Konica digital densitometer, PDA-65. The sensitive speeds of the samples were indicated by the relative speeds to that of Sample 1 having a density of 3.0, and the gamma values of the samples were indicated by the tangent of a density of 0.3 with a density of 3.0. When a sample had a gamma value of lower than 6, it could not stand use and, when a gamma was within the range of not lower than 6 to lower than 10, the sample still could not display a satisfactory high contrast. When a gamma value was not lower than 10, an extremely high contrast image could be obtained good enough to put the image to practical use.

The halftone dot qualities of the samples and the pepper spots produced in the halftone dots were each evaluated as follows.

Evaluation of halftone dot qualities and pepper spots

A subject sample was brought into close contact with a step wedge partly attached with a 150 lines/inch contact screen having a halftone dot area of 50% and was then exposed to Xenon light source for 5 seconds. The exposed sample was developed under the following conditions through a rapid processing automatic processor in which the following developer and fixer were used. The quality of the resulting halftone dot of the sample was observed through a magnifier. The evaluation results of the halftone dot qualities were so ranked as to be '5' for the highest, '4', '3', '2', '1', for the lowest in this order, respectively. In the ranks, '1' and '2' were in the levels not suitable for any practical use.

The production of pepper spots in halftone dot areas were observed and were then so ranked as to be '5' for none of pepper spot produced, '4', '3', '2', and '1' for the most numerous production in this order, respectively. In the ranks, '1' and '2' were in the levels not suitable for any practical use.

The results obtained from the above-mentioned evaluation are shown in the following Table-1.

TABLE 1

| | Compound of formula A, B or C | | Compound of formula I~V or VI | | Layer | Devel- | Characteristics | | Characteristics | |
|---|---|---|---|---|---|---|---|---|---|---|
| No. | Structure | Amount added (mol/mol Ag) | Structure | Amount added (mol/mol Ag) | surface, pH | oper, No. | Relative speed | Gamma | Halftone dot quality | Pepper spot |
| 1-1 | (a) | $2 \times 10^{-3}$ | — | — | 5.6 | 1 | 100 | 3.5 | 1.0 | 3.5 |
| 1-2 | (a) | $2 \times 10^{-3}$ | III-11 | $1.5 \times 10^{-3}$ | 5.6 | 1 | 120 | 5.0 | 2.0 | 3.0 |
| 1-3 | (a) | $2 \times 10^{-3}$ | III-11 | $1.5 \times 10^{-3}$ | 6.4 | 1 | 125 | 5.5 | 2.5 | 2.5 |
| 1-4 | (61) | $2 \times 10^{-3}$ | — | — | 5.6 | 1 | 130 | 6.0 | 2.0 | 3.0 |
| 1-5 | (61) | $2 \times 10^{-3}$ | III-11 | $1.5 \times 10^{-3}$ | 5.6 | 1 | 180 | 8.0 | 2.5 | 3.5 |
| 1-6 | (61) | $2 \times 10^{-3}$ | III-11 | $1.5 \times 10^{-3}$ | 6.4 | 1 | 205 | 11.0 | 4.0 | 3.5 |
| 1-7 | (61) | $2 \times 10^{-3}$ | I-15 | $1.5 \times 10^{-3}$ | 6.4 | 2 | 210 | 11.0 | 4.0 | 3.5 |
| 1-8 | (61) | $2 \times 10^{-3}$ | II-14 | $1.5 \times 10^{-3}$ | 6.4 | 1 | 205 | 11.0 | 4.0 | 3.5 |
| 1-9 | (62) | $2 \times 10^{-3}$ | V-I-1 | $1.5 \times 10^{-3}$ | 6.4 | 1 | 210 | 11.0 | 4.5 | 4.5 |
| 1-10 | (64) | $2 \times 10^{-3}$ | V-II-4 | $1.5 \times 10^{-3}$ | 6.4 | 2 | 210 | 11.0 | 4.5 | 4.5 |
| 1-11 | (64) | $2 \times 10^{-3}$ | VI-III-10 | $1.5 \times 10^{-3}$ | 6.2 | 1 | 205 | 11.0 | 4.0 | 3.5 |
| 1-12 | (64) | $2 \times 10^{-3}$ | III-10 | $1.5 \times 10^{-3}$ | 6.4 | 2 | 210 | 11.0 | 4.0 | 4.0 |
| 1-13 | (68) | $2 \times 10^{-3}$ | I-10 | $1.5 \times 10^{-3}$ | 6.4 | 1 | 210 | 11.0 | 4.0 | 3.5 |
| 1-14 | (68) | $2 \times 10^{-3}$ | V-I-19 | $1.5 \times 10^{-3}$ | 6.4 | 2 | 210 | 11.0 | 4.5 | 4.5 |
| 1-15 | (120) | $2 \times 10^{-3}$ | II-6 | $1.5 \times 10^{-3}$ | 6.4 | 1 | 215 | 11.0 | 4.0 | 4.0 |
| 1-16 | (120) | $2 \times 10^{-3}$ | VI-II-34 | $1.5 \times 10^{-3}$ | 6.4 | 2 | 210 | 11.0 | 5.0 | 5.0 |
| 1-17 | (132) | $2 \times 10^{-3}$ | IV-13 | $1.5 \times 10^{-3}$ | 6.4 | 1 | 210 | 11.0 | 4.0 | 4.0 |
| 1-18 | (132) | $2 \times 10^{-3}$ | V-III-21 | $1.5 \times 10^{-3}$ | 6.4 | 2 | 210 | 11.0 | 4.0 | 3.5 |

As is obvious from the contents of Table-1, when the samples were processed with a developer having a pH of lower than 11, it could be proved that the samples No. 1-6 through 1-18 each relating to the invention were hard in contrast and excellent in sensitive speed, halftone dot quality and pepper spot prevention, as compared to the comparative samples.

EXAMPLE 2

Samples No. 2-1 through No. 2-18 were each prepared in the same manner as in Example 1 so as to have the emulsion layer, emulsion protective layer, backing layer and backing protective layer having the following compositions, respectively.

Composition of the emulsion layer. The same composition as in Example 1, except that sensitizing dye D-2 was not contained, and the hydrazine derivatives of the invention or the comparative compounds indicated in Table-2 were contained therein.

Emulsion protective layer: The same composition as in Example 1, except that the matting agent content was 5 mg/m$^2$.

Backing layer: The same composition as in Example 1.

Backing protective layer: The same composition as in Example 1, except that the matting agent content was 50 mg/m$^2$.

The resulting samples were evaluated in the same manner as in Example 1. The results thereof were obtained as shown in Table-2.

TABLE 2

| | Compound of formula A, B or C | | Compound of formula I-V or VI | | Layer | Devel- | Characteristics | | Characteristics | |
|---|---|---|---|---|---|---|---|---|---|---|
| No. | Structure | Amount added (mol/mol Ag) | Structure | Amount added (mol/mol Ag) | surface, pH | oper, No. | Relative speed | Gamma | Halftone dot quality | Pepper spot |
| 2-1 | (a) | $2 \times 10^{-3}$ | — | — | 5.6 | 1 | 100 | 3.5 | 1.0 | 3.5 |
| 2-2 | (a) | $2 \times 10^{-3}$ | III-11 | $1.5 \times 10^{-3}$ | 5.6 | 1 | 120 | 5.0 | 2.0 | 3.0 |
| 2-3 | (a) | $2 \times 10^{-3}$ | III-11 | $1.5 \times 10^{-3}$ | 6.4 | 1 | 125 | 5.5 | 2.5 | 2.5 |
| 2-4 | (a) | $2 \times 10^{-3}$ | II-6 | $1.5 \times 10^{-3}$ | 5.6 | 2 | 125 | 5.5 | 2.5 | 2.5 |
| 2-5 | (178) | $2 \times 10^{-3}$ | — | $1.5 \times 10^{-3}$ | 5.6 | 1 | 130 | 6.0 | 2.0 | 4.0 |
| 2-6 | (178) | $2 \times 10^{-3}$ | III-11 | $1.5 \times 10^{-3}$ | 5.6 | 1 | 150 | 7.5 | 2.5 | 4.0 |
| 2-7 | (178) | $2 \times 10^{-3}$ | III-11 | $1.5 \times 10^{-3}$ | 6.4 | 1 | 195 | 9.0 | 3.5 | 4.0 |
| 2-8 | (178) | $2 \times 10^{-3}$ | I-15 | $1.5 \times 10^{-3}$ | 6.2 | 2 | 195 | 9.0 | 3.5 | 4.0 |

TABLE 2-continued

| No. | Compound of formula A, B or C: Structure | Compound of formula A, B or C: Amount added (mol/mol Ag) | Compound of formula I-V or VI: Structure | Compound of formula I-V or VI: Amount added (mol/mol Ag) | Layer surface, pH | Developer, No. | Characteristics: Relative speed | Characteristics: Gamma | Characteristics: Halftone dot quality | Characteristics: Pepper spot |
|---|---|---|---|---|---|---|---|---|---|---|
| 2-9 | (178) | $2 \times 10^{-3}$ | II-6 | $1.5 \times 10^{-3}$ | 6.4 | 1 | 195 | 9.0 | 3.5 | 4.0 |
| 2-10 | (178) | $2 \times 10^{-3}$ | V-I-1 | $1.5 \times 10^{-3}$ | 6.4 | 2 | 210 | 11.0 | 5.0 | 4.5 |
| 2-11 | (198) | $2 \times 10^{-3}$ | VI-II-8 | $1.5 \times 10^{-3}$ | 6.4 | 1 | 210 | 11.0 | 4.5 | 5.0 |
| 2-12 | (198) | $2 \times 10^{-3}$ | IV-15 | $1.5 \times 10^{-3}$ | 6.4 | 2 | 190 | 9.5 | 5.0 | 4.5 |
| 2-13 | (198) | $2 \times 10^{-3}$ | V-II-3 | $1.5 \times 10^{-3}$ | 6.4 | 1 | 210 | 10.5 | 4.5 | 5.0 |
| 2-14 | (215) | $2 \times 10^{-3}$ | I-10 | $1.5 \times 10^{-3}$ | 6.4 | 1 | 195 | 9.0 | 4.0 | 4.0 |
| 2-15 | (215) | $2 \times 10^{-3}$ | II-14 | $1.5 \times 10^{-3}$ | 6.4 | 2 | 195 | 9.0 | 4.0 | 4.0 |
| 2-16 | (215) | $2 \times 10^{-3}$ | V-III-21 | $1.5 \times 10^{-3}$ | 6.4 | 2 | 195 | 9.5 | 5.0 | 4.5 |
| 2-17 | (245) | $2 \times 10^{-3}$ | IV-5 | $1.5 \times 10^{-3}$ | 6.4 | 1 | 195 | 9.5 | 4.5 | 5.0 |
| 2-18 | (245) | $2 \times 10^{-3}$ | V-II-65 | $1.5 \times 10^{-3}$ | 6.4 | 1 | 210 | 11.0 | 4.5 | 5.0 |

As is obvious from Table-2, Samples No. 2-7 through No. 2-18 each relating to the invention were proved to be excellent in sensitive speed, gamma, halftone dot quality and black spot prevention, as compared to the other samples.

What is claimed is:

1. A high-contrast silver halide photographic light-sensitive material, comprising a support and at least one silver halide photographic emulsion layer on one side of said support, said silver halide photographic emulsion layer containing:

(i) a hydrazine derivative of the Formula (A), (B) or (C):

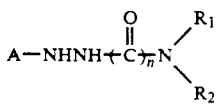

(A)

wherein A is an aryl group or a saturated or unsaturated heterocyclic group having a sulfur atom or an oxygen atom; n is 1 or 2; $R_1$ and $R_2$ each independently is a hydrogen atom, an alkyl group, an alkenyl group, an alkynyl group, an aryl group, a saturated or unsaturated heterocyclic group, a hydroxy group, an alkoxy group, an alkenyloxy group, an alkynyloxy group, an aryloxy group or a heterocyclic-oxy group, provided that when n is 1, $R_1$ and $R_2$ may be bonded together to form a ring, and when n is 2, at least one of $R_1$ and $R_2$ is an alkenyl group, an alkynyl group, a saturated heterocyclic group, a hydroxy group, an alkoxy group, an alkenyloxy group, an aryloxy group or a heterocyclic-oxy group;

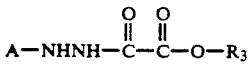

(B)

wherein A is as defined above; and $R_3$ is an alkynyl group or a saturated heterocyclic group;

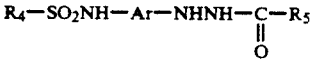

(C)

wherein $R_4$ is an alkyl group, an aryl group or a saturated or unsaturated heterocyclic group; $R_5$ is a hydrogen atom or a blocking group selected from an alkyl group, an aryl group, a heterocyclic group, a group of the formula

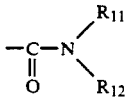

wherein $R_{11}$ and $R_{12}$ each independently is a hydrogen atom, an alkyl group, an alkenyl group, an alkynyl group, an aryl group, a heterocyclic group or an amino group, and $R_{11}$ and $R_{12}$ may form a ring together with the nitrogen atom, and a group of the formula —C—O—$R_{13}$ wherein $R_{13}$ is a hydrogen atom, an alkyl group, an alkenyl group, an alkynyl group or an aryl group; and Ar is an arylene group or a saturated or unsaturated heterocyclic group; and (ii) a compound selected from amine compounds and quaternary onium salts of the Formula (I), (II), (III), (IV), (V-I), (V-II), (V-III), (VI-I), (VI-II), and (VI-III):

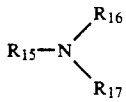

(I)

wherein $R_{15}R_{16}$ and $R_{17}$ each independently is a hydrogen atom or a substituent selected from alkyl, alkenyl, alkynyl, aryl, and saturated and unsaturated heterocyclic groups, provided that $R_{15}$, $R_{16}$ and $R_{17}$ are not all hydrogen atoms and two or three of $R_{15}$, $R_{16}$ and $R_{17}$ may be bonded together to form a ring;

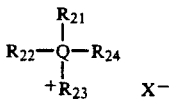

(II)

wherein Q is a nitrogen atom or a phosphorus atom; $R_{21}$, $R_{22}$, $R_{23}$ and $R_{24}$ each independently is a hydrogen atom or a substituent selected from alkyl, alkenyl, alkynyl, aryl, saturated and unsaturated heterocyclic, and amino groups, provided that $R_{21}$, $R_{22}$, $R_{23}$ and $R_{24}$ are not all hydrogen atoms and two or three of $R_{21}$, $R_{22}$, $R_{23}$ and $R_{24}$ may be bonded together to form a ring; and $X^-$ is an anion;

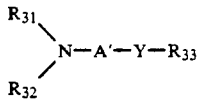

(III)

wherein $R_{31}$ and $R_{32}$ each independently is an alkyl group and may be bonded together to form a ring; $R_{33}$ is an alkyl group, an aryl group, or a saturated or unsaturated heterocyclic group; A' is an alkylene group; Y is a $—CONR_{34}—$, $—OCONR_{34}—$, $—NR_{34}CONR_{34}—$, $—NR_{34}COO—$, —COO—, —OCO—, —CO—, —OCOO—, $—NR_{34}CO_{13}$, $—SO_2NR_{34}—$, $—NR_{34}SO_2—$, $NR_{34}SO_2NR_{34}—$, $—SO_2—$, —S—, —O—, $—NR_{34}—$ or —N= group, wherein $R_{34}$ is a hydrogen atom or an alkyl group;

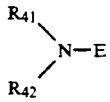

(IV)

wherein $R_{41}$ and $R_{42}$ each independently is a hydrogen atom, an alkyl group, an alkenyl group, an alkynyl group, an aryl group or a heterocyclic group, and may be bonded together to form a ring; and E is a group containing a $—(—CH_2CH_2O)_n$ group, wherein n is an integer of 2 or more:

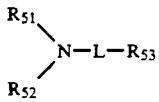

(V-I)

wherein $R_{51}$, $R_{52}$ and $R_{53}$ each independently is an alkyl group, an alkenyl group, an alkynyl group, an aryl group or a saturated or unsaturated heterocyclic group, provided that at least one of $R_{51}$, $R_{52}$ and $R_{53}$ is an alkenyl group or an alkynyl group or at least one of $R_{51}$ and $R_{52}$ is an aryl group or a saturated or unsaturated heterocyclic group, and $R_{51}$, $R_{52}$ and $R_{53}$ may be bonded together to form a ring; and L is a linking group selected from groups of the formula A'—Y as defined in Formula (III) above;

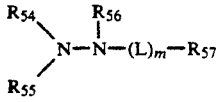

(V-II)

wherein $R_{54}$, $R_{55}$ and $R_{57}$ each independently is an alkyl group, an alkenyl group, an alkynyl group, an aryl group or a saturated or unsaturated heterocyclic group, and $R_{54}$ and $R_{55}$ may be bonded together to form a ring; $R_{56}$ is a hydrogen atom or a substituent selected from alkyl, alkenyl, alkynyl, aryl and heterocyclic groups; and L is a linking group selected from —CO—, —COO—, $—CONR_{58}$, $—SO_2—$ and $—SO_2NR_{58}—$ groups, wherein $R_{58}$ is a hydrogen atom or a substituent selected from alkyl, alkenyl, alkynyl, aryl and heterocyclic groups; and m is 0 or 1;

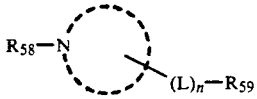

(V-III)

wherein $R_{58}$ is a hydrogen atom or a substituent selected from alkyl, alkenyl, alkynyl, aryl and heterocyclic groups; $R_{59}$ is an alkyl group, an alkenyl group, an alkynyl group, an aryl group or a heterocyclic group; L is a linking group selected from groups of the formula Y as defined in Formula (III) above;

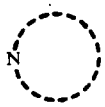

is a nitrogen-containing heterocyclic group and may form a ring together with $R_{58}$; and n is 0 or 1;

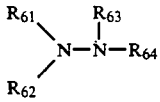

(VI-I)

wherein $R_{61}$ and $R_{62}$ each independently is an alkyl group, an alkenyl group, an alkynyl group, an aryl group or a heterocyclic group; $R_{63}$ is a hydrogen atom or a substituent selected from alkyl, alkenyl, alkynyl, aryl, saturated and unsaturated heterocyclic, acyl, sulfonyl, oxycarbonyl and carbamoyl groups; $R_{64}$ is a group containing

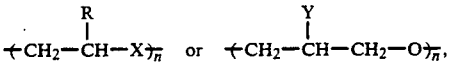

where R is a hydrogen atom or an alkyl group, X is an oxygen atom, a sulfur atom or an NH group, Y is a hydrogen atom or a hydroxy group, and n is an integer of 2 or more; and $R_{61}$, $R_{62}$, $R_{63}$ and $R_{64}$ may be bonded together to form a ring;

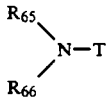

(VI-II)

wherein $R_{65}$ and $R_{66}$ each independently is a hydrogen atom, an alkyl group, an alkenyl group, an alkynyl group, an aryl group or a saturated or unsaturated heterocyclic group, and $R_{65}$ and $R_{66}$ may be bonded together to form a ring; T is a group containing

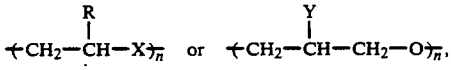

where R is a hydrogen atom or an alkyl group, X is an oxygen atom, a sulfur atom or an NH group, Y is a hydrogen atom or a hydroxy group, and n is an integer of 2 or more, provided that when R is a hydrogen atom, X is a sulfur atom or an NH group; p1 wherein the surface of said silver halide photographic emulsion layer has a pH within the range of 6.0 to 7.5.

2. A high-contrast silver halide photographic light-sensitive material as recited in claim 1, wherein the pH of said surface is within the range of 6.1 to 6.5.

3. A high-contrast silver halide photographic light-sensitive material as recited in claim 1, wherein the amine or quaternary onium compound is of the Formula (V-I), (V-II), (VI-III), (VI-I), (VI-II) or (VI-III).

4. A high-contrast silver halide photographic light-sensitive material as recited in claim 3, wherein the amine or quaternary onium compound is of the Formula (V-I), (V-II), (VI-I), or (VI-II).

5. A high-contrast silver halide photographic light-sensitive material as recited in claim 4, wherein the amine or quaternary onium compound is of the Formula (VI-II).

6. A high-contrast silver halide photographic light-sensitive material as recited in claim 1, wherein said hydrazine derivative and said amine or quaternary onium compound are each present in an amount of from $5\times10^{-7}$ mol to $5\times10^{-1}$ mol per mol of silver halide present in the silver halide photographic emulsion layer.

7. A high-contrast silver halide photographic light-sensitive material as recited in claim 6, wherein said amount is from $5\times10^{-6}$ mol to $1\times10^{-2}$ mol per mol of silver halide present in the silver halide photographic emulsion layer.

8. A high-contrast silver halide photographic light-sensitive material, comprising a support and at least one silver halide photographic emulsion layer on one side of said support, said silver halide photographic emulsion layer containing:

(i) a hydrazine derivative of the Formula (A-1):

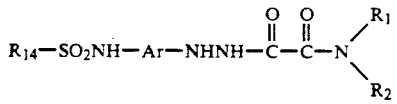

(A-1)

wherein $R_1$ and $R_2$ each independently is a hydrogen atom, an alkyl group, an alkenyl group, an alkynyl group, an aryl group, a saturated or unsaturated heterocyclic group, a hydroxy group, an alkoxy group, an alkenyloxy group, an alkynyloxy group, an aryloxy group or a heterocyclic-oxy group, provided that at least one of $R_1$ and $R_2$ is an alkenyl group, an alkynyl group, a saturated heterocyclic group, a hydroxy group, an alkoxy group, an alkenyloxy group, an aryloxy group or a heterocyclic-oxy group; $R_{14}$ is an alkyl group, an aryl group or a saturated or unsaturated heterocyclic group; and Ar is an arylene group or a saturated or unsaturated heterocyclic group; and (ii) a compound selected from amine compounds and quaternary onium salts of the Formulae (V-I), (V-II), (VI-I), and (VI-II):

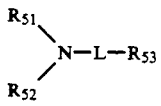

(V-I)

wherein $R_{51}R_{52}$ and $R_{53}$ each independently is an alkyl group, an alkenyl group, an alkynyl group, an aryl group or a saturated or unsaturated heterocyclic group, provided that at least one of $R_{51}$, $R_{52}$ and $R_{53}$ is an alkenyl group or an alkynyl group or at least one of $R_{51}$ and $R_{52}$ is an aryl group or a saturated or unsaturated heterocyclic group, and $R_{51}$, $R_{52}$ and $R_{53}$ may be bonded together to form a ring; and L is a linking group of the formula A'—Y, wherein A' is an alkylene group and Y is a —$CONR_{34}$—, —$OCONR_{34}$—, —$NR_{34}CONR_{34}$—, —$NR_{34}COO$—, —COO—, —OCO—, —CO—, —OCOO—, —$NR_{34}CO_{13}$, —$SO_2NR_{34}$—, —$NR_{34}SO_2$—, —$NR_{34}SO_2NR_{34}$—, —$SO_2$—, —S—, —O—, —$NR_{34}$— or —N= group;

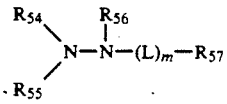

(V-II)

wherein $R_{54}$, $R_{55}$ and $R_{57}$ each independently is an alkyl group, an alkenyl group, an alkynyl group, an aryl group or a saturated or unsaturated heterocyclic group, and $R_{54}$ and $R_{55}$ may be bonded together to form a ring; $R_{56}$ is a hydrogen atom or a substituent selected from alkyl, alkenyl, alkynyl, aryl and heterocyclic groups; and L is a linking group selected from —CO—, —COO—, —$CONR_{58}$, —$SO_2$— and —$SO_2NR_{58}$— groups, wherein $R_{58}$ is a hydrogen atom or a substituent selected from alkyl, alkenyl, alkynyl, aryl and heterocyclic groups; and m is 0 or 1;

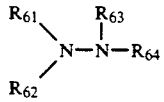

(VI-I)

wherein $R_{61}$ and $R_{62}$ each independently is an alkyl group, an alkenyl group, an alkynyl group, an aryl group or a heterocyclic group; $R_{63}$ is a hydrogen atom or a substituent selected from alkyl, alkenyl, alkynyl, aryl, saturated and unsaturated heterocyclic, acyl, sulfonyl, oxycarbonyl and carbamoyl groups; $R_{64}$ is a group containing

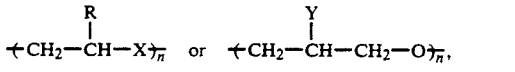

where R is a hydrogen atom or an alkyl group, X is an oxygen atom, a sulfur atom or an NH group, Y is a hydrogen atom or a hydroxy group, and n is an integer of 2 or more; and $R_{61}$, $R_{62}$, $R_{63}$ and $R_{64}$ may be bonded together to form a ring;

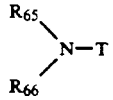

(VI-II)

wherein $R_{65}$ and $R_{66}$ each independently is a hydrogen atom, an alkyl group, an alkenyl group, an alkynyl group, an aryl group or a saturated or unsaturated heterocyclic group, and $R_{65}$ and $R_{66}$ may be bonded together to form a ring; T is a group containing $$\left(CH_2-\overset{R}{\overset{|}{C}}H-X\right)_n \quad \text{or} \quad \left(CH_2-\overset{Y}{\overset{|}{C}}H-CH_2-O\right)_n,$$

where R is a hydrogen atom or an alkyl group, X is an oxygen atom, a sulfur atom or an NH group, Y is a hydrogen atom or a hydroxy group, and n is an integer of 2 or more, provided that when R is a hydrogen atom, X is a sulfur atom or an NH group; wherein the surface of said silver halide photographic emulsion layer has a pH within the range of 6.0 to 7.5.

9. A high-contrast silver halide photographic light-sensitive material as recited in claim 8, wherein the pH of said surface is within the range of 6.1 to 6.5.

where the surface of said silver halide photographic emulsion has a pH within the range of 6.0 to 7.5.

10. A high-contrast silver halide photographic light-sensitive material as recited in claim 9, wherein the amine or quaternary onium compound is of the Formula (VI-II).

11. A high-contrast silver halide photographic light-sensitive material as recited in claim 10, wherein said hydrazine derivative and said amine or quaternary onium compound are each present in an amount of from $5\times10^{-7}$ mol to $5\times10^{-1}$ mol per mol of silver halide present in the silver halide photographic emulsion layer.

12. A high-contrast silver halide photographic light-sensitive material as recited in claim 11, wherein said amount is from $5\times10^{-6}$ mol to $1\times10^{-2}$ mol per mol of silver halide present in the silver halide photographic emulsion layer.

* * * * *

UNITED STATES PATENT AND TRADEMARK OFFICE

CERTIFICATE OF CORRECTION

PATENT NO. : 5,229,248

DATED : July 20, 1993

INVENTOR(S) : Takashi SANPEI et al.

It is certified that error appears in the above-indentified patent and that said Letters Patent is hereby corrected as shown below:

Claim 1, column 138, line 47, correct "$R_{15}R_{16}$" to --$R_{15}$, $R_{16}$-;

column 139, line 14, correct "-$NR_{34}CO_{13}$," to -- -$NR_{34}CO$-, --;

column 139, line 30, correct "more:" to --more;--;

column 139, line 30, correct "-$CONR_{58}$," to -- -$CONR_{58}$- --;

column 140, line 68, delete "p1".

Claim 3, column 141, line 9, correct the first occurrence of "(VI-III)" to --(V-III)--.

Claim 8, column 141, line 64, correct "$R_{51}R_{52}$" to --$R_{51}$, $R_{52}$-;

column 142, line 9, correct "-$NR_{34}CO_{13}$" to -- -$NR_{34}CO$- --;

column 142, line 27, correct "-$CONR_{58}$," to -- -$CONR_{58}$- --.

UNITED STATES PATENT AND TRADEMARK OFFICE

CERTIFICATE OF CORRECTION

PATENT NO. : 5,229,248

DATED : July 20, 1993

INVENTOR(S) : Takashi Sanpei, et al

It is certified that error appears in the above-indentified patent and that said Letters Patent is hereby corrected as shown below:

Column 143, below claim 9, delete the text on lines 19-20 in its entirety,

Signed and Sealed this

Twenty-fourth Day of May, 1994

*Attest:*

Bruce Lehman

BRUCE LEHMAN

*Attesting Officer*

*Commissioner of Patents and Trademarks*